US006102385A

United States Patent [19]

Wakamatsu et al.

[11] Patent Number: 6,102,385

[45] Date of Patent: Aug. 15, 2000

[54] FINISHER

[75] Inventors: Shinji Wakamatsu; Norihiko Suzuki, both of Toyokawa, Japan

[73] Assignee: Minolta Co., Ltd., Osaka, Japan

[21] Appl. No.: 08/946,489

[22] Filed: Oct. 7, 1997

[30] Foreign Application Priority Data

Mar. 12, 1997 [JP] Japan ..... 9-058120

[51] Int. Cl.[7] ..... B65H 39/02

[52] U.S. Cl. ..... 270/58.12; 270/58.08; 270/58.07; 270/58.09; 271/221; 271/222; 271/233; 271/236

[58] Field of Search ..... 270/58.12, 58.16, 270/58.08, 58.07, 58.09; 271/221, 222, 233, 236, 239, 245, 226

[56] References Cited

U.S. PATENT DOCUMENTS

| | | | |
|---|---|---|---|
| 4,905,053 | 2/1990 | Matsuo et al. | 355/319 |
| 5,032,876 | 7/1991 | Murakami | 355/324 |
| 5,099,292 | 3/1992 | Hirose | 355/324 |
| 5,253,860 | 10/1993 | Hirose et al. | 271/176 |
| 5,344,130 | 9/1994 | Suzuki et al. | 270/53 |
| 5,382,011 | 1/1995 | Tani | 270/37 |
| 5,772,198 | 6/1998 | Yamamoto | 270/58.17 |
| 5,791,644 | 8/1998 | Regimbal et al. | 270/58.12 |
| 5,839,048 | 11/1998 | Kato | 399/407 |
| 5,857,670 | 1/1999 | Jung | 270/58.12 |
| 5,905,935 | 5/1999 | Wakamatsu et al. | 399/407 |

*Primary Examiner*—Joseph E. Valenza
*Assistant Examiner*—Michael E. Butler
*Attorney, Agent, or Firm*—Sidley & Austin

[57] ABSTRACT

A finisher includes an additional-working tray and a leading edge stopper and trailing edge stopper for aligning folded and unfolded sheets fed into the additional-working tray. The leading edge stopper contacts a leading edge of each sheet when it is fed into the additional-working tray. The trailing edge stopper is movable relative to the additional-working tray in accordance with a sheet length. The trailing edge stopper is adapted to align one or more sheets received in the additional-working tray relative to a discharge direction.

23 Claims, 41 Drawing Sheets

NORMAL STAPLE MODE

FOLD STAPLE MODE

Z-FOLDING

DOUBLE-FOLDING

CREASING MODE

MIXED STAPLE MODE

UNFOLDED AND Z-FOLDING

FINISHER

BACKGROUND OF THE INVENTION

1. Field of the Invention

This invention relates to a finisher which gives such additional-workings as creasing, folding, punching, stapling and binding to sheets outputted from such image forming devices as printers and copying machines. More particularly, this invention relates to a finisher which gives the sheets the additional-workings, which include at least the mode of folding a sheet to a size smaller than the size of the sheet in the unfolded state, and aligns a sheaf of stacked sheets in a receiving tray unit which stores and stacks sheets.

2. Description of the Related Art

Recently, various finishers which give various additional-workings to sheets with an image formed surface which are outputted from such image forming devices as printer and copying machines, have been proposed. The term "additional-workings" as used herein means various working processes such as sorting sheets, filing sheets with staples, folding sheets in two (double-folding), creasing sheets (creasing), or folding sheets in three or in a cross section like a letter Z (Z-folding), binding sheets with mucilage, and punching sheets for filing. The finisher generally is provided with a receiving tray unit for temporarily storing sheets that have been folded and punched. The sheaf of sheets, which has been stacked and aligned in the receiving tray unit, is conveyed to a stapler and is stapled.

In the field of ordinary printers and copying machines, the end faces of the sheets are aligned along the conveying direction. The alignment is attained by utilizing the weight of sheet, having a transmission gear, or adjusting the angle of a tray U.S. Pat. No. 4,905,053, for example).

The conventional finisher with a stapling mechanism and a sheet folding mechanism aligns a sheet in the conveying direction without reference to the presence or absence of a sheet folding.

The alignment utilizing the weight of a sheet, therefore, encounters many unstable factors and tends to produce an imperfect result.

The alignment which uses a transmission gear only necessary to a small sheet or a folded sheet has such problems as boosting production cost and electric power consumption, and suffering degradation of productivity because of the inability to quickly do the series of additional-workings due to the addition of the transmission gear.

Further, the folded sheet has an unstable shape as compared with an equivalent sheet in an unfolded state because of the presence of the crease of fold. The alignment which uses a tray capable of varying the working angle and necessary only for aligning a folded sheet with an unstable shape, has the problem of boosting manufacturing cost and electric power consumption due to the additional device for the adjustment of the tray angle.

SUMMARY OF THE INVENTION

An object of this invention is to provide a finisher which is capable of steadily aligning a sheaf even when the sheaf include folded sheets. Another object of this invention is to provide a finisher which reduced production cost and electric power consumption, and refrains from impeding productivity.

To accomplish the objects, this invention concerns a finisher for stacking sheets folded to a size smaller than the size of an equivalent sheet in an unfolded state, the finisher comprising: a receiving tray unit stacking sheets, a first regulating device disposed as projected from the receiving tray unit and contacting to one end face of a sheaf stacked in the receiving tray unit, and a second regulating device disposed as projected from the receiving tray unit and contacting to leading ends of sheets fed into the receiving tray unit, which presses the other end face of the sheaf and aligns one end face with the first regulating device, the second regulating device being actuated, when the sheaf include sheets folded by a fold mode for folding sheets to a size smaller than the size of an equivalent sheet in an unfolded state, to move and push the folded sheets into the first regulating device.

In the finisher, when one sheet is conveyed in the direction of the receiving tray unit, the leading end of this sheet contacts to the second regulating device and springs back toward the first regulating device and quickly falls onto the receiving tray unit or onto the uppermost one of the sheets already held therein. As a result, the sheets can be aligned optimally and quickly, and the temporary accumulation of sheets in the receiving tray unit can be completed early even when the sheets are fed and outputted with a short interval. Owing to this merit, the finisher is enabled to carry out the series of additional-workings expeditiously and enjoy improved productivity. Moreover, the finisher utilizes the spring-back force which the sheet produces on contacting to the second regulating device. It reduces misalignment of the sheet as compared with the alignment which resorts solely to the weight of sheet. When the sheaf include folded sheets, the second regulating device is actuated to move and push the folded sheets into the first regulating device. In other words, the receiving tray unit effects stable alignment by considering the fact that the sheaf includes folded sheets. Moreover, the alignment does not utilize a transmission gear, and the productivity is not decreased. The addition of a transmission gear or a device for adjusting the tray angle is not required. It prevents manufacturing cost or electric power consumption from increasing.

The workings performed in the finisher include a double-folding and a Z-folding.

The finisher is connected to an image forming device for forming a image on a sheet and performs various additional-workings on a sheet having an image formed surface which has been outputted from the image forming device. The work of sheet folding is performed in the finisher and the additional-workings include a stapling and a binding.

The second regulating device is preferably disposed on a side of the receiving tray unit where a crease of the sheets folded by the fold mode is located, and is formed in a shape curved toward the first regulating device. To be specific, the second regulating device has a radius or is rounded, or has a bent shape.

When folded sheets are stacked, the resultant sheaf of the sheets is not parallel to the stacking face of the receiving tray unit but inclines toward the first regulating device side from the second regulating device side. The inclination sharply increases in response to the number of folded sheets stored in the receiving tray unit. If the second regulating device is so shaped as to perpendicularly intersect the stacking face of the receiving tray unit, it cannot satisfactorily align sheets in the upper part of the sheaf. In contrast, the second regulating device according to the invention is formed in a curved shape. Consequently, the alignment of the sheaf including folded sheets is done uniformly and perfectly throughout from the lower part to the upper part of the sheaf.

DETAILED DESCRIPTION OF THE PREFERRED EMBODIMENTS

The preferred embodiments of this invention will be described below with reference to the accompanying drawings.

Figure 1:
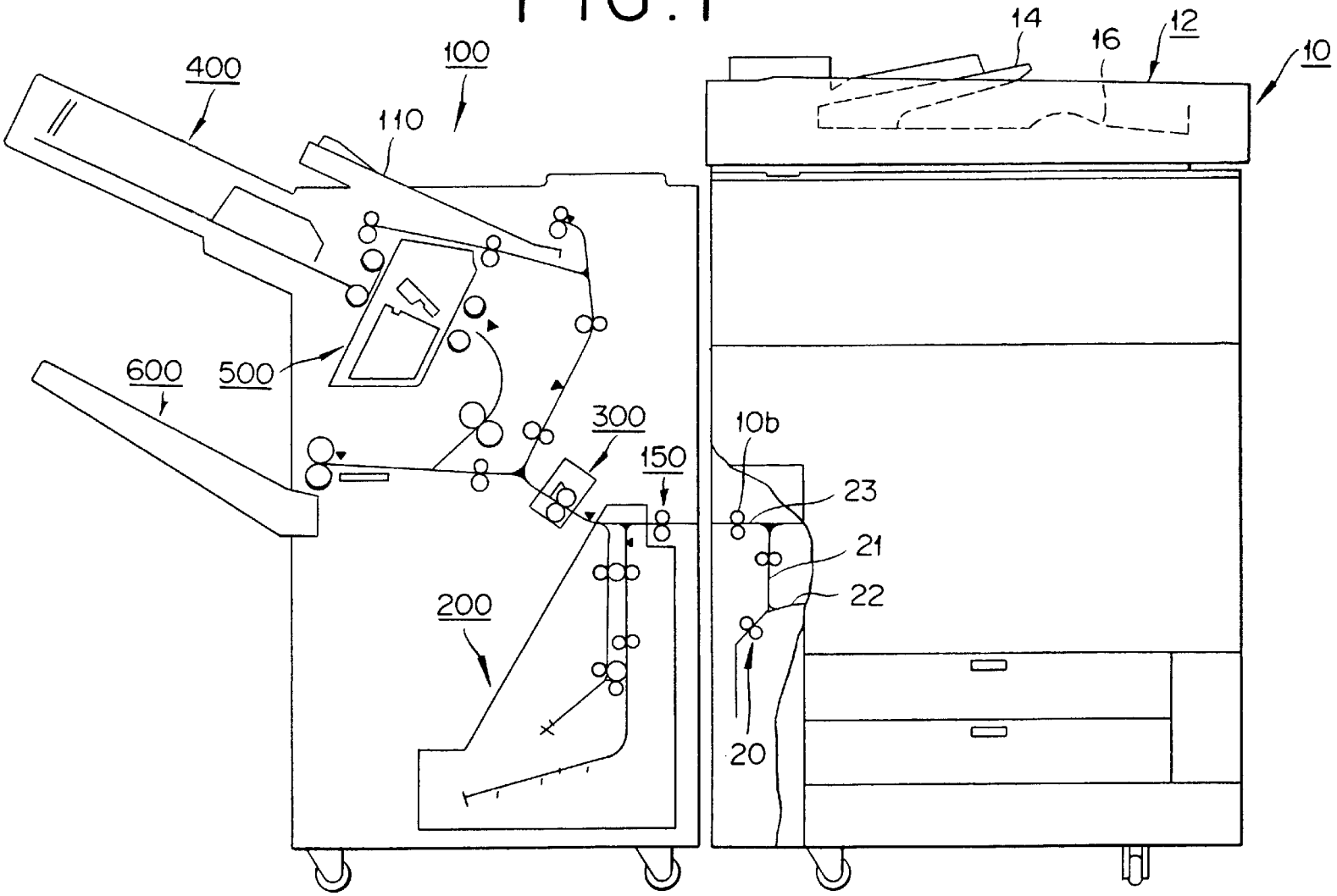
FIG. 1 is a schematic explanatory cross section illustrating an embodiment having a finisher according to this invention connected to a copying machine as an image forming device.
Figure 2:
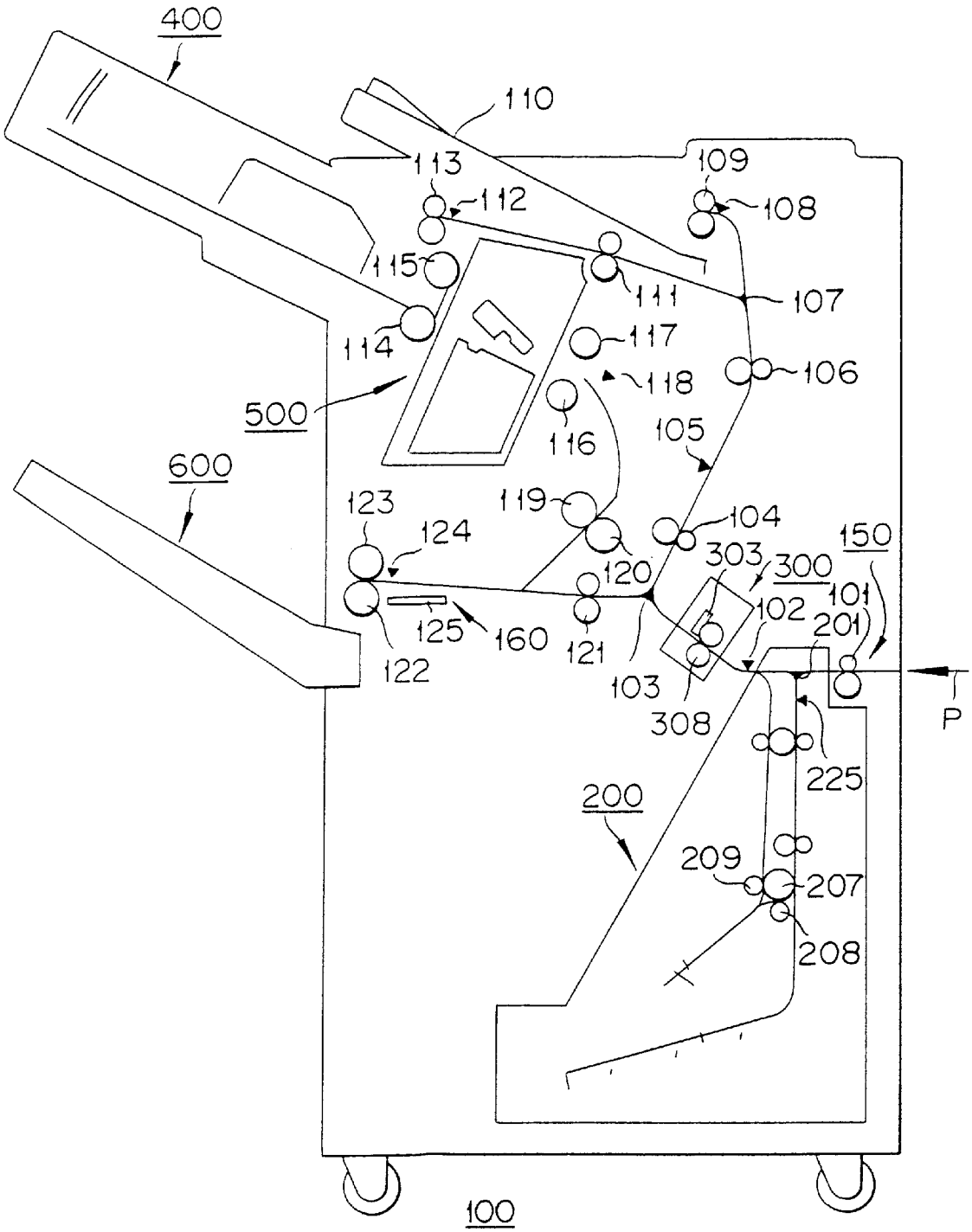
FIG. 2 is a schematic structural diagram illustrating the essential section of the finisher.

FIG. 1 is a schematic explanatory cross section illustrating an embodiment having a finisher 100 according to this invention connected to a copying machine 10 as an image forming device and FIG. 2 is a schematic structural diagram illustrating the essential section of the finisher 100.

In this specification, the direction of conveyance of a sheet will be referred to as "conveying direction" and the direction perpendicular to the conveying direction as "orthogonal direction." Then, the orientations of a sheet are defined as follows relative to the conveying direction. The orientation of the sheet whose longitudinal direction falls along the conveying direction will be referred to as "longitudinal" and the orientation of the sheet whose longitudinal direction perpendicularly crosses the conveying direction as "lateral."

COPYING MACHINE 10

The illustrated copying machine 10 to which the finisher 100 is connected is what is called a digital copying machine. The digital copying machine reads and temporarily stores in a memory an image on the surface of a document and, when necessary, executes various image processings. Then, it forms the image on a sheet by the well-known electrophotographic method and outputs sheets with the copied image one by one from a sheet output section 10*b*.

The copying machine 10 has an automatic document feeder 12 (hereinafter referred to as "ADF")on the upper section. The ADF 12 feeds one document or a plurality of documents (group of documents) set on a tray 14 one by one onto a platen glass (not shown) of the copying machine 10 and, after scanning the image, outputs and stacks the document onto a tray 16.

The copying machine 10 of the present embodiment is a so-called first page system which starts a copying motion from the first page onward of the group of documents. On the tray 14 of the ADF 12, the group of documents are set, with the first page turned upward. The copying machine of the first page system obviates the necessity for inputting or detecting the number, odd or even, of the documents in the group as when an image on one side of the document is copied on the obverse and reverse sides of one sheet. It produces advantages such as a quick copying motion.

As the document is set on the platen glass as by the ADF 12, the image on the document is read by an image reader (not shown) built in the copying machine 10, converted into digital data, and stored in a memory of the control unit. The copying operation, after read out of the image data, is executed as combined with such necessary editorial processings as, for example, changing the order of pages, inverting an image, or producing copied images on both sides of a sheet.

This copying machine 10 is provided near the sheet output section 10*b* with a turn-back mechanism 20 for turning a sheet with copied image upside down. This mechanism will be described more specifically herein below.

<<General construction and general operation of finisher 100>>

[General construction]

The finisher 100 of the present embodiment performs, either selectively or as suitably combined, such a folding work as folding the sheets outputted from the sheet output section 10*b* of the copying machine 10 and conveyed one by one, in two or three (Z-folding in a cross section like a letter Z) as occasion demands, a punching work for forming holes for filing in the edges of the sheets, and a stapling for binding a sheaf with staples. Further, in this finisher 100 the mode of conveyance of sheets, the mode of stacking of sheets, or the mode of folding of sheets are designed on the assumption that it will be used as connected to the copying machine or a printer as an image forming device of the first page system.

The finisher 100, as illustrated in FIG. 2, comprises a feed channel section 150 through which a sheet P outputted from the sheet output section 10*b* is fed, a folding device 200 which folds or creases the sheets conveyed one by one, a punching device 300 which forms holes for filing in the sheets P conveyed one by one, an additional-work tray unit 400 which stacks and aligns the sheets before a stapling work, a stapler 500 disposed on the downstream side of the additional-work tray unit 400 and stapling a sheaf of stacked and aligned sheets, an accumulating tray unit 600 which is capable of receiving a stapled sheaf or an unstapled sheet, and an output tray unit 110 which receives the sheets outputted from the finisher 100.

The feed channel section 150 is provided with a conveying roller 101 and a guide plate. The folding device 200 is provided with a plurality of folding rollers 207, 208, and 209 and is adapted to nip a sheet P between the folding rollers 207, 208, and 209 and folds or creases the sheet P. The stapler 500 is so constructed as to be moved in the two directions, i.e. the conveying direction and the orthogonal direction of the sheaf stacked and aligned in the additional-work tray unit 400.

For the purpose of conveying the sheet to various sections in the finisher 100, conveying rollers 104, 106, 111, and 121 are disposed along the sheet conveying paths. For the purpose of conveying the sheaf, sheaf-conveying rollers 114 and 115, 116 and 117, and 119 and 120 are disposed along the conveying paths of the sheaf. A discharge roller 109 for discharging the sheet P into the output tray unit 110, a discharge roller 113 for discharging the sheet P into the additional-work tray unit 400, and discharge rollers 122 and 123 for discharging the sheet P or the sheaf into the accumulating tray unit 600 are respectively disposed at the terminal positions of the conveying paths.

For the purpose of changing the destination of the sheet being conveyed, a plurality of switch claws 201, 103 and 107 are disposed on the sheet conveying paths. The switch claw 201, which is disposed between the feed channel section 150 and the folding device 200, decides whether or not the sheet P is fed into the folding device 200. The punching device 300 is disposed on the downstream side of the switch claw 201 and is enabled to punch the sheet conveyed from the feed channel section 150 or the sheet conveyed from the folding device 200. The switch claw 103 disposed on the downstream side of the punching device 300 directs whether the sheet P is conveyed to the output tray unit 110 or to the additional-work tray unit 400 or the sheet P is directly conveyed to the accumulating tray unit 600. The switch claw 107 disposed on the downstream side of the switch claw 103 directs whether the sheet P is conveyed to the output tray unit 110 or to the additional-work tray unit 400.

For the purpose of timing the driving or stopping the various components in the finisher 100, a plurality of sensors 102, 105, 108, 112, 118, 124 and 225 for detecting the sheet are disposed on the sheet and sheaf conveying paths.

The finisher 100 of the present embodiment is further provided with a guide unit 160 for preventing the sheaf bound by stapling like a weekly magazine from being defectively discharged into the accumulating tray unit 600. The guide unit 160 illustrated in the diagram is composed of an auxiliary guide 125 which supports the lower side of the sheaf discharged from a space between discharge rollers 122 and 123, and is allowed freely to advance and retract. This construction permits the leading end of the sheaf being discharged to fall toward the downstream side along the discharging direction, further than the peak of the formerly discharged center bound sheaf even when the sheaves of sheets are stacked such that the bound sections project upward like a mountain. This results in precluding the possibility of the leading ends of the successively discharged sheaves being caught in the neighborhood of the peaks of the already stacked sheaves.

[General operation]

The finisher 100 is capable of performing a plurality of additional-workings (folding, punching and stapling) on the sheets. The user of the finisher 100 may select freely these works by the use of a control panel of the copying machine 10.

When the user selects a mode excluding a stapling, the sheet P discharged from the sheet output section 10*b* of the copying machine 10 is worked by the folding device 200 and the punching device 300 in response to instructions of the user and conveyed by means of rollers to the output tray unit 110 or the accumulating tray unit 600 for storage.

When the user selects a mode including a stapling, first the sheet P is worked by the folding device 200 and the punching device 300 in response to instructions of the user as similarly to the mode excluding the stapling. Then, a certain number of sheets P which have been folded and/or punched are conveyed to the additional-work tray unit 400 and sequentially stacked and aligned Thereafter, the sheets which have been stacked and aligned are fed as one sheaf by rollers to the stapler 500.

After the stapler 500 has bound the sheaf by driving staples in the sheaf at the positions selected by the user, the stapled sheaf is conveyed by the rollers to the accumulating tray unit 600 and is stored.

In this finisher 100, the folding device 200 and the punching device 300 (as means working the incoming sheets one by one) are disposed on the upstream sides of the position of the switch claw 103, or on the upstream sides of the branching points of the conveying paths to a plurality of receiving tray units (referring collectively to the output tray unit 110, the additional-work tray unit 400, and the accumulating tray unit 600). The sheets which have undergone the works (folding and punching in this embodiment) one by one, therefore, can be discharged to any of the receiving tray units.

The main mechanisms of the finisher 100 will be sequentially described in detail below.

<<Folding device 200>>

Figure 3:
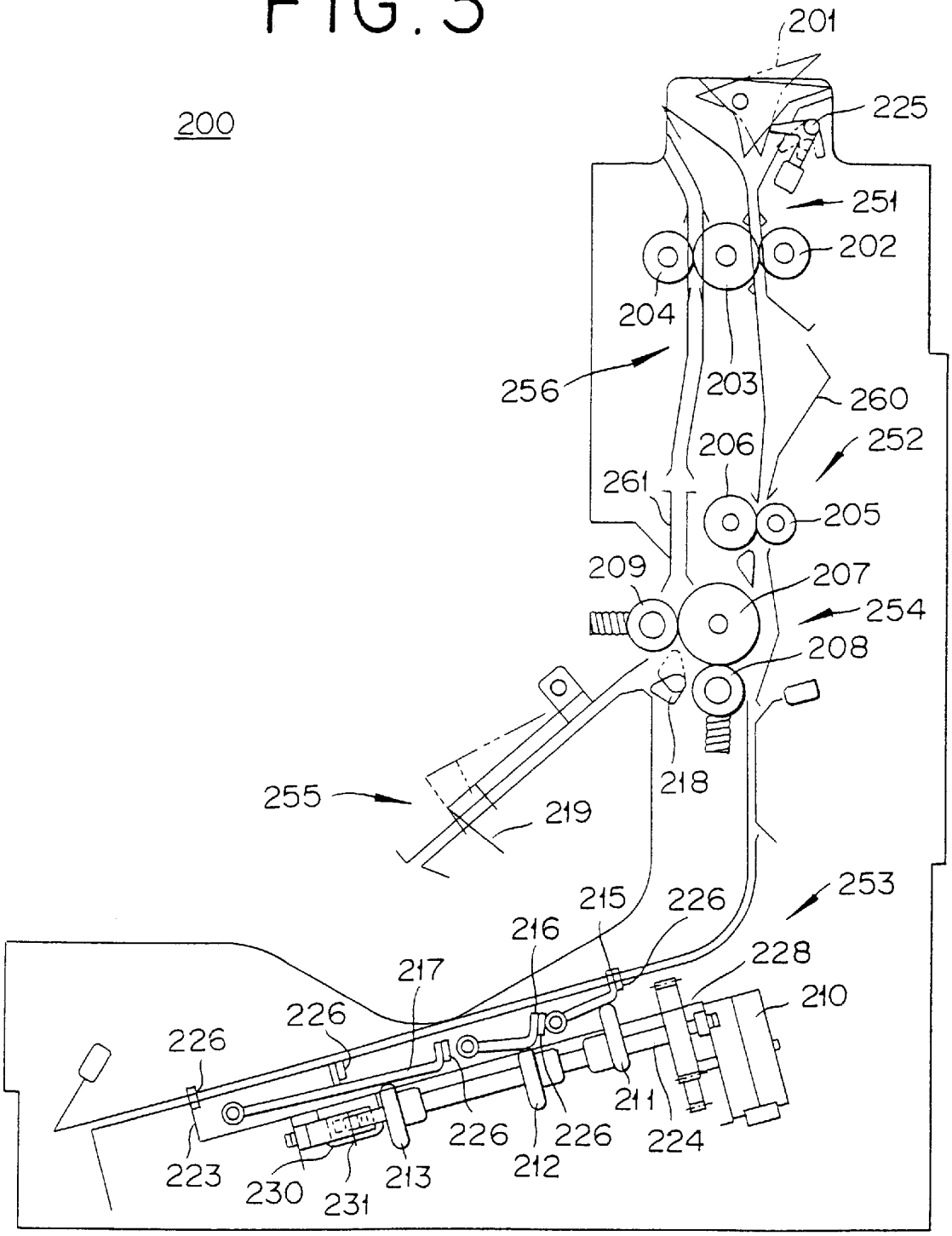
FIG. 3 is a cross section illustrating the construction of a folding device.
Figure 4:
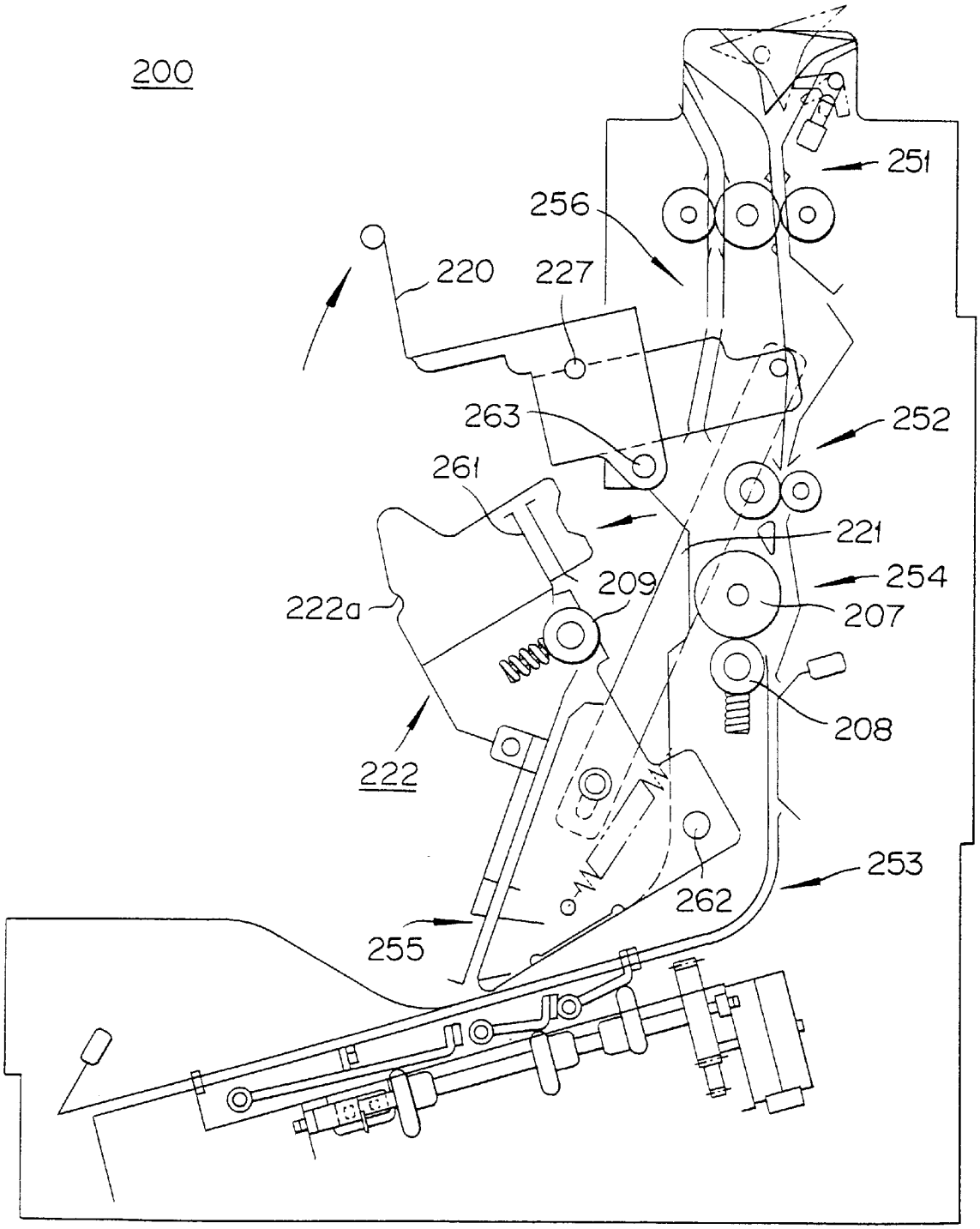
FIG. 4 is a cross section illustrating the folding device which is jammed.
Figure 5A:
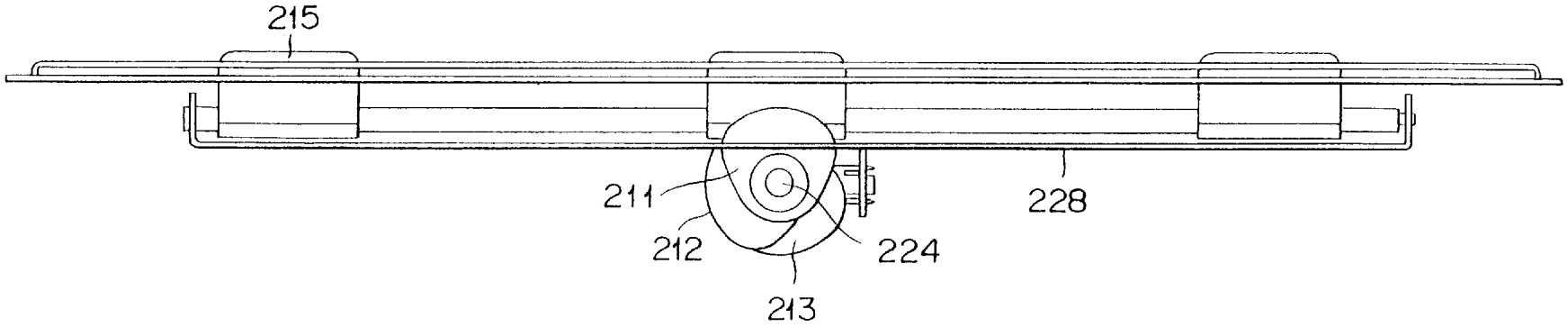
FIG. 5A and FIG. 5B are cross sections illustrating the essential section of a mechanism for regulating the first folding position in the folding device.
Figure 5B:
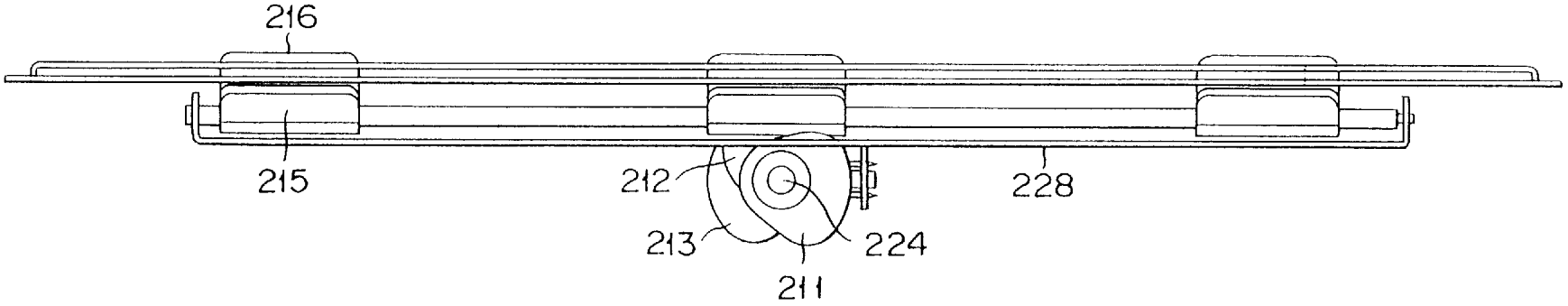
Figure 6:
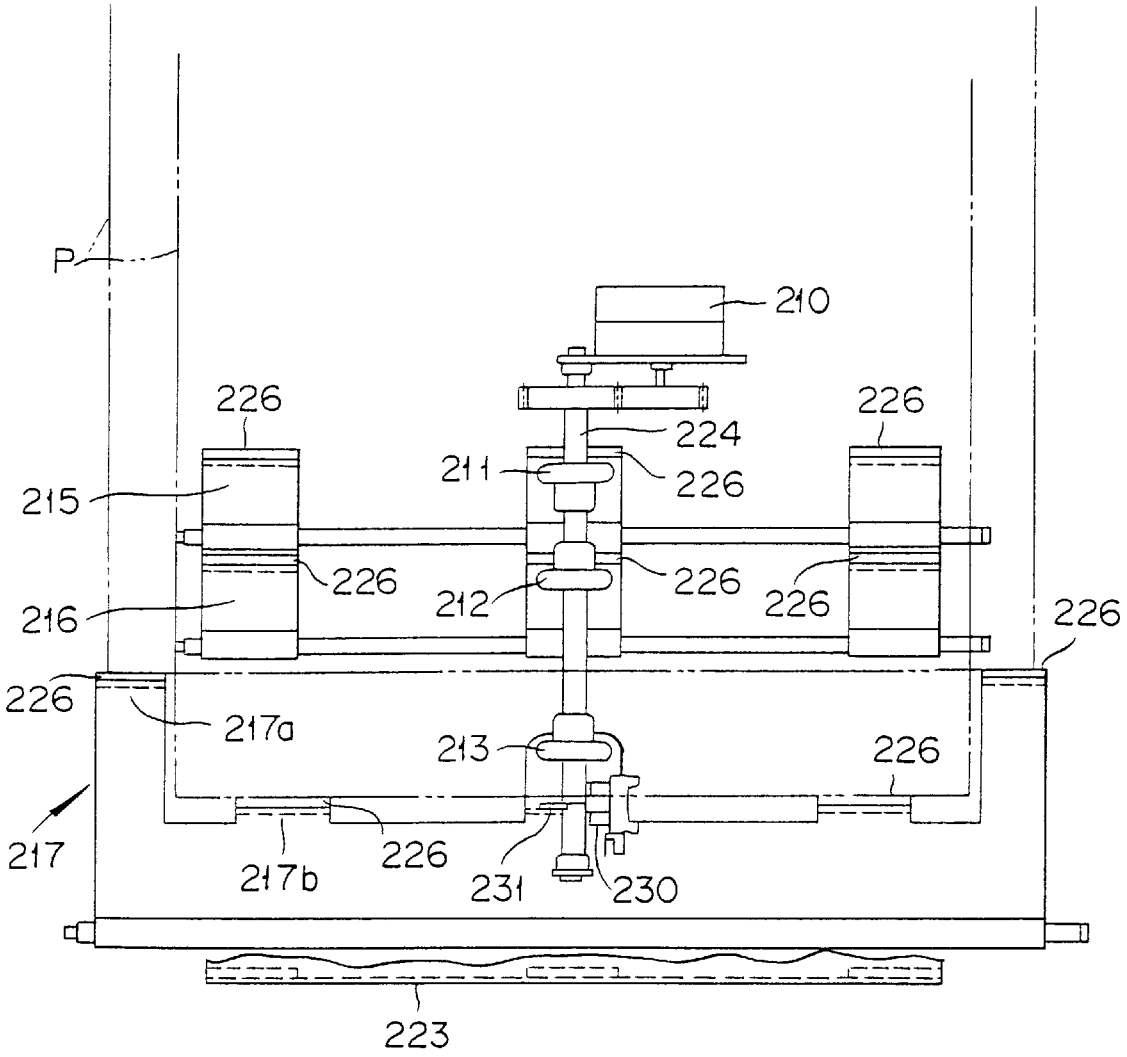
FIG. 6 is a bottom view illustrating the mechanism for regulating the first folding position in the folding device.
Figure 7:
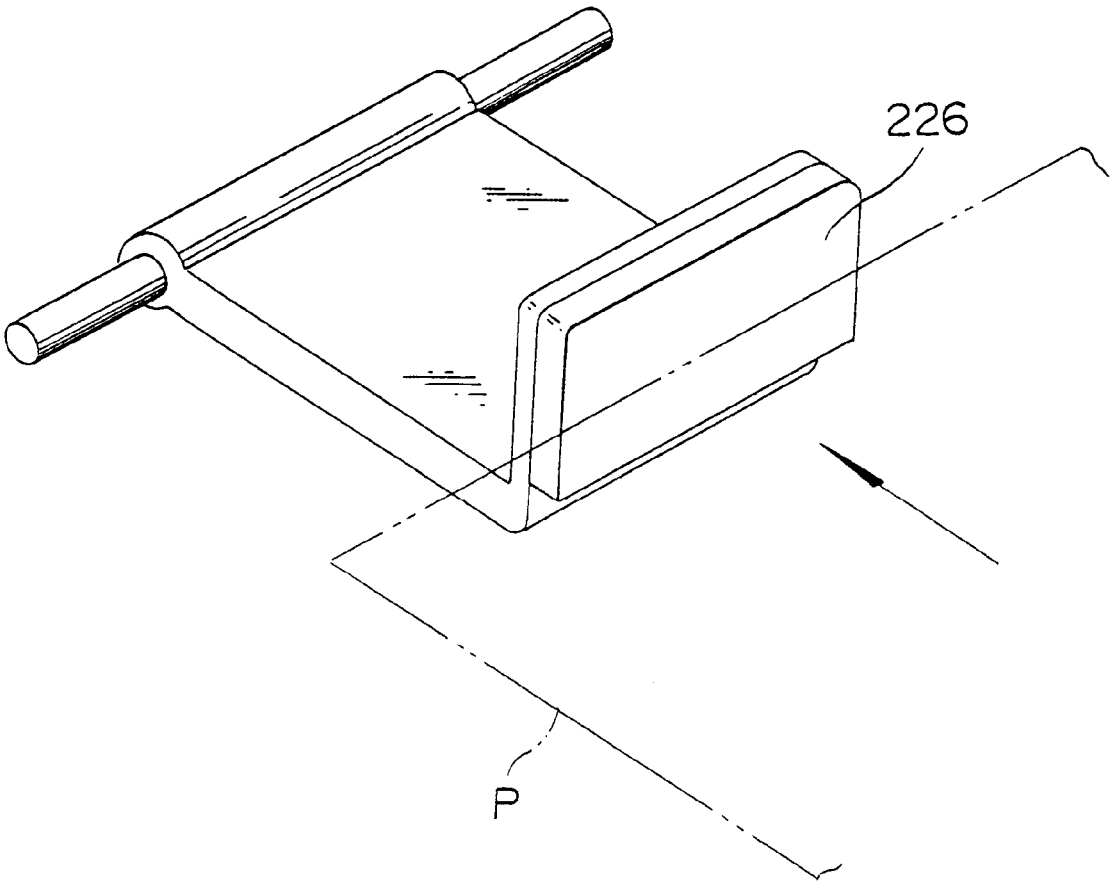
FIG. 7 is a perspective view illustrating the essential section of a first folding stopper.

FIG. 3 is a cross section illustrating the construction of the folding device 200, FIG. 4 is a cross section illustrating the folding device 200 which is jammed, FIGS. 5A and 5B and FIG. 6 are respectively cross sections and a bottom view illustrating the essential section of a mechanism for regulating a first folding position in the folding device 200, and FIG. 7 is a perspective view illustrating the essential section of a first folding stopper.

The folding device 200 is built in the finisher 100 so as to be drawn out toward the front side of the finisher 100 (the foreground side of the face of the sheet bearing FIG. 1) and is supported as mounted to a rail (not shown) extended in the longitudinal direction of the finisher 100.

The folding device 200, as illustrated in FIG. 3, is composed of a feed channel section 251 for inside feeding a sheet for folding, an adjusting section 252 for correcting the sheet fed into the folding device 200 by removing a deviation, a first conveying section 253 for regulating the first folding position of the sheet conveyed from the adjusting section 252, a folding section 254 for creasing or folding the sheet, a second conveying section 255 for regulating the second folding position, and a discharging section 256 for conveying the folded sheet from the folding device 200 to the punching device 300.

[Feed channel section 251]

The feed channel section 251 comprises the switch claw 201 which selectively guides the sheet to the folding device 200, conveying rollers 202, 203 which convey the sheet fed into the folding device 200, a solenoid (not shown) which rotates the switch claw 201, and a sheet sensor 225 which detects the sheet fed into the folding device 200.

[Adjusting section 252]

The adjusting-section 252 comprises resist rollers 205, 206 disposed on the downstream side of the feed channel section 251, a drive motor (not shown) which drives the resist rollers 205, 206 for folding a sheet, and a solenoid clutch (not shown) which selectively cuts the connection of the motor to the resist rollers 205, 206. The resist rollers 205, 206 are a pair of rollers composed of straight rollers. The surface friction coefficient $\mu$ of the roller 205 is set at a level lower than that of the other roller 206. A guide 260 which is disposed on the upstream side of the resist rollers 205, 206 is shaped such that the leading end of the sheet is made to contact infallibly to the roller 205 having a lower surface friction coefficient.

The procedure for correcting a deviated sheet is as follows.

First, the sheet sensor 225 detects the leading end of an incoming sheet. At this time, the solenoid clutch is in the OFF state and the driving force of the motor for sheet folding is not transmitted to the resist rollers 205, 206.

Then, after the elapse of the time (t+t1) [second], the solenoid clutch is turned on to transmit the driving force to the resist rollers 205, 206 to convey the sheet to the downstream side. Here, the letter "t" refers to the time [second] required for the leading end of a given sheet to reach the nip part of the resist rollers 205, 206.

In consequence of the operation, a loop, V×t1 [mm] (in which V stands for the sheet conveying speed [mm/second]) in length, is formed on the sheet between the conveying rollers 202, 203 and the resist rollers 205, 206. Owing to the formation of this loop, the leading end of the sheet is caused by the intensity of the nerve of the sheet to conform to the contour of the nip part and the deviation of the sheet is adjusted.

[First conveying section 253]

The first conveying section 253 disposed on the downstream side of the adjusting section 252 comprises first folding stoppers 215, 216, 217 and 223 which move into and out of the sheet conveying paths in accordance with the sheet size and the folding, form and regulate the first folding position of the sheet by contacting to the leading end of the sheet, cams 211, 212 and 213 which actuate the first folding stoppers 215, 216 and 217, a stepping motor 210 which rotates the cams 211, 212 and 213, and anti-deviation devices 226 of an elastic material which are disposed where the first folding stoppers 215, 216, 217 and 223 are contacted to the leading end of the sheet.

The first folding stoppers 215, 216, 217 and 223 will be described more specifically herein below. The first folding stopper 217 especially has the function of regulating the first folding position for sheets of two kinds with one stopper.

The three cams 211, 212 and 213 are fixed to a cam shaft 224 as shifted in angle such that the three first folding stoppers 215, 216 and 217 are severally moved in and out of the sheet conveying path just once each time the cam shaft 224 produces one complete rotation.

[Folding section 254]

The folding section 254 disposed between the downstream positions of the resist rollers 205, 206 and the upstream position of the first folding stopper 215 is possessed of the three folding rollers 207, 208 and 209. These folding rollers 207, 208 and 209 have a straight shape.

The folding rollers 208 and 209 are severally pressed against the folding roller 207. Namely, the folding rollers 207, 208 and the folding rollers 207, 209 are respectively in pairs. The folding rollers 207, 208 which are paired will be referred to hereinafter as "paired folding rollers 207, 208" and the folding rollers 207, 209 which are paired as "paired folding rollers 207, 209." The paired folding rollers 207, 208 are disposed such that the nip part continues into the first conveying section 253.

[Second conveying section 255]

The second conveying section 255 is disposed between the downstream positions of the paired folding rollers 207, 208 and the upstream positions of the paired folding rollers 207, 209. The second conveying section 255 comprises a second folding stopper 219 which regulates the second folding position of the sheet by contacting to the leading end of the sheet, a solenoid (not shown) which switches the position of the second folding stopper 219 contacting to the sheet in conformity with the sheet size, a switching mechanism 218 which selectively guides the leading end of the sheet which has undergone the first folding by the paired folding rollers 207, 208 in the direction of the nip part of the paired folding rollers 207, 209 or in the direction of the second folding stopper 219, and a solenoid (not shown) which rotates the switching device 218.

[Discharging section 256]

The discharging section 256 is disposed on the downstream side of the paired folding rollers 207, 209 and is possessed of discharging rollers 203 and 204. The roller 203 constitutes itself one of the conveying rollers 202, 203.

[Mechanism of restoring from jam]

The mechanism of restoring from a sheet jam which occurs in the folding section 254 of the folding device 200 will be described with reference to FIG. 4.

The folding rollers 207, 208 and 209 in the folding section 254 are added with relatively high pressing force because they are required to fold the sheet strongly. The pressing force, for example, is 10 kg per roller. When the sheet happens to be wrapped fast around any of the folding rollers 207, 208 and 209, it is a very difficult work to remove the stuck sheet, or solving the jam.

The folding device 200 of the present embodiment, therefore, releases either of the two folding rollers 208, 209 from being pressed against the folding roller 207 and opens the folding section 254 in order to improve the operational efficiency of restoring from the jam in the vicinities of the folding rollers 207, 208 and 209. This construction will be described below.

An open unit 222 is formed by integrally retaining the second conveying section 255, the single folding roller 209 and a guide 261 of the discharging section 256. This open unit 222 is supported as freely rotated around a fulcrum 262 provided on a frame of the folding device 200.

Further, a lock lever 220 constructed to encircle the periphery of the remotest section of the open unit 222 from the fulcrum 262 (as the upper end of the diagram) is supported as freely rotated around a fulcrum 263 provided on the frame. Lock shafts 227 are provided one each in the front and rear portions of the lock lever 220 extending in the direction perpendicular to the face of the sheet bearing an image. When the open unit 222 is closed, the lock shafts 227 are severally engaged with recess 22*a* formed in the open unit 222 and the open unit 222 is infallibly locked to the folding device 200.

The lock lever 220 and the open unit 222 are connected through a link device 221. The link device 221 enables the open unit 222 to be retained and rotated as synchronized with the rotation of the lock lever 220 and can preclude the fall of the open unit 222 during the relief of the lock.

[Detailed construction of first folding stopper]

As illustrated in FIG. 5A, FIG. 5B and FIG. 6, the first folding stoppers 215, 216, 217 and 223 as devices for regulating the leading end of the sheet, the cams 211, 212 and 213, the stepping motor 210, and the cam shaft 224 are integrally held by a stopper unit frame 228.

Excepting the stopper 223 disposed on the most downstream side in the conveying direction of the sheet, the first folding stoppers 215, 216 and 217 are constructed as freely rotated around respective fulcrums provided on the stopper unit frame 228. The first folding stopper 223 is fixed to the stopper unit frame 228 and retained as constantly projected into the sheet conveying path.

The first folding stoppers 215, 216 and 217 are driven to move into and out of the sheet conveying path by the rotation of the cams 211, 212 and 213 and the cam shaft 224 which are disposed on the lower side of the frame 228. The cams 211, 212 and 213 are attached in different angles to the cam shaft 224. The first stoppers 215, 216 and 217 move severally into and out of the sheet conveying path while the cam shaft 224 produces one complete rotation. The stepping motor 210 rotationally drives the cam shaft 224. One of the first folding stoppers 215, 216 and 217 is moved into and out of the sheet conveying path by actuating the stepping motor 210 in a desired angle proper for the folding mode or the sheet size.

The cam shaft 224 is provided with a light stop or gobo 231. The gobo 231 is moved into and out of the detecting area of a home position sensor 230 in consequence of the rotation of the cam shaft 224. The position at which the home position sensor 230 detects the gobo 231 is the home position for the cam shaft 224. At the home position, all the first folding stoppers 215, 216 and 217 that are capable of moving into and out of the sheet conveying path are not in a projecting state except the first folding stopper 223.

The first folding stopper 217 is designed to have the function of regulating two kinds of folding positions. To be specific, it is approximately shaped like a letter U having the opposite ends projected toward the upstream side in the conveying direction of the sheet as clearly shown in FIG. 6. This shape is applicable only when the position for regulating the leading end of a sheet of a small width relative to the orthogonal direction falls on the downstream side in the conveying direction from the position for regulating the leading end of a sheet of a large width. Naturally, in this case, the stopper for the sheet of a large width must be disposed on the outer side along the orthogonal direction than the stopper for the sheet of a small width. In other words, the first folding stopper 217 is required to form, at the upstream position in the conveying direction, a notch of a width larger than the width of that of the two kinds of sheet which has a smaller width. The edges of the notch, or the edge located on the upstream side in the conveying direction and the edge located on the bottom, function as stoppers which contact to the leading edges of the two different kinds of sheet, respectively In the illustrated embodiment, the first folding stopper 217 is constructed by integrating stoppers 217*a* disposed on the opposite outer sides used in double-folding of an A3 with a stopper 217*b* disposed on the further downstream side than the stopper 217*a* and used in Z-folding of a B4 sheet.

The anti-deviation device 226 is mounted where the first folding stoppers 215, 216, 217 and 223 contact to the leading end of the sheet as illustrated in FIG. 7. The anti-deviation device 226 is provided for the purpose of precluding the inconvenience that the leading end of the sheet slides laterally on the contacting face of a stopper and induces deviation of the folding position. This fact explains why the anti-deviation device 226 is made of an elastic material with a high surface friction coefficient and a low hardness. The anti-deviation device 226 is also effective in abating the noise which is made when the leading end of the sheet contacts to the stopper.

The advantages of the construction are as follows.

Firstly, the deviation of positions occurring when the leading end of a sheet is regulated is slight. Because the devices for regulating the leading end of a sheet, or stoppers 215, 216, 217 and 223 are disposed one each at the plurality of positions used or required for regulating the leading end of a sheet.

Secondly, one motor 210 suffices as a drive source. Because the plurality of devices for regulating the leading end of a sheet can be actuated by the single cam shaft.

Thirdly, the components for actuation can be simplified.

Because a device for regulating the leading end of a sheet, or stopper 217 has the function of regulating the leading ends of two kinds of sheet and a device for regulating the leading end of a sheet on the most downstream side, or stopper 223 has a stationary structure. Namely, the function of regulating the leading end of a sheet can be accomplished with high accuracy by means of simple and inexpensive construction.

It is, when necessary, allowable to divide the drive system into two and add the cam shafts, etc. though one cam shaft and one motor suffice to actuate the plurality of devices for regulating the leading end of a sheet.

[Operation of various folding modes]

The folding device 200 has the three folding modes, (1) Z-folding, (2) double-folding, and (3) creasing. When the folding mode is inputted through a control panel provided in the copying machine 10, the folding device 200 is controlled in the inputted mode.

(1) Z-Folding Mode

Figure 8:
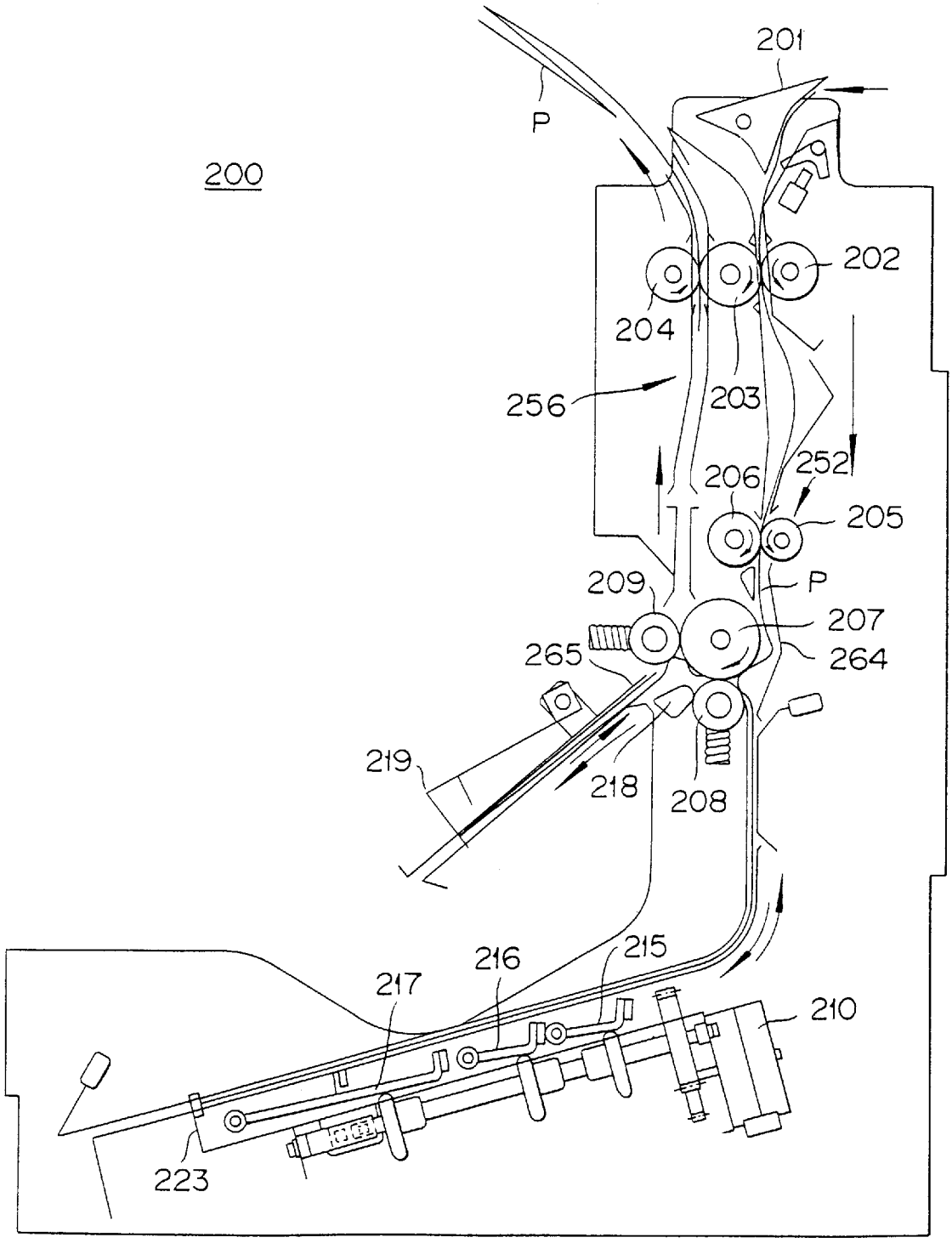
FIG. 8 is a cross section illustrating the state of the folding device under the A3 Z-folding mode.

FIG. 8 is a cross section illustrating the state of the folding device 200 under the A3 Z-folding mode. In the diagram, the states which the sheet P assume at different points of time are simultaneously indicated in the folding device 200 as well as in FIGS. 9 and 10.

The term "Z-folding mode" refers to a mode of folding a sheet of a large size (A3 or B4) in a cross section like a letter Z, or in the sheet in a size approximately one half of the original length of the sheet along the conveying direction The sheet P outputted from the sheet output section 10*b* of the copying machine 10 is conveyed in the "longitudinal" direction to the switch claw 201, with the image-formed face held on the upper side. The sheet P is fed into the folding device 200 by the rotation of the switch claw 201 and then nipped by the conveying rollers 202, 203. The sheet P is further conveyed to the adjusting section 252 wherein the leading end of the sheet is corrected by removal of a deviation. Thereafter, the sheet P is conveyed toward the first folding stoppers 215, 216, 217 and 223.

Immediately after the command of copy start is inputted, the stepping motor 210 is rotated by a fixed number of steps proper for the sheet size and the folding mode to set the position of the first folding stopper 215 216 or 217 (projecting position or retracting position). All three first folding stoppers 215, 216 and 217 are retracted and the fixed first folding stopper 223 alone is projected when the sheet has the size of A3 and is in the longitudinal direction under the Z-folding mode as illustrated in the diagram. The first folding stopper 217 is moved to the projected position when the sheet has the size of B4 and is in the longitudinal direction.

After the leading end of the sheet has contacted to the first folding stopper 223, the conveyance of the sheet is further continued. As a result, the sheet forms a loop in the neighborhood of the nip of the paired folding rollers 207, 208 and the loop is finally gripped by the nip of the paired folding rollers 207, 208. Consequently, the first folding is effected on the sheet.

A guide 264 near the nip of the paired folding rollers 207, 208 is naturally constructed in a shape such that the loop in the sheet P is infallibly formed steadily as directed to the nip of the paired folding rollers 207, 208.

The first folding position is separated by approximately ¾ of the total length of the sheet in a given sheet size from the edge of the sheet, or the leading end side in entering the folding device 200. In this specification, for the sake of convenience of description, the first fold will be defined as "three-quarter (¾) fold." The first fold at the position separated by approximately ¼ of the total length of the sheet from the edge of the sheet will be defined as "one-quarter (¼) fold."

In response to the command "Z-folding" from the copying machine 10, the switching device 218 is moved to the position for leading the sheet P in the direction of the second folding stopper 219. The leading end of the sheet P conveyed by the paired folding rollers 207, 208 contacts to the second folding stopper 219 which has been switched in accordance with the sheet size.

When the conveyance of the sheet P is continued by the paired folding rollers 207, 208 after the leading end has contacted to the second stopper 291, the sheet P forms a loop near the nip of the paired folding rollers 207, 209. This loop is finally gripped by the nip of the paired folding rollers 207, 209. The second folding position is at a distance of approximately ½ of the total length of the sheet.

Here again, a guide 265 near the nip of the paired folding rollers 207, 209 is naturally constructed in a shape such that the loop in the sheet P is infallibly formed steadily as directed to the nip of the paired folding rollers 207, 209.

The sheet P on which the Z-folding has been completed by the second folding is conveyed toward the discharging section 256 by the paired folding rollers 207, 209 and discharged from the folding device 200 by the discharging rollers 203, 204.

The Z-folding mode can do a so-called mixed working, i.e. an additional-working on a mixture of folded sheets and unfolded sheets. To be specific, Z-folding mode can achieve the mixed working of A3 Z-folding in the longitudinal direction and unfolded A4 sheets in the lateral direction or the mixed working of B4 Z-folding in the longitudinal direction and unfolded B5 sheets in the lateral direction.

Under the mixed mode, sheets for folding can be fed at a standard interval into the finisher 100 when the sheets follow sheets for no folding into the finisher 100. Conversely, feeding of the sheets for no folding at the standard interval into the finisher 100 possibly causes such inconveniences as disruption of the order of pages or the contact between the sheets when the sheets follows sheets for folding into the finisher 100. The present embodiment, therefore, precludes in the latter case, the occurrence of such inconveniences as the disruption of the order of pages by loading a weight on the conveyance of the sheets for no folding and preventing these sheets from entering the finisher 100 until the folded sheets are discharged from the folding device 200.

In consideration of the appearance of the product of the mixed working, the second crease or fold is preferably prevented from jutting out of the unfolded sheets. For this reason, the second folding position preferably deviates slightly from the ½ position of the total length of the sheet toward the edge of the sheet as the leading end side in entering the folding device 200.

(2) Double Folding Mode

Figure 9:
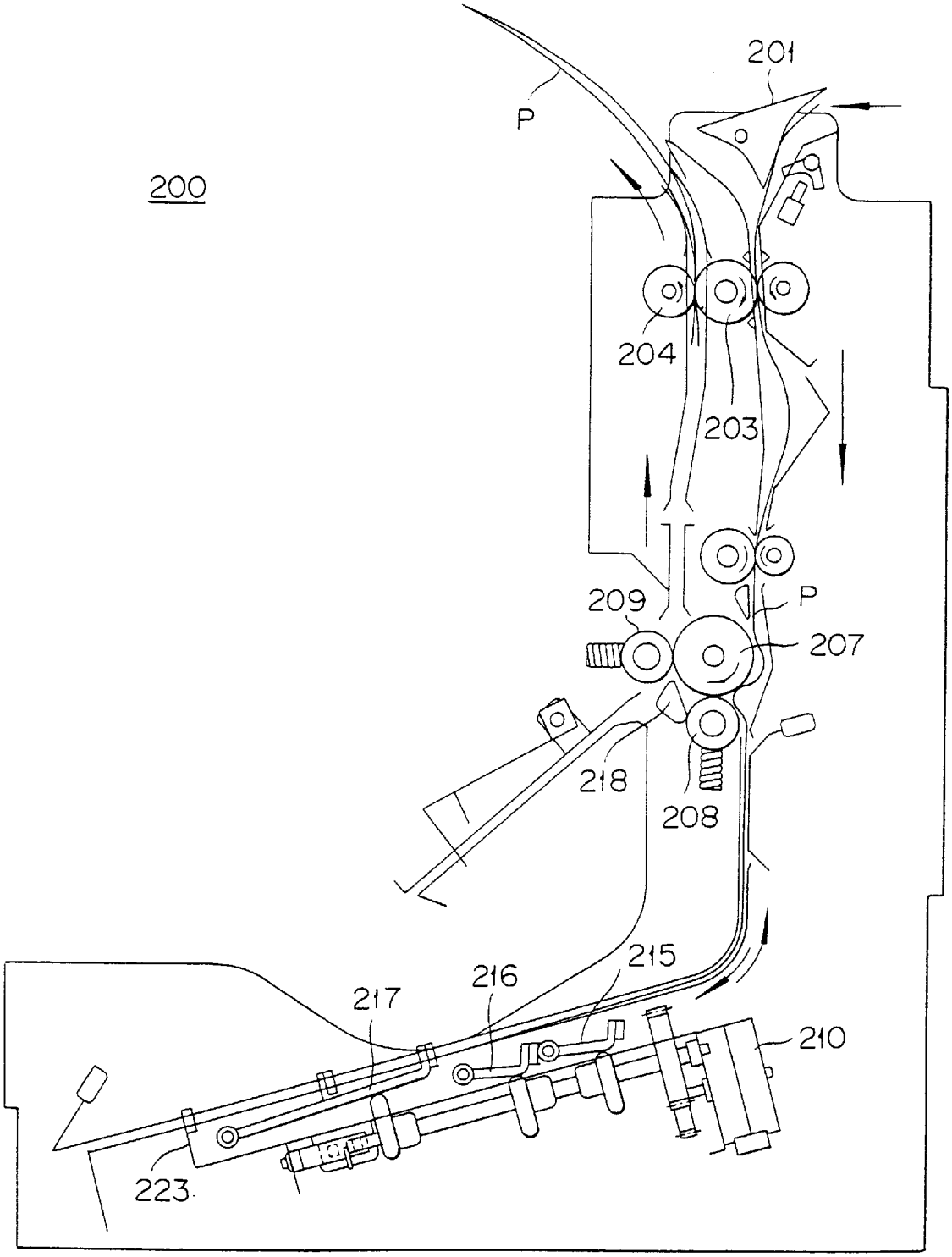
FIG. 9 is a cross section illustrating the state of the folding device under the A3 double-folding mode.

FIG. 9 is a cross section illustrating the state of the folding device 200 under the A3 double-folding mode.

The term "double-folding mode" refers to the mode of folding a sheet in two or the central section.

The sheet P discharged from the sheet output section 10*b* of the copying machine 10 undergoes the same process as under the Z-folding mode and conveyed toward the first folding stoppers 215, 216, 217 and 223.

Likewise under the double-folding mode, the stepping motor 210 is controlled to move only the first folding stopper 217 to the projecting position when the sheet has the size of A3 and is in the longitudinal direction, as illustrated in the diagram. The first folding stopper 216 is only moved to the projecting position when the sheet has the size of B4 and is in the longitudinal direction. The first folding stopper 215 is only moved to the projecting position when the sheet has the size of A4 and is in the longitudinal direction. The sheet P, after undergoing the same process as under the Z-folding mode, is gripped by the nip of the paired folding rollers 207, 208 and then given the first folding.

In response to the command "double-folding" from the copying machine 10, the switching device 218 is moved to the position for guiding the sheet P toward the nip of the paired folding rollers 207, 209. Then, the sheet P conveyed by the paired folding rollers 207, 208 is gripped on the crease by the nip of the paired folding rollers 207, 209 and conveyed per se to the paired discharging rollers 203, 204 and discharged from the folding device 200.

(3) Creasing Mode

Figure 10:
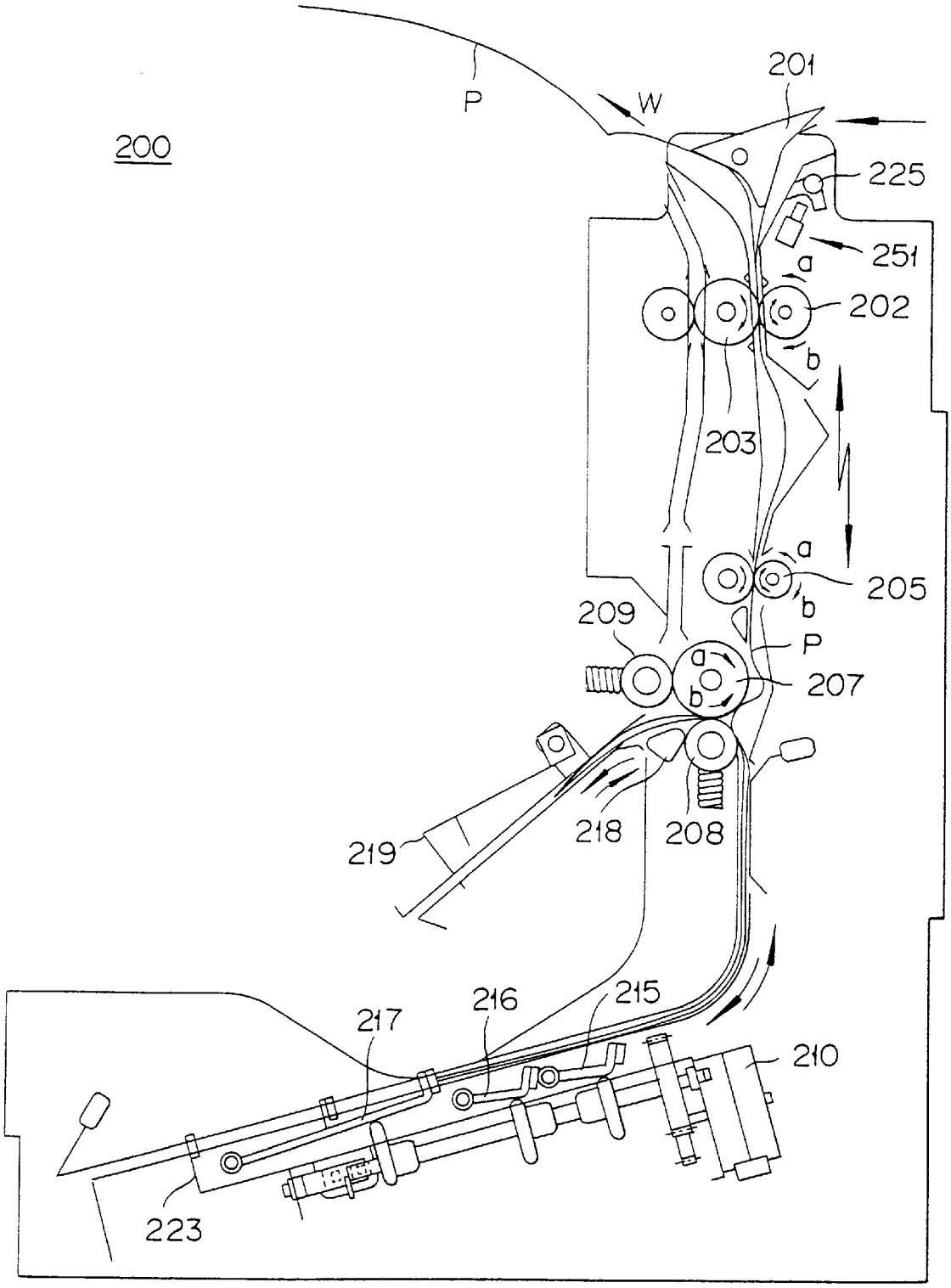
FIG. 10 is a cross section illustrating the state of the folding device under the creasing mode.

FIG. 10 is a cross section illustrating the state of the folding device 200 under the creasing mode.

The term "creasing mode" refers to the mode of preparatorily creasing the central section of sheet for stapling the central crease of the sheaf like a weekly magazine.

The sheet P discharged from the sheet output section 10*b* of the copying machine 10 is conveyed toward the first folding stoppers 215, 216, 217 and 223, similarly to the Z-folding mode or the double-folding mode.

The folding position under the creasing mode is identical with that under the double-folding mode. The motions of the first folding stoppers 215, 216 and 217 are controlled in the same manner as under the double-folding mode. And the sheet P is gripped by the nip of the paired folding rollers 207, 208 and given the first folding.

In response to the command "creasing mode" from the copying machine 10, the switching device 218 is moved to the position for guiding the sheet P toward the second folding stopper 219. The sheet P which has undergone the first folding is conveyed by the paired folding rollers 207, 208 toward the second folding stopper 219.

The driving direction of the rollers 202, 205 and 207 in the folding device 200 is switched from the normal rotation (the direction of the arrow a in the diagram) to the reverse rotation (the direction of the arrow b in the diagram) after the elapse of the period of the time t2 [second] which follows the detection of the trailing edge of the sheet P having undergone the first folding by the sheet sensor 225 in the feed channel section 251. The term "t2" refers to the length of time satisfying the following condition:

$$(y/V)>t2>(x/V)$$

in which V stands for the rate of conveyance of a sheet, x for the distance between the sheet sensor 225 and the lower edge of the switch claw 201, and y for the distance between the leading end of the sheet and the second folding stopper 219 after the detection of the trailing end of the sheet and the completion of the first folding.

The crease formed in the central section of the sheet P is released from the paired folding rollers 207, 208 in consequence of the reverse rotation of the rollers 202, 205 and 207. The edge, which has been the trailing edge during the feed of the sheet into the folding device 200, is now the leading edge. And the sheet is led to the switch claw 201 held in the same state as during the feed of the sheet, and passed through the path indicated by the arrow W, and discharged from the folding device 200. In this manner, the sheet P with the central crease can be conveyed in an opened posture toward the downstream side.

Incidentally, all the three folding modes are invariably accepted only when the sheet has a length of not less than twice the length of the sheet of the smallest size that is available for conveyance.

[Turn-back of sheet during the folding]

A turn-back mechanism 20, which turns a sheet with a copied image upside down, is installed near the sheet output section 10*b* of the copying machine 10. This turn-back mechanism 20 comprises a path for switchback conveyance of a sheet and a pair of reversible rollers provided in the path. The turn-back mechanism promotes compaction of the finisher and reduction in the cost. The arrangement of the turn-back mechanism 20 does not need to be limited to the vicinity of the sheet output section 10*b* of the copying machine 10. This mechanism 20 may be disposed closely to the feed channel section 150 of the finisher 100 instead.

The copying machine 10 further comprises three paths 21, 22 and 23 used as selectively switched. The first path 21 is applied to discharge the sheet turned by the turn-back mechanism 20 from the sheet output section 10*b*. The second path 22 is applied to rotate the sheet turned by the turn-back mechanism 20 within the copying machine 10 for two-sided copies or copying an image on the side opposite to the side with the copied image. The third path is applied to directly discharge the sheet from the sheet output section 10*b* without passing the sheet through the turn-back mechanism.

The copying machine 10, based on the operating mode set by the user and the size of the sheet selected for copying, judges whether or not the sheet for copying is subsequently folded and inputs the information resulting from this judgment to the finisher 100.

Figure 11:
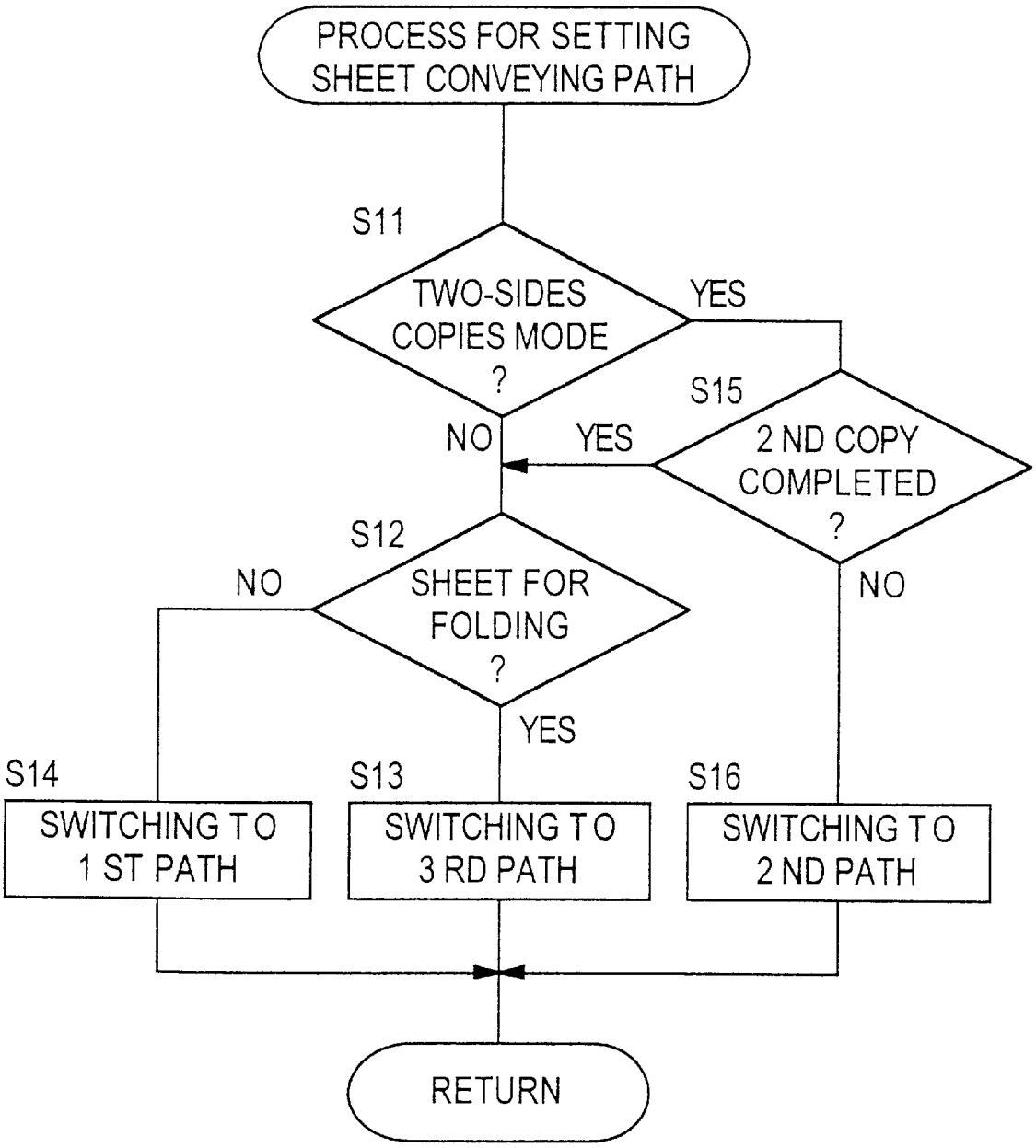
FIG. 11 is a flow chart illustrating a process for setting a sheet conveying path.

FIG. 11 is a flow chart illustrating the process for setting a sheet conveying path.

When the copy mode is not a two-sides copies mode ("N" at Step S11) and the judgment is "sheet for folding" ("Y" at Step S12), the copying machine 10 switches the conveying path to the third path 23 (Step S13). Then, the sheet is discharged from the sheet output section 10*b* without passing through the turn-back mechanism. In contrast, when the judgment is "sheet for no folding" ("N" at Step S12), the copying machine 10 switches the path to the first path 21. Then, the sheet is passed through the turn-back mechanism 20 and discharged in a reversed state from the sheet output section 10*b* (Step S14). The finisher 100, based on the information inputted from the copying machine 10, controls the rotation of the switch claw 201 disposed on the upstream side of the folding device 200 and the positions of the first and second folding stoppers 215, 216, 217, 223 and 219 in conformity to the relevant folding mode.

When the copy mode is a two-sides copies mode ("Y" at Step S11), the conveying path is temporarily switched to the second path 22 ("N" at Step S15, S16) after the first copy is completed on one side. After the second copy is completed on the other side ("Y" at Step S15), the operation described above is executed, depending on the result of the judgment whether or not the sheet folding is necessary.

[Retracting of first fold stopper during restoring from jam]

The sheet folding in the folding device 200 is achieved by contacting to the leading end of a sheet to the first and second folding stoppers 215, 216, 217 223 and 219, and forming a loop halfway in the entire length of the sheet, and gripping the loop with the folding rollers 207, 208 and 209. The plurality of first folding stoppers 215, 216 and 217 disposed along the conveying direction of the sheet are moved in and out by the cams 211, 212 and 213 connected to the stepping motor 210 as the drive source and can be retracted outside the sheet conveying path. The stepping motor 210, which actuates the cam shaft 224, is rotated by an angle proportionate to the number of received pulses. The forward and backward motions of the first folding stoppers 215, 216 and 217 are controlled in terms of the angle of rotation of the cam shaft 224 in response to the number of pulses inputted to the stepping motor 210 based on a home position at which the gobo 231 provided on the cam shaft 224 is detected by the home position sensor 230. The home position is defined as where all the first folding stoppers 215, 216 and 217 capable of forward and backward motions are retracted outside the conveying path.

In the folding device 200 of this embodiment, the ¾ fold as the first fold of Z-folding mode is done by setting the first folding stoppers at the positions separated from the paired folding rollers 207 208 by a distance equivalent to the length of ¾ of the sheet size. Accordingly, the first folding stopper 223 is only fixed at the position separated from the paired folding rollers 207, 208 by a distance equivalent to the length of ¾ of the largest sheet size (A3 in the longitudinal direction) in all the sheet sizes (A3 in the longitudinal direction and B4 in the longitudinal direction) that are capable of Z-folding.

Figure 12:
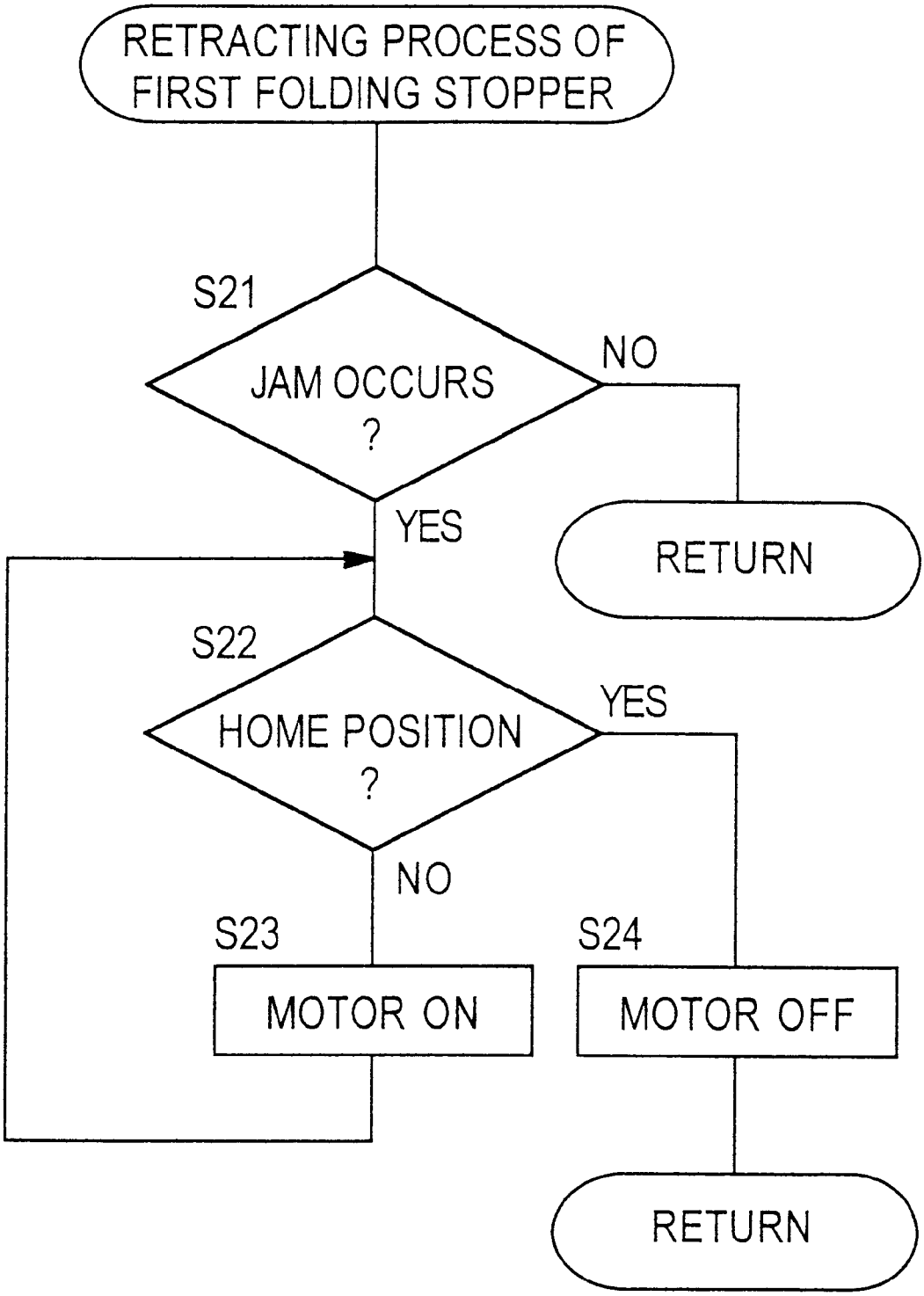
FIG. 12 is a flow chart illustrating a process for retracting the first folding stopper during the restoration from a sheet jam.

FIG. 12 is a flow chart illustrating the retracting process of the first folding stopper during the restoration from a sheet jam.

When a jam occurs in the folding device 200 ("Y" at Step S21), it is judged whether or not the first folding stoppers 215, 216 and 217 are at the home position, based on the signal from the home position sensor 230 (S22).

When the first folding stoppers 215, 216 and 217 are not at the home position ("N" at Step S22), the stepping motor 210 is kept in operation until the stoppers 215, 216 and 217 return to the home position, namely until the gobo 231 provided on the cam shaft 224 is detected by the home position sensor 230 (S22, S23 and S24). Namely, the first folding stoppers 215, 216 and 217 return to the home position and then the fact that the sheet jam has occurred in the folding device 200 is outputted on the control panel of the copying machine 10.

When the completion of the restoration from a sheet jam is detected, the first folding stoppers 215, 216 and 217, which have been retracted to the home position, are moved to the position which was assumed when the jam actually occurred.

In brief, the first folding stopper is retracted outside the sheet conveying path and a space large enough for the user to insert his hand to the vicinity of the sheet in the jam is formed when the jam of sheet occurs. Consequently, the user can easily insert his hand and remove the jammed sheet. And there is no possibility that the user will accidentally touch and move the first folding stopper during the restoration from the jam and the first folding stopper keeps its accurate position. Further, no addition of any special mechanism is required and no possibility of the user accidentally touching the first folding stopper can set the strength of the finisher at the level of an irreducible minimum. Consequently, the finisher enjoys simplicity of construction and low cost.

<<Punching unit 300>>

Figure 13:
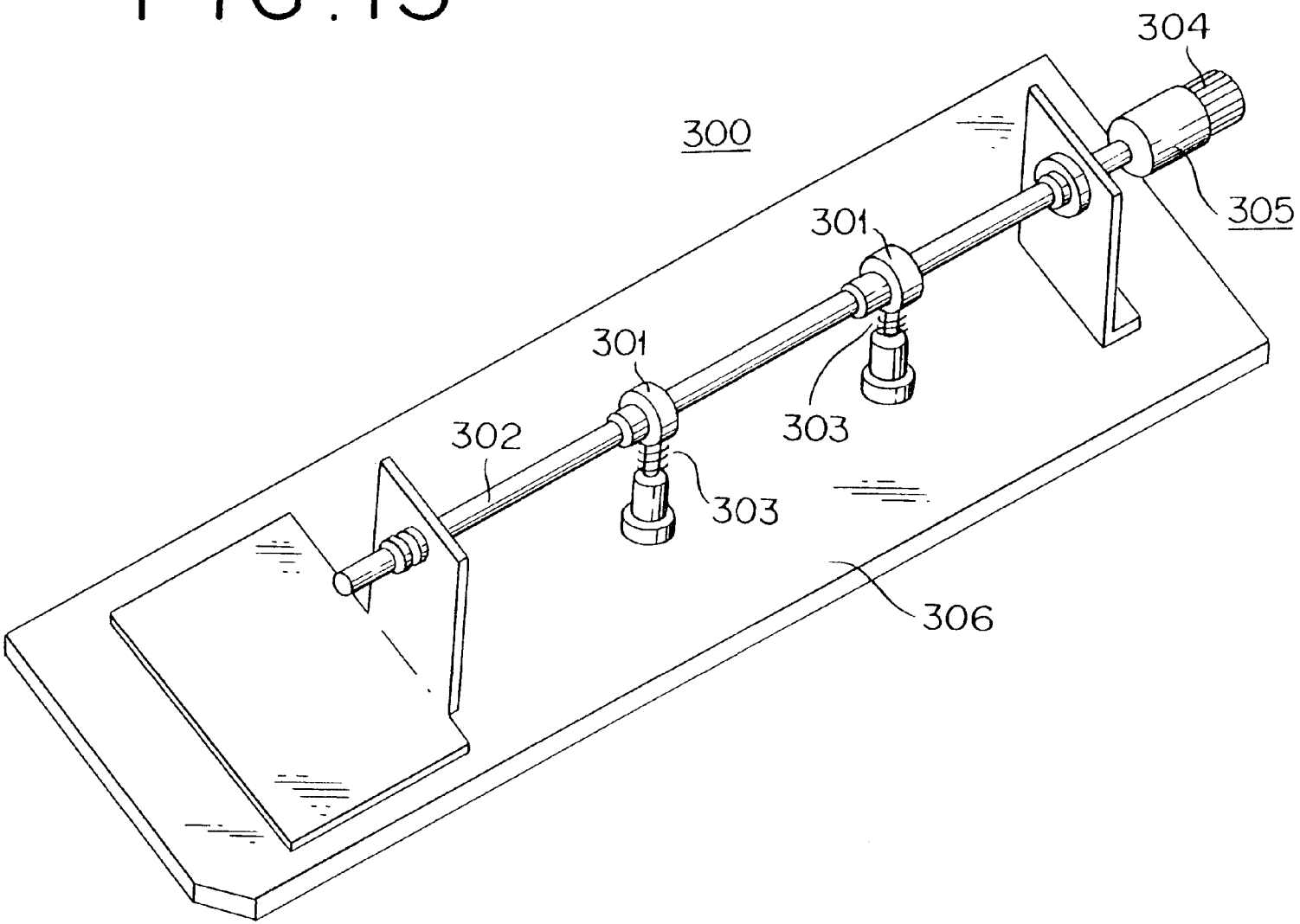
FIG. 13 is a perspective view illustrating a punching device.
Figure 14:
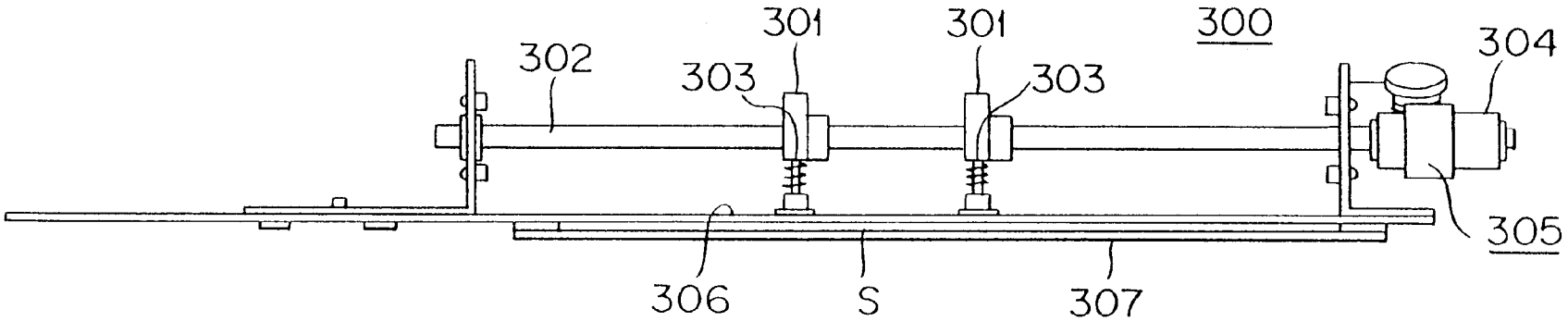
FIG. 14 is a side view illustrating the punching device.

FIG. 13 and FIG. 14 are respectively a perspective view and a side view illustrating the punching device 300.

The punching device 300 comprises a punch blade 303, a punch die 307 which makes a hole in cooperation with the punch blade 303, a drive cam 301 which moves the punch blade 303 forward and backward by contacting to the punch blade 303, and a resist roller 308 (FIG. 2) which fixes the punching position. The punch die 307 is mounted on the lower side of a base plate 306 as separated by a certain gap S.

The drive cam 301 is left standing at a certain stop position while the punch is not in use. A drive shaft 302 on which the drive cam 301 is mounted is connected to a motor 304 through a solenoid clutch 305. The drive cam 301 produces one rotation and returns to the stop position and stops when the solenoid clutch 305 is turned on and the motor 304 rotates the drive shaft 302. The punch blade 303 produces one reciprocation in consequence of one rotation by the drive cam 301.

The punch die 307 has a hole with an inside diameter nearly equal to the outside diameter of the punch blade 303. The punch blade 303 fits into the hole in the punch die 307 when the punch blade 303 is moved by the largest stroke at least from the stop position. And a punched hole is formed in a sheet by gripping or inserting the sheet in the gap S between the punch blade 303 and the punch die 307 and reciprocating the punch blade 303 once.

The punch blade 303, as illustrated in FIG. 2, is disposed on the downstream side of the resist roller 308 along the conveying direction. The distance between the punch blade 303 and the nip of the resist roller 308 is set so as to equal a size required to intervene between the punched hole formed in the sheet and the edge of the sheet. The sheet sensor 102 formed of a photosensor, for example, is provided on the upstream side of the resist roller 308. The sheet discharged from the folding device 200 or brought in without passing through the folding device 200 is caused to change the destination by the switch claw 103 on the downstream side of the punching device 300 and is conveyed by the conveying roller 104 or the conveying roller 121. These two conveying rollers 104, 121 may stop at an arbitrary timing through a solenoid clutch.

The conveying rollers 104, 121 are stopped in a state such that the trailing end of the sheet remains in a slight amount on the upstream side from the resist roller 308 when the sheet sensor 102 detects the trailing end of the sheet. The resist roller 308 is continuously rotated even after the conveying rollers 104, 121 have been stopped. As a result, the sheet continues to stand at rest in the state such that the trailing end remains in the nip of the resist roller 308. In the sheet left standing in the state, the punched hole is formed by one reciprocating motion of the punch blade 303. Thereafter, the solenoid clutch of the conveying rollers 104, 121 is again turned on and the punched sheet is conveyed further to the downstream side.

In conclusion, the punching device 300 is operated as described above to form a punched hole separated by a fixed interval from the trailing end of the sheet.

<<Additional work tray unit 400>>

Figure 15:
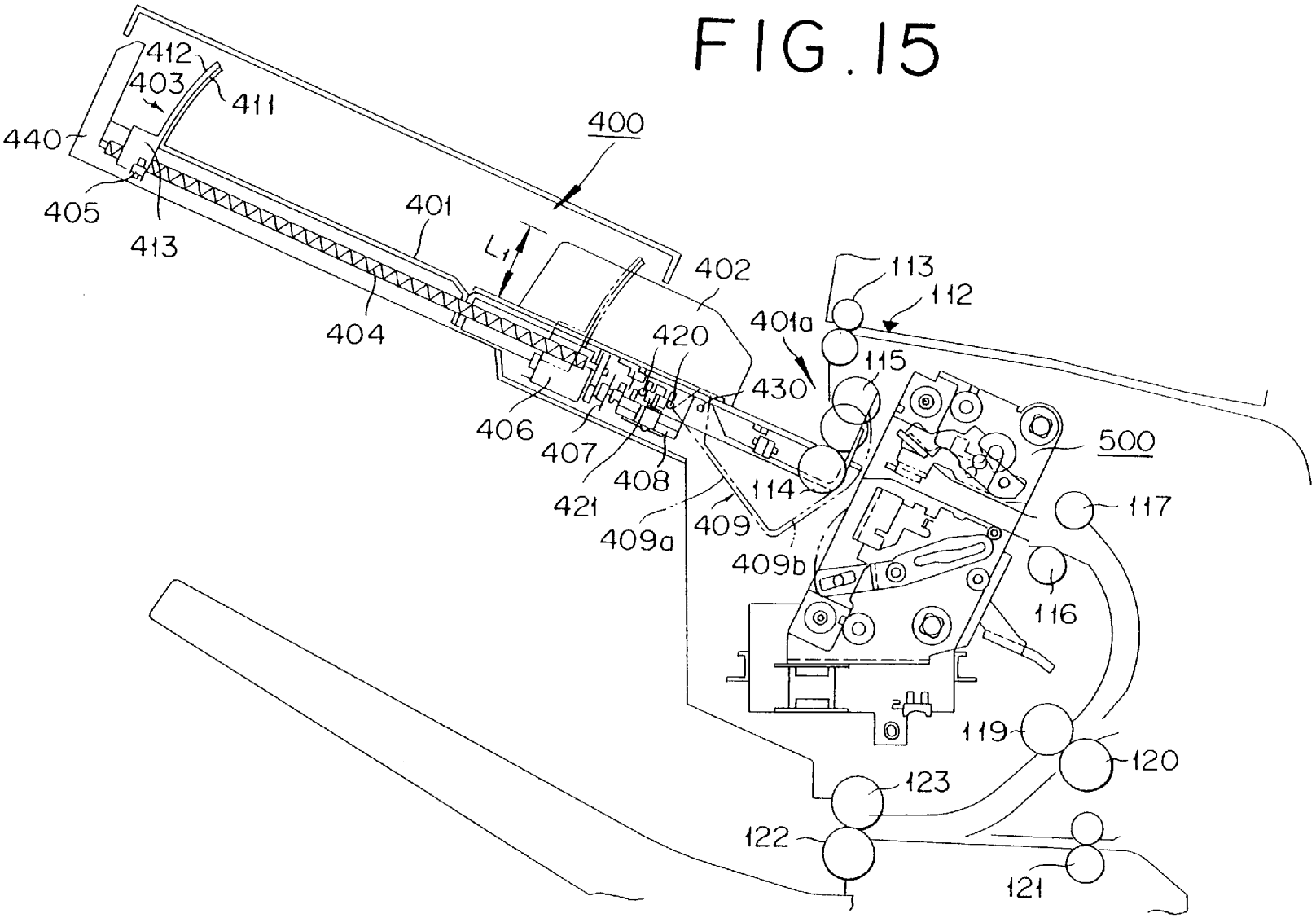
FIG. 15 is a cross section illustrating the construction of an additional-work tray unit.
Figure 16:
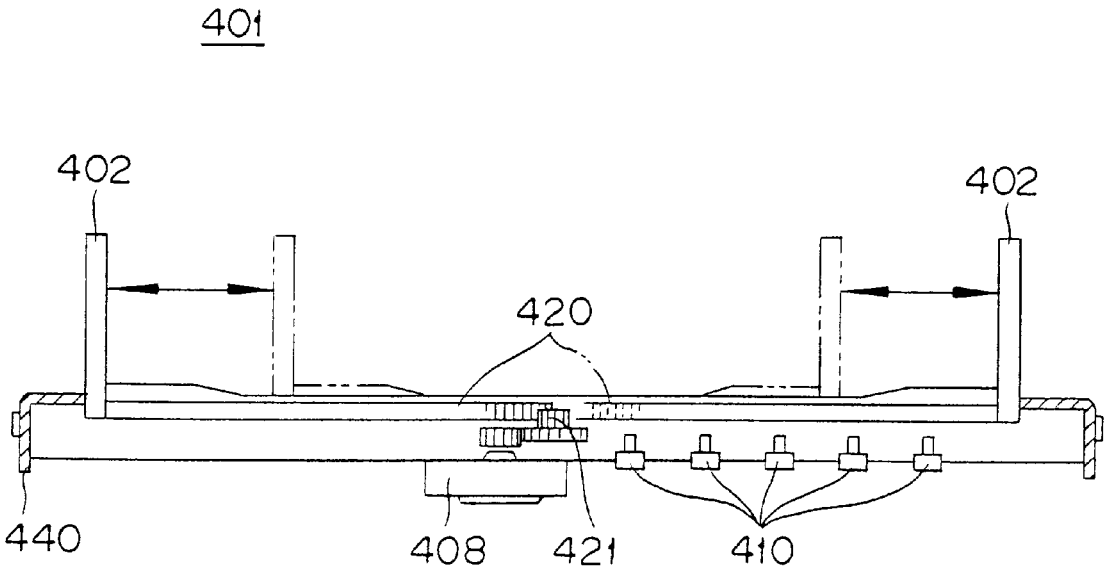
FIG. 16 is a lateral cross section illustrating an additional-working tray of the additional-work tray unit.
Figure 17:
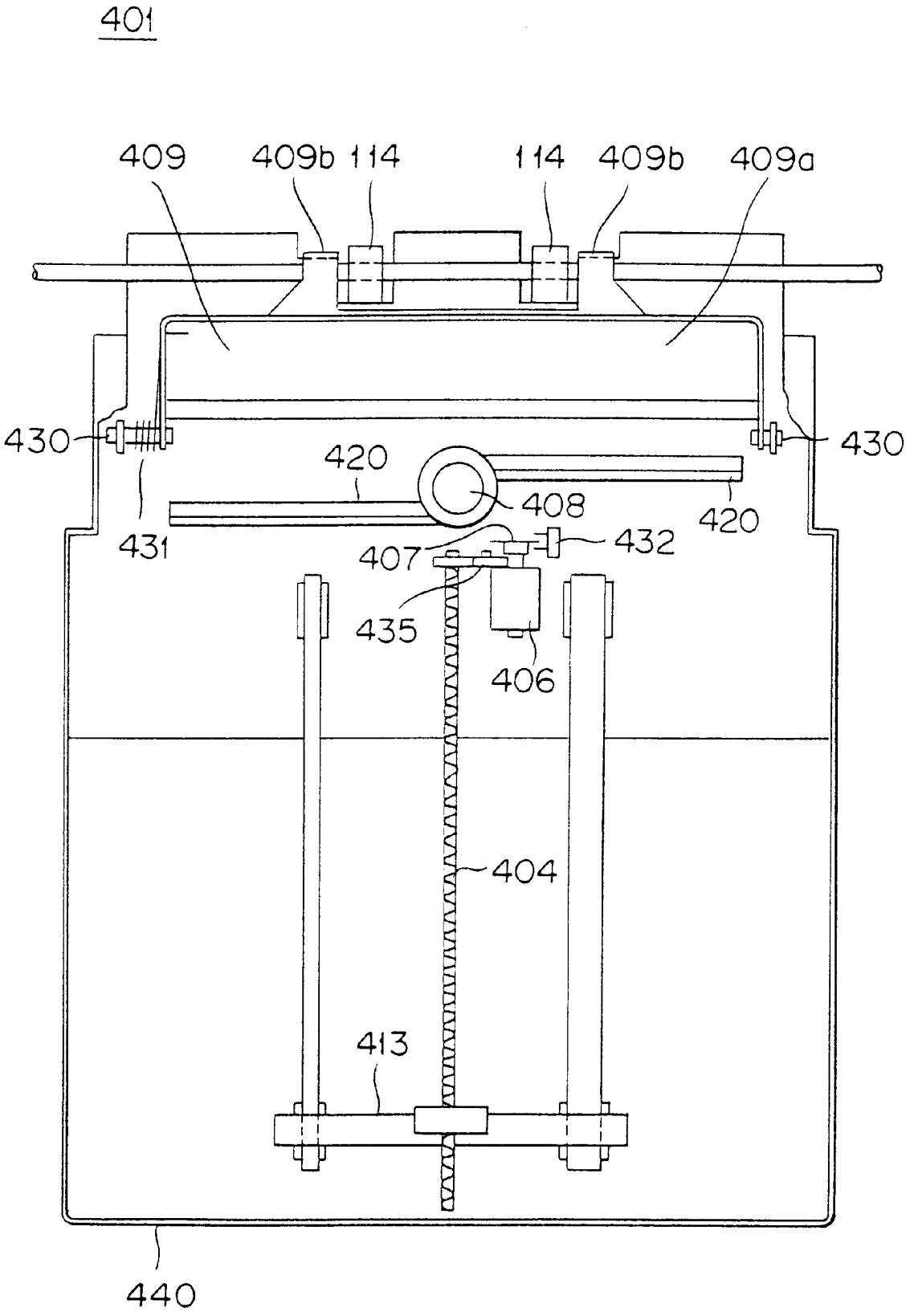
FIG. 17 is a partially cutaway bottom view illustrating the additional-working tray of the additional-work tray unit.

FIG. 15 is a cross section illustrating the construction of the additional-work tray unit 400 and the stapler 500 disposed on the downstream side and FIG. 16 and FIG. 17 are respectively a lateral section and a partially cutaway bottom view illustrating an additional-work tray 401 of the additional-work tray unit 400.

For the sake of convenience of the description, the alignment along the conveying direction from the additional-work tray 401 to the stapler 500 (FD-direction) will be referred to as "FD-alignment" and the alignment along the width direction of conveying sheet, i.e. the orthogonal direction (CD-direction), as "CD-alignment" hereinafter.

The additional-work tray unit 400 comprises the additional-work tray 401 which temporarily stores, in a face-down state, the sheet which is reversed upside down in the upstream section and then discharged by the discharging roller 113, a leading end stopper 409 which is disposed in the sheet discharging outlet 401*a* of the additional-work tray 401 and effects the FD-alignment of the sheet, a pair of lateral aligning plates 402 which effects the CD-alignment of the sheet discharged by the discharging roller 113, a trailing end stopper 403 which stabilizes the FD-alignment done with the leading end stopper 409 by contacting to the leading end of the sheet discharged by the discharging roller 113, and the first sheaf-conveying rollers 114, 115 which conveys a certain number of sheets stored in the additional-work tray 401 as one sheaf to the stapler 500.

The additional-work tray 401 corresponds to the receiving tray unit for storing sheets. The leading end stopper 409 as the first regulating device is disposed as projected from the additional-work tray 401 and contacts to one end face of the sheaf stacked in the additional work tray 401. The trailing end stopper 403 as the second regulating device is disposed as projected from the additional-work tray 401, and contacts to the leading end of the sheet being conveyed to the additional-work tray 401 and pushes the other end face of the sheaf inward until the one end face is aligned with the leading end stopper 409.

The additional-work tray 401 is set up such that the sheet-discharging outlet 401*a* is inclined downward by a certain angle. The pair of lateral aligning plates 402 is disposed such that they are freely moved symmetrically along the CD-direction. The pair of lateral aligning plates will be occasionally-referred to hereinafter otherwise as "paired lateral aligning plates." The trailing end stopper 403 is disposed so as to move along the FD-direction freely. The CD-alignment is effected each time that the additional-work tray 401 receives a sheet. Additionally, the FD-alignment is effected each time that the additional-work tray 401 receives a sheet or a certain number of sheets. The first sheaf-conveying rollers 114, 115 constitute a pair of the lower roller 114 and the upper roller 115. The upper roller 115 can move substantially in the vertical direction to press the lower roller 114 or depart from the lower roller 114.

[Paired lateral aligning plates 402]

The paired lateral aligning plates 402, as illustrated in FIG. 15 and FIG. 16, are composed of plates having a height (L1) greater than the largest height of the sheaf that can be stored on the additional-work tray 401. The paired lateral aligning plates 402 are severally mounted on a pair of racks 420 provided on the reverse side of the additional-work tray 401 along the CD-direction. The paired racks 420 are mounted as opposed to each other across a gear 421 which is rotatably driven by a stepping motor 408. The rotation of the gear 421 causes the paired lateral aligning plates 402 to move symmetrically along the CD-direction. To be specific, the paired lateral aligning plates 402 synchronously move toward each other during the normal rotation of the stepping motor 408 and synchronously move away from each other during the reverse rotation of the stepping motor 408.

The paired lateral aligning plates 402 have two waiting positions, i.e. a first waiting position and a second waiting position. The first waiting position is a place occupied before the discharging roller 113 discharges the sheet. The second waiting position, as altered by the size of the sheet to be discharged, occupies a slightly wider area than the size of the sheet and is a place for awaiting the discharge of the sheet by the discharging roller 113. The paired lateral aligning plates 402 are freely moved between the three positions, i.e. the first waiting position, the second waiting position, and the position for the CD-alignment of the sheet discharged by the discharging roller 113.

A plurality of sensors 410 for positioning the paired lateral aligning plates 402 are provided on the lower face of the additional-work tray 401. The gobos, or stops for intercepting the light from the sensors 410 are integrally mounted on the paired lateral aligning plates 402. Positioning of the first and second waiting positions are based on that the gobos intercept the light from the sensors 410. The positioning of the paired lateral aligning plates 402 for the alignment is done by controlling the number of pulses inputted the stepping motor 408 to actuate the gear 421.

[Leading end stopper 409]

The leading end stopper 409, as illustrated in FIG. 15 and FIG. 17, is roughly shaped like a letter L, and is composed of a bottom plate 409*a* and a blocking plate 409*b* raised from the leading end of the bottom plate 409*a*. The leading end stopper 409 is so mounted on the lower face of the additional-work tray 401 to freely rotate about a fulcrum 430 provided on the bottom plate 409*a*. The leading end stopper 409 is urged by the elastic force of a spring 431 to contact to the lower face of the additional-work tray 401. The blocking plate 409*b* of the leading end stopper 409 forms a base plane when the FD-alignment is effected on the sheet to be stored in the additional-work tray 401. The blocking plate 409*b* of the leading end stopper 409 is moved downward as indicated by an alternate two-dot chain line in FIG. 15, by actuating a solenoid to pull a link arm (not shown) pivotally supported on a rotary fulcrum 430. It results in opening the sheet-discharging outlet 401*a*for feeding a sheaf to the stapler 500.

[Trailing end stopper 403]

The trailing end stopper 403, as illustrated in FIG. 15, is disposed on the side such that the crease of a sheet exists on the additional-work tray 401. The trailing end stopper 403 comprises a plate 412, a sponge 411 attached to one face of the plate 412 to which the sheet contacts, and a framer 413 supporting the plate 412. Roughly the upper half of the plate 412 is rounded, or radius-shaped by being projected as slightly curved from the direction perpendicular to the upper face of the additional-work tray 401 toward the leading stopper 409 located on the sheet discharging outlet 401*a*.

The plate 412 of the trailing end stopper 403 with the rounded shape produces the following advantages. The trailing end of the sheet along the conveying direction from the additional-work tray 401 to the stapler 500 (corresponding to the leading end of the sheet being discharged from the discharging roller 113) always contacts steadily to the plate 412 of the trailing end stopper 403 without reference to the number of sheets stacked on the additional-work tray 401, the size of the sheet, or the presence or absence of the folding. In consequence of this contact, the sheet is repelled in the direction opposite the discharging direction and the leading end of the sheet along the conveying direction infallibly contacts to the leading end stopper 409 and the FD-alignment is further ensured. The Z-folding sheet, owing to the crease, has the trailing end along the conveying direction in a slightly lifted state. However, the sheaf including Z-folding sheets can be uniformly pushed in and brought into contact with the leading end stopper 409 by using the plate 412 having the radius-shaped upper part. Thus, the additional-work tray unit 400 can infallibly eliminate the deviation in the conveying direction possibly produced in the sheaf including Z-folding sheets during the conveyance to the-stapler 500.

The framer 413 of the trailing end stopper 403, as additionally illustrated in FIG. 17, is engaged with a spiral shaft 404 which is installed as extended along the conveying direction at the center of the lower face of the additional-work tray 401. This spiral shaft 404 is connected to a motor 406 as a DC motor through a transmission device 435 as a gear train. The trailing end stopper 403 is moved forward or backward by a necessary distance along the conveying direction by actuating the motor 406 properly in the normal or reverse direction to rotate the spiral shaft 404.

A home position sensor 405 formed of a photosensor, for example, is mounted on a casing 440 supporting the spiral shaft 404 as illustrated in FIG. 15. And a gobo or a stop (not shown) for intercepting the light from the sensor 405 is mounted on the framer 413 of the trailing end stopper 403. The trailing end stopper 403 is stopped at a certain home position on the additional-work tray 401 based on the detection of this stop by the sensor 405. A pulse disc sensor 407 is so mounted on the drive shaft of the motor 406 as to stop the trailing end stopper 403 highly accurately at a necessary position in response to the signal of a conventional pulse disc sensor 432 (FIG. 17).

[Sheet alignment in additional-work-tray unit 400]

Figure 18A:
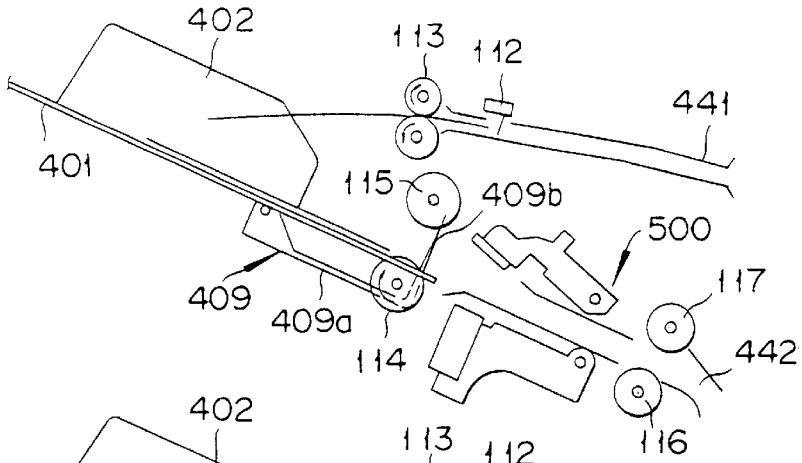
FIG. 18A–FIG. 18C are explanatory diagrams illustrating steps for aligning sheets in the additional-work tray unit and FIG. 18D is an explanatory diagram illustrating steps for conveying a sheaf of stacked and aligned sheets in the direction of a stapler.
Figure 18B:
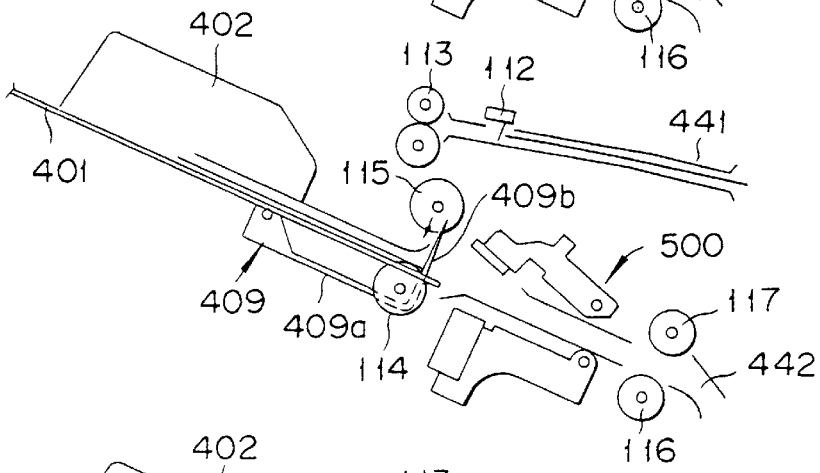
Figure 18C:
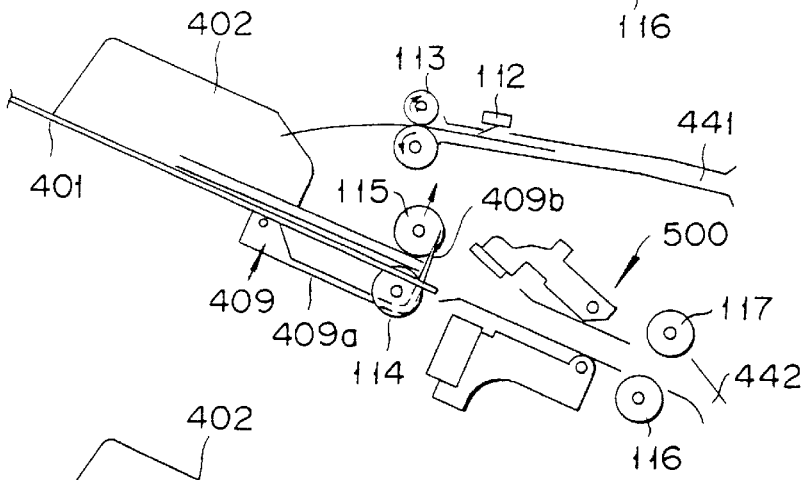
Figure 18D:
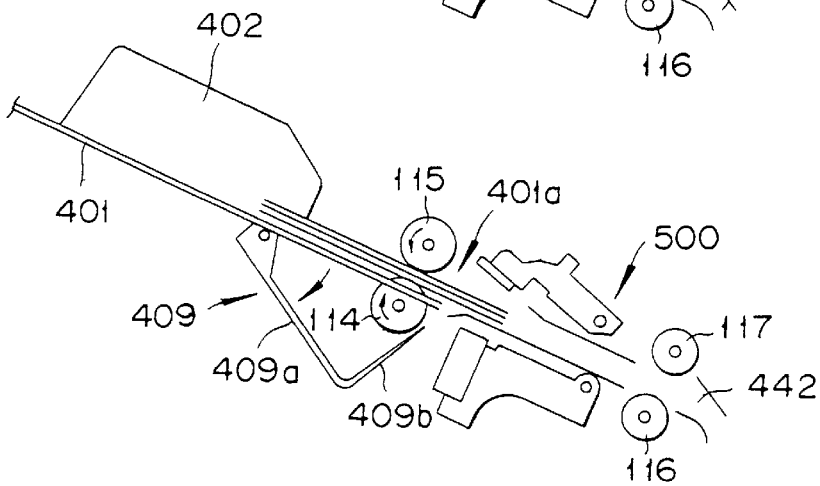
Figure 19A:
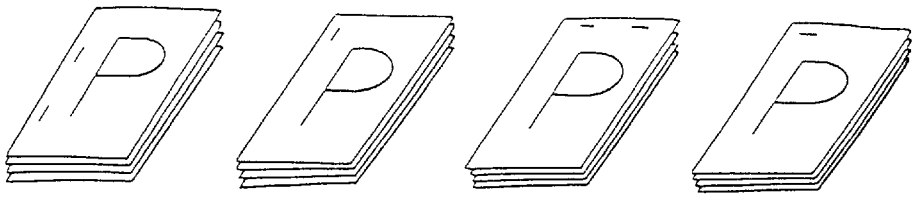
FIG. 19A–FIG. 19C are diagrams illustrating various stapling modes.
Figure 19B:
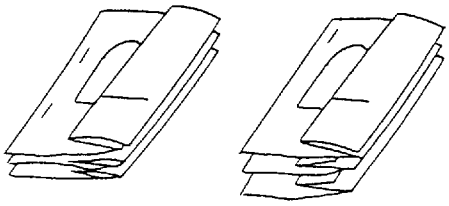
Figure 19B:
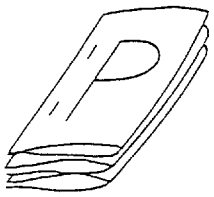
Figure 19B:
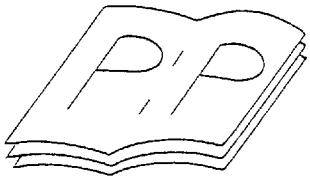
Figure 19C:
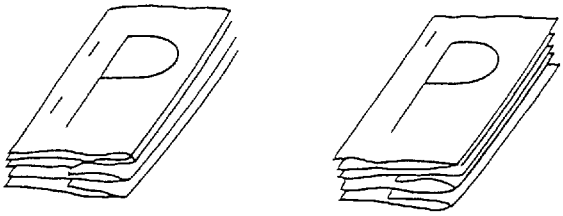
Figure 20:
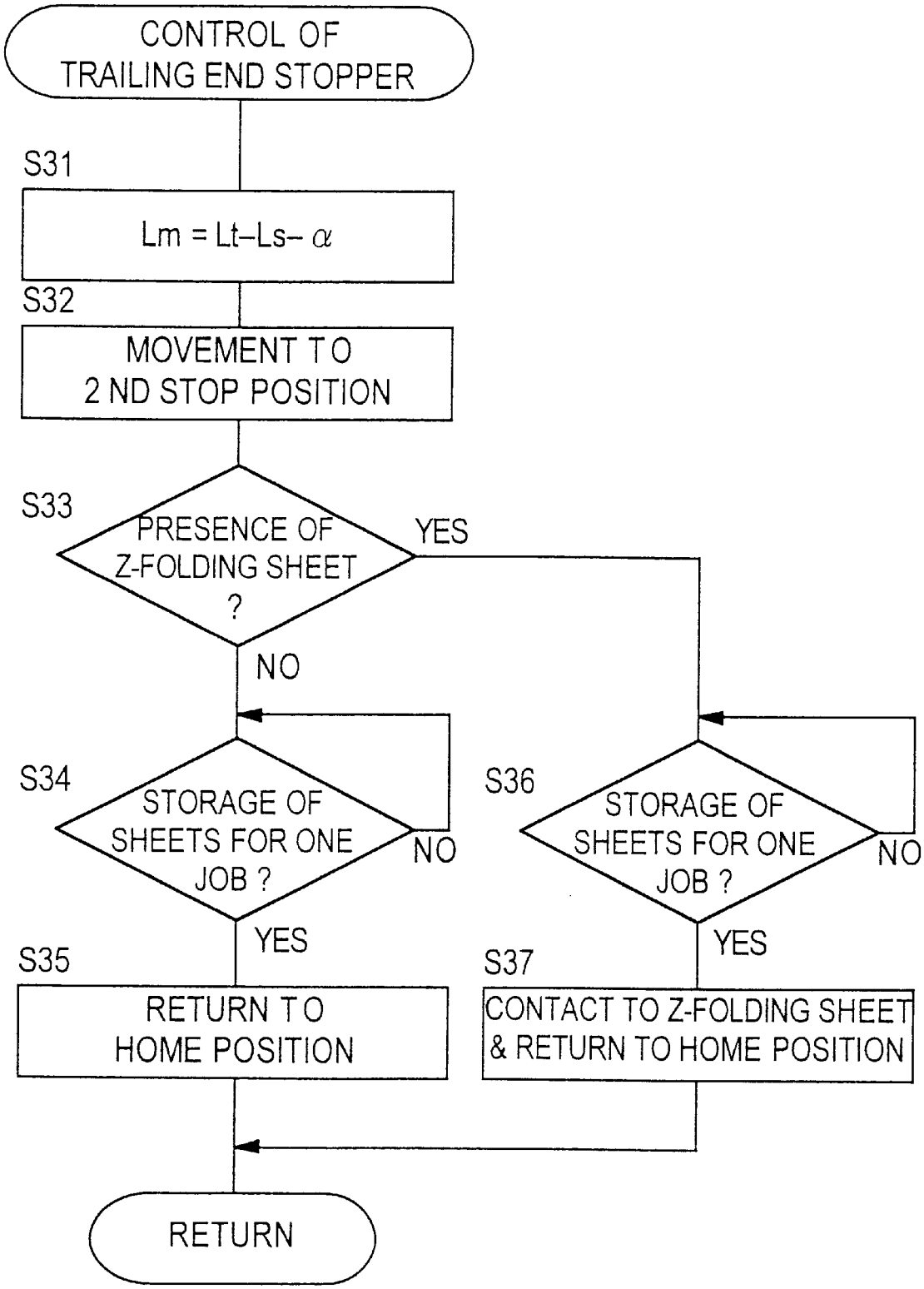
FIG. 20 is a flow chart illustrating the control of motion of a trailing end stopper.
Figure 21:
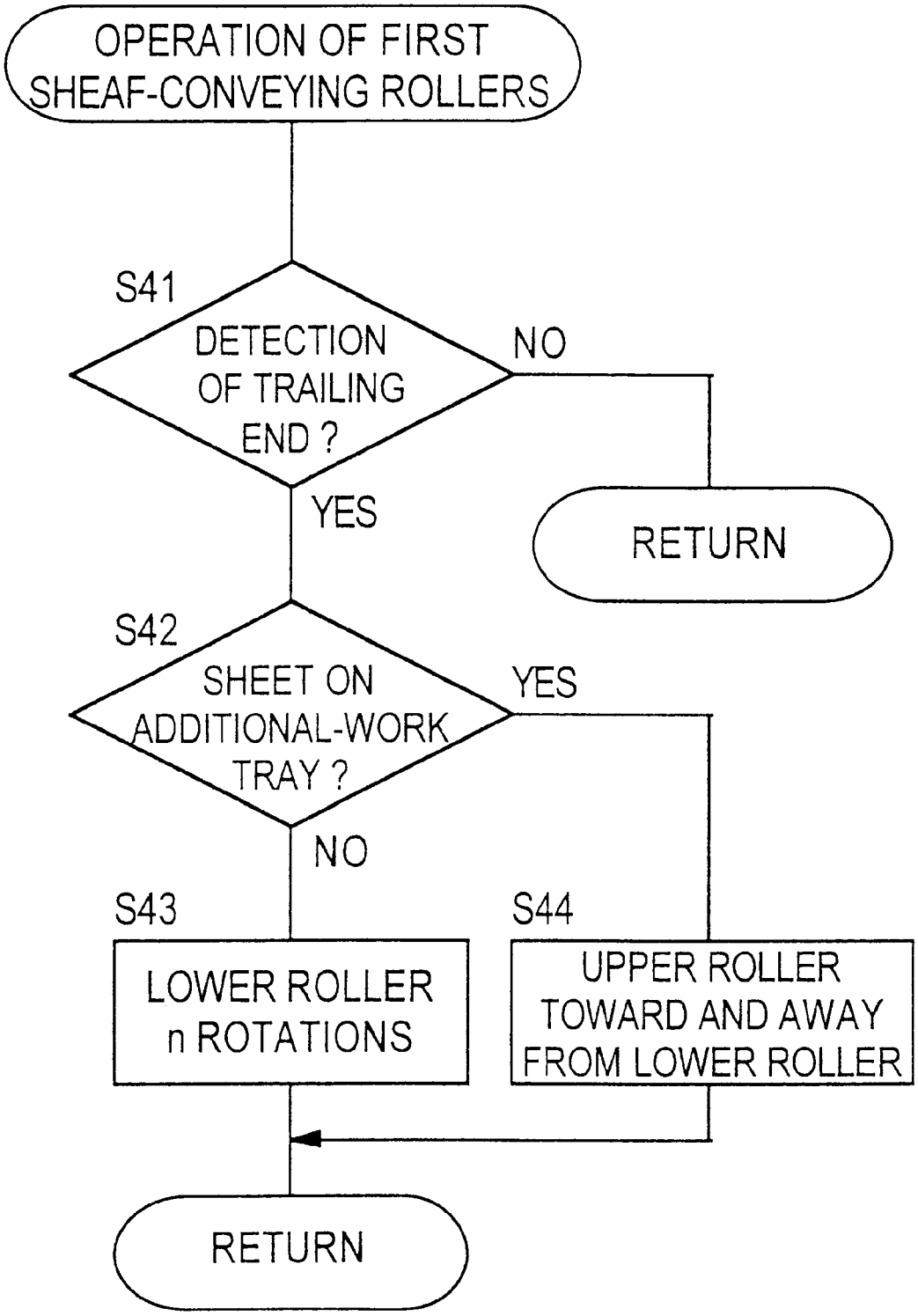
FIG. 21 is a flow chart illustrating the operation of a first sheet-conveying roller during the sheet alignment.

FIG. 18A–FIG. 18C are explanatory diagrams illustrating steps for the sheet alignment in the additional-work tray unit 400, FIG. 18D is an explanatory diagram illustrating steps for the conveyance of a sheaf of stacked and aligned sheets to the stapler 500, FIG. 19 is a diagram illustrating the states of various staple modes, FIG. 20 is a flow chart illustrating the control of the trailing end stopper 403, and FIG. 21 is a flow chart illustrating the operation of the first sheaf-conveying rollers 114,115 during the sheet alignment.

Now, steps for the sheet alignment in the additional-work tray unit 400 will be described as divided into (1) a version in the absence of Z-folding sheets and (2) a version in the presence of Z-folding sheets.

(1) Absence of Z-Folding Sheet

When the sheets are temporarily stacked on the additional-work tray 401 for stapling in the absence of Z-folding sheet, the leading ends of the sheets discharged by the discharging roller 113 are caused to contact or collide against the trailing end stopper 403. Then, the leading ends of the sheets are caused to contact to the leading end stopper 409 by virtue of the repelling force arising from the collision and the weight of the sheets. The series of motions effect the FD-alignment. The movement of the paired lateral aligning plates 402 in the CD-direction effects the CD-alignment. A discharged sheet sensor 112 which detects the trailing end of a sheet for judging the discharge of the sheet from a first conveying path 441 toward the additional-work tray 401 is disposed in the upstream vicinity of the discharging roller 113.

To be more specific, the trailing end stopper 403 moves to and stops at the second stop position keeping a stated distance from the end face of the sheet, depending on the presence or absence of sheet folding, the size of sheet, and the mode of sheet folding (S32), as shown in the flow chart of FIG. 20. Besides, the conveying length to the second stop position is calculated at Step S31 in accordance with the formula, Lm (moving length) =Lt (length of the additional-work tray 401)−Ls (size of sheet)−α (certain distance). The term "Ls (size of sheet)" refers to the size of the sheet measured when the sheet is fed into the additional-work tray 401. Thus, Ls (size of sheet) is the size of the folded sheet when the sheet is folded. The term""α (certain distance)x varies, depending on the presence or absence of folding.

The leading end of the sheet being discharged from the discharging roller 113 contacts to the trailing end stopper 403 kept at the second stop position or the calculated position. Then, the sheet is repelled toward the leading end stopper 409 and quickly dropped onto the upper face of the additional-work tray 401 or on the uppermost of the stored sheets. The FD-alignment, therefore, can be optimally and expeditiously carried out even when the sheets are conveyed and discharged at a small interval. Moreover, the timing for the subsequent CD-alignment can be quickly set. The temporary storage of sheets in the additional-work tray 401 is completed early and the series of additional-workings can be fulfilled expeditiously. Thus, the finisher is improved in productivity.

In the absence of a Z-folding sheet, the trailing end stopper 403 is retained at the second stop position until the storage of sheets for one job is completed and then is returned to the home position (S33, S34 and S35).

The trailing end stopper 403 may be controlled to move to a position at which the distance to the leading-end stopper 409 equals the size of the discharged sheet and contact to the trailing end of the sheaf before the return of the trailing end stopper 403 to the home position.

Incidentally, the sheets temporarily stored in the additional-work tray 401 have been slightly curled under the influences of heat and pressure exerted by the formation of images. There is the possibility-that the leading ends of sheets partly ride aslant on the blocking plate 409*b* of the leading end stopper 409. When the sheets in the above state are aligned without correction and stapled, the stapled sheaf suffers from poor appearance because the mismatch in the FD-direction of the sheaf is in existence.

For solving the problem, the additional-work tray unit 400 waits for a certain length of time to elapse after the sensor 112 has detected the discharge of the sheet and then lowers, toward the lower roller 114, the upper roller 115 constructed to be freely moved toward and away from the lower roller 114 under the FD-alignment as illustrated in FIG. 18B and FIG. 18C. The certain length of time is sufficient to be spent by the leading end of the discharged sheet in coming into contact to the leading end stopper 409. By lowering the upper roller 115 once after the discharge of the sheets, those sheets ridden aslant on the blocking plate 409*b* of the leading end stopper 409 are dropped onto the additional-work tray 401 and are aligned by eliminating the deviation of the FD-direction. Namely, the FD-alignment by the leading end stopper 409 is infallibly achieved. Then, the upper roller 115 is moved upward before the subsequent sheet comes and is prevented from contacting to the subsequent sheet.

Incidentally, the upper roller 115 as the first sheaf-conveying roller is arranged to produce no rotation at least during the descent. Owing to this arrangement, the upper roller 115 avoids compelling the sheet to incur such inconveniences as production of wrinkles under a pressure from the roller. This construction will be described specifically herein below.

In respect of receiving the first sheet for storage, the lower roller 114 as the first sheaf-conveying roller protrudes upward from the stacking base of the additional-work tray 401 as illustrated in FIG. 18A. There is the possibility that the leading end of the first sheet entering the additional-work tray 401 contacts to the lower roller 114 and gets stuck in this portion.

In consideration of the point, the lower roller 114 continues to advance only the first sheet by producing several rotations even after the sensor 112 has detected the discharge of the sheet for enabling the leading end of the sheet to contact to the leading end stopper 409 infallibly. Specifically as shown in the flow chart of FIG. 21, the lower roller 114 is actuated to produce n rotations when the absence of a sheet on the additional-work tray 401 is discerned and the sensor 112 has detected the trailing end of the sheet (S41–S43). The first sheet, therefore, can be aligned properly. With respect to the second and following sheets, only the motion of the upper roller 115 toward and away from the lower roller 114 is effected because sheets are already present on the additional-work tray 401 (S44).

Incidentally, if the operation of lowering the upper roller 115 into forced contact to the upper roller 114 is effected additionally on the first sheet, the first sheet will be pressed strongly against the leading end stopper 409 and possibly incur inconveniences. The motion of the upper roller 115 toward and away from the upper roller 104 is carried out on the second and following sheets received in the additional-work tray 401, or every sheets except the first sheet.

If the rotation of the lower roller 114 is continued during the receiving of second and following sheets, these sheets will be unduly advanced in consequence of a gradual increase in the cumulative weight of sheets stacked on the lower roller 114. The-rotational operation of the lower roller 114, therefore, is carried out exclusively when the first sheet is received into the additional-work tray 401 and is stopped during the receiving of the second and following sheets.

When the stacking, CD-alignment and the FD-alignment of a plurality of sheets on the additional-working tray 40 are completed, the upper roller 115 is moved downward and the first sheaf-conveying rollers 114, 115 which are now in a mutually pressed state nip the sheaf on the additional-work tray 401 as illustrated in FIG. 18D. The leading end stopper 409 is further rotated to move the blocking plate 409*b* downward and to open the sheet discharging outlet 401*a* and a second conveying path 442 provided with the stapler 500. The first sheaf-conveying rollers 114, 115 are then set rotating and the sheaf is passed through the sheet discharging outlet 401*a* and conveyed in the direction of the stapler 500.

In the present embodiment, the first sheaf-conveying rollers 114, 115 can both convey the sheaf to the stapler 500 and align the sheet for eliminating a FD-direction deviation. This embodiment, therefore, simplifies or miniaturizes the finisher 100 as a whole and contributes also to lower the cost as compared with a finisher provided independently with a sheaf conveyance mechanism and an alignment mechanism.

The example using the first sheaf-conveying rollers 114, 115 as a device for conveying a sheaf is depicted in the drawing. The motion of the opposed rollers toward and away from each other for adjusting the FD-direction deviation can be applied to a sheaf conveying device which is composed of a chuck capable of nipping the sheaf with sliding.

(2) Presence of Z-Folding Sheet

The stapler has three staple modes, i.e. normal staple mode (FIG. 19A), fold staple mode (FIG. 19B), and mixed staple mode (FIG. 19C), which are selectively adopted. The normal staple mode is a mode for stapling a sheaf solely of unfolded sheets, the fold staple mode is a mode for stapling a sheaf solely of folded sheets, and the mixed staple mode is a mode for stapling a sheaf of unfolded and folded sheets.

Without reference to the kind of staple mode, the folded and/or unfolded sheets are stacked on the additional-work tray 401 prior to the relevant stapling, subjected to the CD-alignment by the paired lateral aligning plates 402, and then subjected to the FD-alignment performed jointly by the trailing end stopper 403 and the leading end stopper 409.

Particularly, the trailing end stopper 403 can be freely moved to and stopped at a pertinent position in the FD direction. As shown in the flow-chart of FIG. 20, the trailing end stopper 403 is moved to and stopped at the second stop position kept at a stated distance from the end face of the sheet, depending on the presence or absence of sheet folding, the size of sheet, and the mode of sheet folding for the purpose of effecting the FD-alignment perfectly (S31 and S32).

The z-folding sheets which have a peculiar form such that there are three overlapping layers in one half of the length of sheet and one only one layer in the remaining half of the length, are stacked on the additional-work tray 401 such that the overlapping side is located on the side of the trailing end stopper 403. In the mode involving a sheaf including Z-folding sheets, the sheets stacked on the additional-work tray 401 are not well balanced and have a possibility of partly protruding in the conveying direction.

Figure 22A:
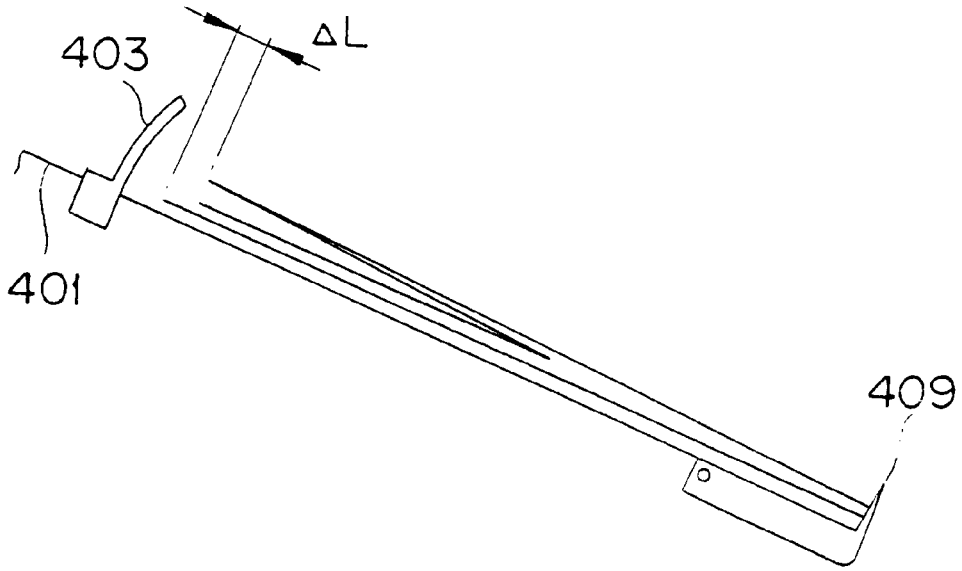
FIGS. 22A and 22B are explanatory diagrams illustrating the operation of aligning a sheaf including Z-folding sheets.

The Z-folding constitutes itself a fold mode of folding a sheet (such as A3 sheet) to a size (such as $\Delta L$=about 3 mm) smaller than the size of an unfolded sheet (such as A4 sheet) as illustrated in FIG. 22A. In the FD-alignment of a sheaf including Z-folding sheets, perfect FD-alignment is not done by moving the trailing end stopper 403 in conformity with the sheets which are not Z-folding sheets.

Figure 22B:
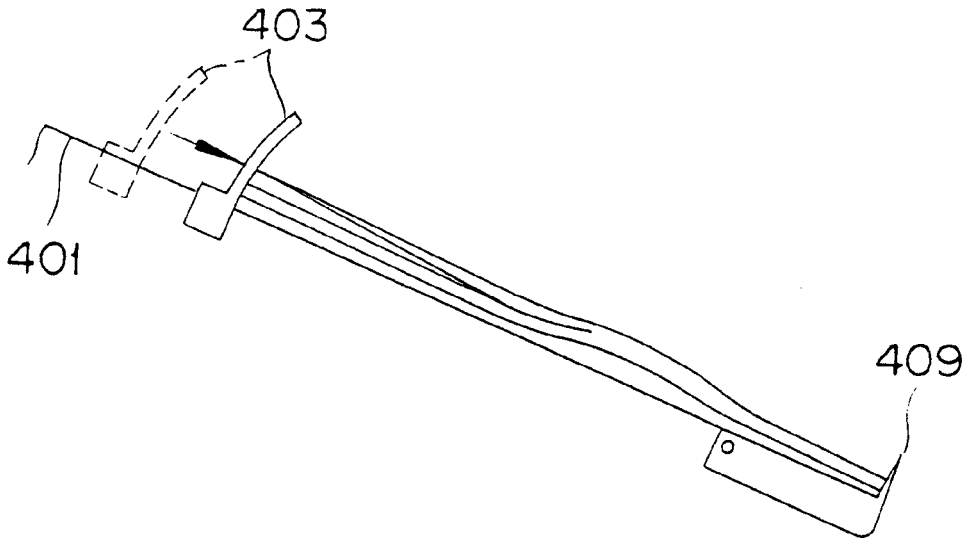

In view of the factors, when the sheaf includes Z-folding sheets, the final sheet is received ("Y" at Step S36 in FIG. 20) and then the trailing end stopper 403 at the second stop position is moved to the position for pushing the Z-folding sheet into the leading end stopper 409 as illustrated also in FIG. 22B and returned to the home position (S37). Therefore, the deviation of the sheets in the FD-direction can be eliminated even when the sheaf includes Z-folding sheets.

The Z-folding sheets assume a peculiar form. The sheaf of Z-folding sheets is not parallel to the stacking base of the additional-work tray 401 but is in an oblique state such that a section on the side of the trailing end stopper 403 is higher than a section on the side of the leading end stopper 409. This oblique state grows as the number of Z-folding sheets included in the sheaf increases. The distance along the conveying direction between the trailing end of the sheets in the upper section of the sheaf and the leading end stopper 409 becomes short as compared with the distance between the trailing end of the sheets in the lower section of the sheaf and the leading end stopper 409. Here, the sheets in the upper section of the sheaf are discharged in the final stacking stage and the sheets in the lower section of the sheaf are discharged in the initial stacking stage. In the state such the distance between the trailing end of sheet and the leading end stopper 409 varies in the upper section and the lower section of the sheaf, the sheets in the upper section of the sheaf will not be given a perfect FD-alignment when the trailing end stopper has a shape perpendicularly intersecting the stacking base of the trailing end stopper 401.

In the present embodiment, roughly the upper half of the trailing end stopper 403 is rounded, or radius-shaped and inclined toward the sheet storing side. This construction enables the FD-alignment of the sheaf including Z-folding sheets to be effected uniformly and satisfactorily throughout the entire sheaf from the lower to the upper section.

After the CD-alignment and the FD-alignment are completed in the additional-work tray 401, the sheaf is nipped by the first sheaf-conveying rollers 114, 115 and passed through the sheet discharging outlet 401*a* opened in consequence of the rotation of the leading end stopper 409 and then conveyed toward the stapler 500.

Optionally, the trailing end stopper 403 may be controlled, at an interval of a suitable number of sheets, to move to a position at which a Z-folding sheet is pushed to the leading end stopper 409 and then returned to the second stop position before the final sheet has been received.

[Retracting of paired lateral aligning plates 402 and trailing end stopper 403 during restoration from sheet jam]

The paired lateral aligning plates 402 are located based on the pulses inputted to the stepping motor 408 and the signal outputted from the sensor 410 which detects the paired lateral aligning plates 402 at the home position. The paired lateral aligning plates 402, after discerning the size of a sheet for copying, move to a position separated slightly from the lateral end of the sheet and assume a waiting posture and effect the CD-alignment by making reciprocating motion each time one sheet is received for storage. The home position is separated by a minute length from the lateral end of a sheet stored in the additional-work tray 401, which has the largest length in the CD-direction.

The trailing end stopper 403 is located in accordance with the pulses outputted from the pulse disc sensor 407 provided as a pulse generating device in the motor 406 and the signal outputted from the sensor 405 detecting the trailing end stopper 403 at the home position. The trailing end stopper 403, after discerning the size of sheet for copying and the mode of sheet folding, produces a motion proper for the size of a sheet received into the additional-work tray 401. The home position is separated by a minute length from the trailing end of a sheet stored in the additional-work tray 401, which has the largest length in the FD-direction.

When a jam occurs inside the additional-work tray unit 400, first the paired lateral aligning plates 402 and the trailing end stopper 403 are returned to their respective home positions and then the fact that the jam has occurred in the additional-work tray unit 400 is outputted on the control panel on the copying machine 10.

After the completion of the restoration from the jam is detected, the paired lateral aligning plates 402 and the trailing end stopper 403 are both moved to the positions which they occupied when the jam occurred.

<<Stapler 500>>

[Construction of stapler 500]

Figure 23:
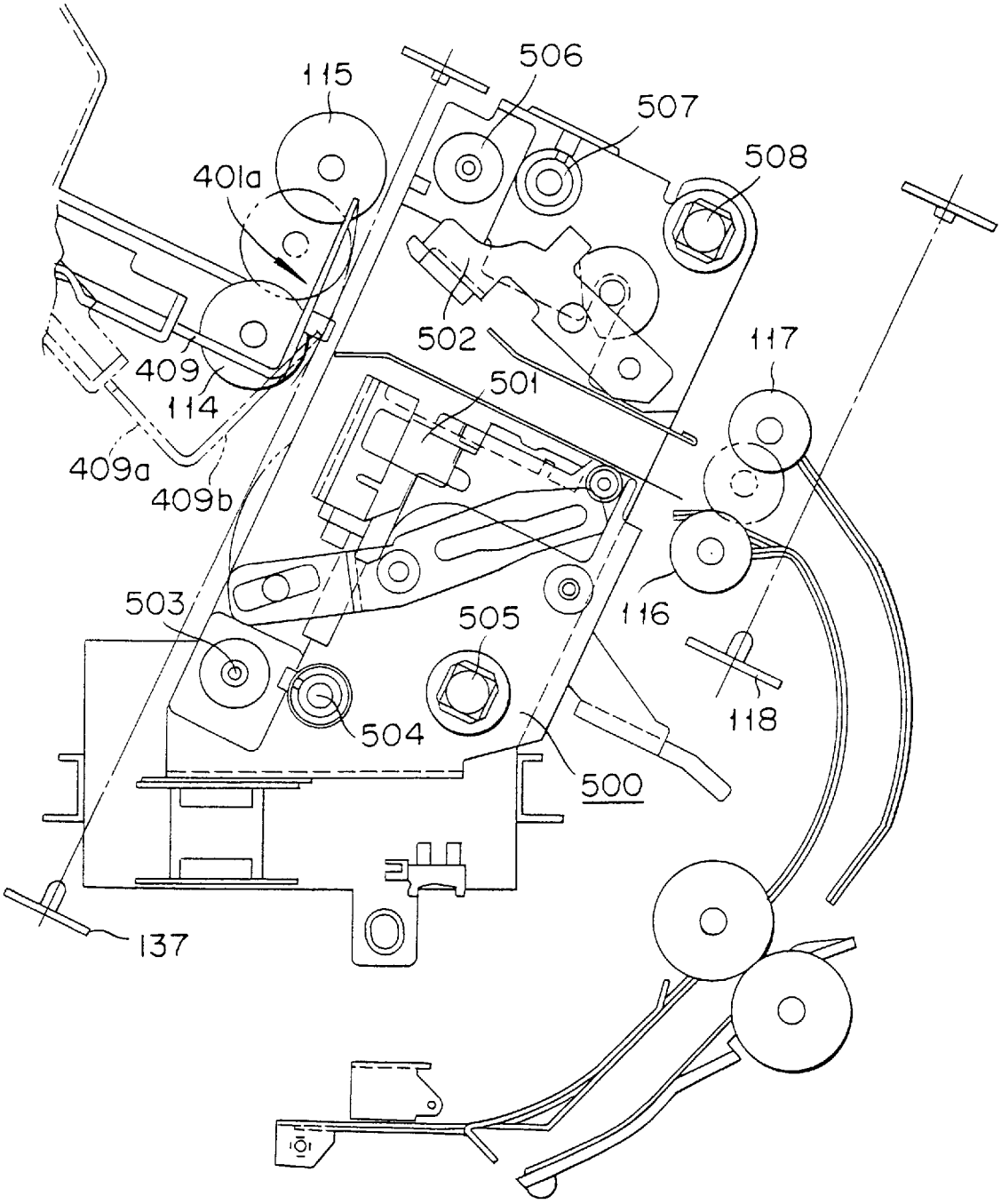
FIG. 23 is a structural diagram illustrating a stapler together with a second sheet-conveying roller as well as the first sheet-conveying roller.
Figure 24:
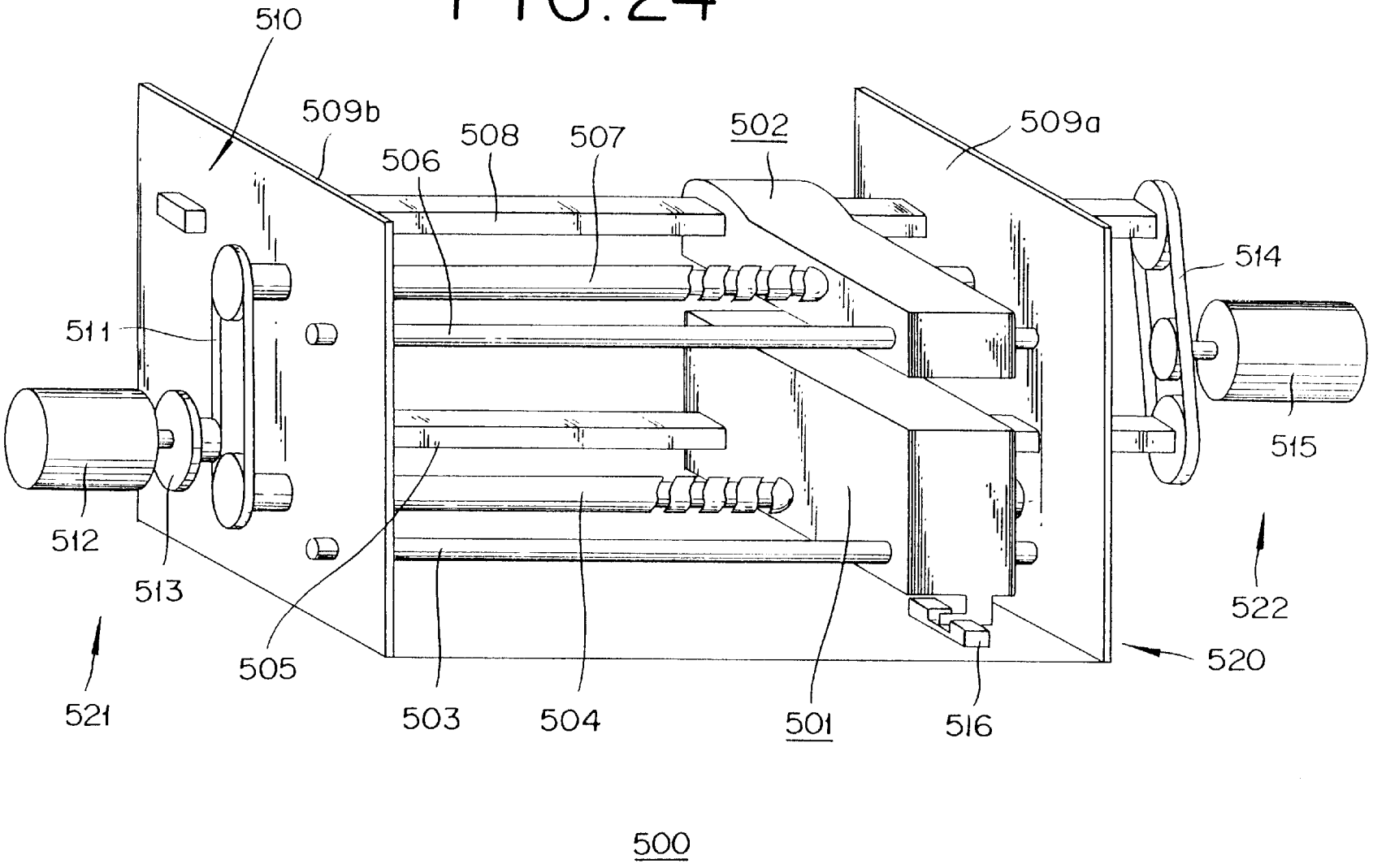
FIG. 24 is a schematic perspective view illustrating the construction of the stapler.

FIG. 23 is a structural diagram illustrating the stapler 500 together with the first and second sheaf-conveying rollers 114–117 and FIG. 24 is a schematic perspective view illustrating the construction of the stapler 500.

The stapler 500 performs a stapling at certain positions of a sheaf nipped and conveyed by the first sheaf-conveying rollers 114, 115 on the upstream side of the stapler 500 relative to the conveying direction. The stapler 500 comprises a head unit 501, an anvil unit 502, a supporting mechanism 520 which supports the units 501, 502 such that the units 501, 502 are freely moved in the orthogonal direction and rotated, a first drive mechanism 521 which moves the units 501, 502, and a second drive mechanism 522 which rotates the units 501, 502. In the stapler 500, devices which engage or connect the head unit 501 with the anvil unit 502 do not transverse the sheet conveying path.

Further, the second sheet-conveying rollers 116, 117 which convey the stapled sheaf and the second sensor 118 for fixing the stapling position of the sheaf (as will be specifically described herein below) are installed on the downstream side of the stapler 500.

The head unit 501 separates one staple from a cartridge held within a cartridge case (not shown), bends the separated staple in the shape nearly resembling a letter U, and transfixes the sheaf with the bent staple. This unit 501 is provided with a sensor which detects the presence or absence of staple in the cartridge case.

The anvil unit 502 inwardly bends shanks of the staple which has penetrated through the sheaf and receives the shock of stapling performed by the head unit 501. This unit 502 comprises a receiving plate, which inwardly bends the shanks of the staple, and a supporting plate, which receives the shock of the stapling action.

The supporting mechanism 520, as illustrated schematically in FIG. 24, comprises a frame 510 provided with a pair of lateral wall 509*a*, 509*b* and supporting shafts 503, 506 extending along the orthogonal direction and supported by the frame 510. The distance between the lateral wall 509*a*, 509*b* of the frame 510 is set to surpass at least the length of a sheet in the orthogonal direction, which is passable. The supporting shafts 503, 506 are each formed of a round bar. The supporting shaft 503 is inserted through the head unit 501 and the supporting shaft 506 is inserted through the anvil unit 502. The units 501, 502 are freely moved in the orthogonal direction along the supporting shafts 503 and 506 and are freely rotated respectively about the supporting shafts 503 and 506, respectively.

The first drive mechanism 521 comprises a spiral shaft 504 inserted through the head unit 501 and a spiral shaft 507 inserted through the anvil unit 502. The spiral shafts 504, 507 extend along the orthogonal direction and supported by the frame 510. In consequence of the rotation of the spiral shaft 504, the head unit 501 is moved in the orthogonal direction as guided by the supporting shaft 503. In consequence of the rotation of the spiral shaft 507, the anvil unit 502 is moved in the orthogonal direction as guided by the supporting shaft 506.

The second drive mechanism 522 comprises a drive shaft 505 inserted through the head unit 501 and a drive shaft 508 inserted through the anvil unit 502. The drive shafts 505, 508 extend along the orthogonal direction and supported by the frame 510. In consequence of the rotation of the drive shaft 505, the driving force for transfixing a sheaf is transmitted to the head unit 501 and the head unit 501 is rotated about the supporting shaft 503 as a center. In consequence of the rotation of the drive shaft 508, the driving force for bending shanks of a staple is transmitted to the anvil unit 502 and the anvil unit 502 is rotated about the supporting shaft 506 as a center. The drive shafts 505, 508 include a shaft possessed of a rectangular cross section incapable of generating slippage for the purpose of infallibly transmitting the driving force to the units 501, 502. When the drive shafts are formed of a round bar, the slippage between the drive shafts and the units 501 and 502 may be precluded by means of a key or a key groove, for example.

The units 501, 502 can be linearly moved independently and parallel along the orthogonal direction with the aid of the plurality of shafts 503–505 and 506–508, which are inserted respectively.

The head unit 501 and the anvil unit 502 are moved along the orthogonal direction by the rotation of the spiral shafts 504, 507 which have the same phases. A timing belt 511 is suspended as passed around the spiral shafts 504, 507. This belt 511 is connected to a drive motor 512. The drive motor 512 is formed of a DC motor and enabled by a pulse disc sensor 513 to produce a controlled rotation. Owing to the construction, the units 501, 502 can be severally moved in an equal distance. The first drive mechanism 521 is composed of the spiral shafts 504 and 507, the timing belt 511, the drive motor 521, etc.

A light-permeable sensor 516 is mounted on the frame 510 for detecting the home positions of the units 501, 502. After detecting the gobos provided on the head unit 501 by the sensor 516, the units 501, 502 are both moved to the respective home positions. The distances of movement of the units 501, 502 are set on the basis of the home positions.

The head unit 501 and the anvil unit 502 are actuated to produce the transfixing motion by the rotation of the drive shafts 505, 508. A belt 514 is suspended as passed around the drive shafts 505, 508. This belt 514 is connected to a drive motor 515. Owing to this construction, the units 501, 502 are severally driven to transfix a sheaf at positions arbitrarily selected in the orthogonal direction. The second drive mechanism 522 is composed of the drive shafts 505 and 508, the belt 514, the drive motor 515, etc.

[Description of operation]

The head unit 501 and the anvil unit 502 of the stapler 500 at first stand at rest at the home positions for intercepting the light from the sensor 516. The sheets outputted from the copying machine 10 are conveyed to the additional-work tray 401 and are stacked and aligned. When as many sheets as suffice for one job are stacked on the additional-work tray 401, the stacked sheet are conveyed as a sheaf in the direction of the stapler 500.

The first sheaf-conveying rollers 114, 115 as a conveying device for nipping and conveying the sheaf to the stapler 500 can control the conveying distance of the sheaf by the amounts of their rotation. The first sheaf-conveying rollers 114, 115 convey the sheaf at a position such that the stapling position arbitrarily selected on the sheaf coincides with the transfixing position.

Thereafter, the drive motor 512 is actuated to rotate the spiral shafts 504, 507 through the belt 511 while the pulse disc sensor 513 detects the amount of rotation. The units 501, 502 are severally moved over an equal distance in the direction of the stapling positions selected arbitrarily. When the units 501, 502 are stopped at the selected stapling positions, the drive motor 515 is actuated to rotate the drive shafts 505, 508 through the belt 514. The units 501, 502 are rotated to transfix a sheaf.

When the stapling is performed at a plurality of points falling on a straight line along the orthogonal direction, the units 501, 502 are moved to the next transfixing point by the operation of the motor 512 after completing the transfixing work at the first point. Then, the motor 515 is actuated to perform the transfixing work. By repeating this process, the stapling work at the plurality of points is wholly completed.

[Mechanism for conveyance of sheaf]

Figure 25A:
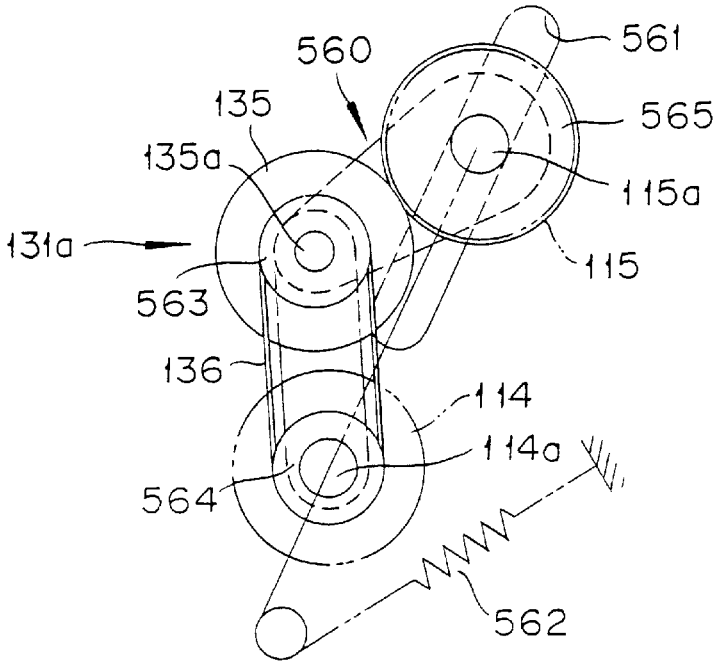
FIG. 25A–FIG. 25C are structural diagrams illustrating the first sheet-conveying roller.
Figure 25B:
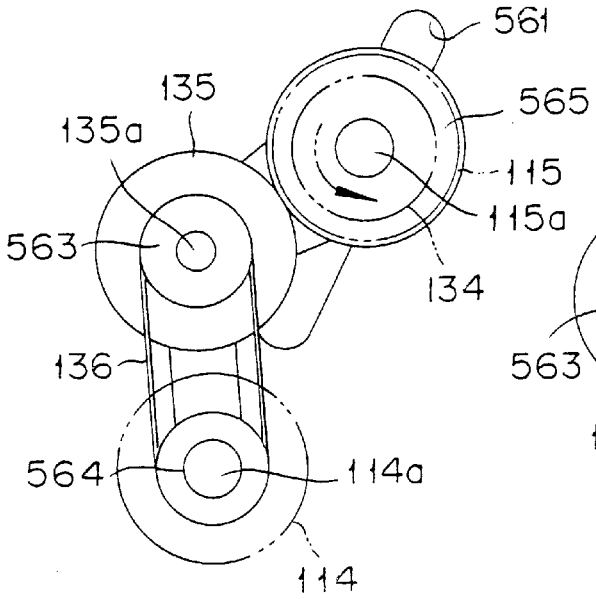
Figure 25C:
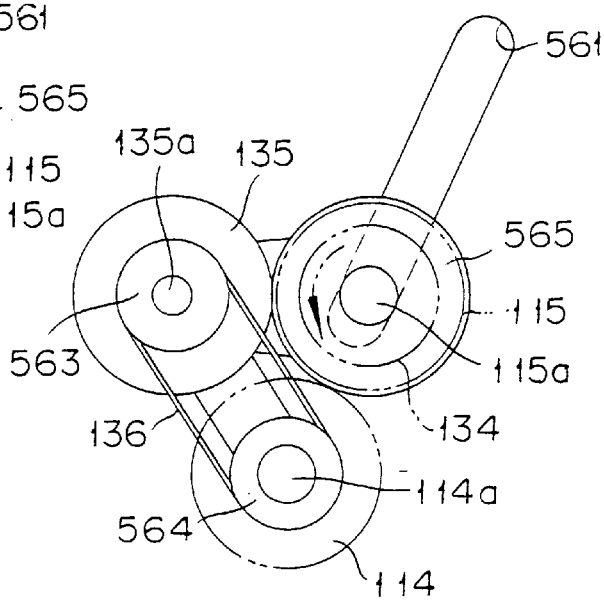

FIG. 25A–FIG. 25C are structural diagrams illustrating the first sheaf-conveying rollers 114, 115.

The first sheaf-conveying rollers 114, 115 formed of a pair of upper and lower rollers are disposed in the upstream section of the stapler 500 and the second sheet-conveying rollers 116, 117 likewise formed of a pair of upper and lower rollers are disposed in the downstream section as illustrated in FIG. 23. The first sheaf-conveying rollers 114, 115 nip and convey a sheaf awaiting a stapling and the second sheet-conveying rollers 116, 117 mainly nip and convey the stapled sheaf. The distance between the nipping position of the first sheaf-conveying rollers 114, 115 and the nipping position of the second sheet-conveying rollers 116, 117 is set at a size slightly smaller than the smallest of the sizes of sheets to be conveyed.

The upper roller 115 of the first sheaf-conveying rollers is freely pressed against and separated from the lower roller 114 of the first sheaf-conveying rollers by the operation of the first DC motor. The upper and lower rollers 114, 115 are both rotated by a stepping motor (denoted by reference numeral "128" in FIG. 31 which will be specifically described herein below). The conveying distance of the sheaf depends on the amount of rotation of the stepping motor. The second sheet-conveying rollers 116, 117 are similarly constructed. By the actuation of the second DC motor, the upper roller 117 is freely pressed against and separated from the lower roller 116, independently of the first sheaf-conveying rollers 114, 115. The upper and lower rollers 116, 117 are rotated by the same stepping motor as is used for driving the rollers 114, 115 and control the conveying distance of the sheaf.

The upper and lower rollers 114, 115 disposed on the upstream side of the stapler 500 are formed of a same kind of material having a desired hardness and are formed in an equal diameter. Likewise, the upper and lower rollers 116, 117 on the downstream side are formed of a same kind of material having a desired hardness and are formed in an equal diameter. However, the rollers 116, 117 have a smaller diameter than the rollers 114 and 115.

To be more specific, the upper and lower rollers 114, 115 on the upstream side are constructed of solid rubber having hardness of not more than 18 Hs (JIS [Japanese Industrial Standard] A) and are amply deformed when the rollers 114, 115 are pressed against the sheaf. The pressing force by the upper and lower rollers 114, 115 is such that the width of contact between the rollers and the sheets exceeds 5mm along the direction of rotation of the rollers. The upper and lower rollers 116, 117 on the downstream side are constructed of foam rubber of low hardness and exert on the sheaf lower pressing force than that on the upstream side. The hardness of the rollers 114, 115 will be further described herein below.

The lower roller 114 and the upper roller 115 of the first sheaf-conveying rollers are connected through a drive transmission mechanism 131*a* possessed of at least one idle gear 135 as illustrated in FIG. 25A. The lower roller 114 is disposed such that the roller surface protrudes from the stacking base of the additional-work tray 401. The drive transmission mechanism 131*a* is possessed of a link mechanism 560 which connects supporting shafts 135*a*, 114*a* and 115*a* respectively of the idle gear 135, the lower roller 114, and the upper roller 115. The link mechanism 560 regulates the distance between the shafts of the idle gear 135 and the lower roller 114 and the distance between the shafts of the idle gear 135 and the upper roller 115. An oblong hole 561 is formed in a (not shown) casing which supports the supporting shaft 114*a* of the lower roller 114 in a freely rotating state. The supporting shaft 115*a* of the upper roller 115 is slidably inserted through this oblong hole 561. The oblong hole 561 extends in the direction perpendicular to the stacking base of the additional-work tray 401. When the link mechanism 560 is actuated by the operation of the first DC motor, the upper roller 115 is moved along the direction perpendicular to the stacking base of the additional-work tray 401 between the spaced position (FIG. 25B) and the pressing position (FIG. 25C), with the supporting shaft 115*a* guided in the oblong hole 561.

The supporting shaft 115*a* of the upper roller 115 is connected to one end of a spring 562 for pressing force. The length of the oblong hole 561 is such that the supporting shaft 115*a* avoids contacting to the edge of the oblong hole 561 while the upper roller 115 is pressed against the lower roller 114. Thus, the desired pressing force by the spring 562 is exclusively given to the upper roller 115. The pressing force is given in the direction perpendicular to the sheet face of stacked sheets or the sheaf.

A belt 136 is suspended as passed around pulleys 563, 564 mounted on the supporting shafts 135*a*, 114*a* respectively of the idle gear 135 and the lower roller 114. The idle gear 135 is engaged with a gear 565 mounted on the supporting shaft 115*a* of the upper roller 115. The rotational driving force of the stepping motor is transmitted to the lower roller 114. However, the rotational driving force is transmitted to the upper roller 115 even when the upper and lower rollers 114, 115 are not pressed against each other, owing to the above construction. The advantages of the system, which transmits the rotational driving force to both the upper and lower rollers 114, 115, will be described herein below.

On the supporting shaft 115*a* of the upper roller 115, at least one one-way clutch 134 which permits rotation exclusively in the direction indicated by an arrow in the diagram is mounted, as illustrated in FIG. 25B and FIG. 25C. This one-way clutch 134 keeps the upper roller 115 from rotating when the link mechanism 560 is actuated and the upper roller 115 is lowered from the spaced position to the pressing position. The second sheet-conveying rollers 116, 117 are similarly constructed though omitted from illustration.

The upper rollers 115, 117 are so constructed as to produce no rotation while being pressed against each other. Thus, the possibility of the sheets in the sheaf suffering from such inconveniences as disruption of alignment and sustentation of folds and wrinkles can be precluded when the sheaf is conveyed from the first sheaf-conveying rollers 114, 115 for nipping and conveying the sheaf before stapling to the second sheet-conveying rollers 116, 117 disposed on the downstream side of the stapler 500. The upper rollers 115, 117 and the lower rollers 114, 116 can be rotated through the drive transmission mechanism 131*a* even when the upper rollers 115, 117 and the lower rollers 114, 116 are in a separated state. Thus, the sheaf of an arbitrary number of sheets not exceeding the largest number allowed for conveyance can be conveyed without incurring such inconveniences as irregularity or deviation.

Further, the above arrangement of the shape, material, and disposition of the upper and lower rollers 114, 115 for conveying the sheaf makes it possible to convey the sheaf without entraining such inconveniences as disruption of alignment and sustentation of folds and wrinkles. Particularly, the setting of the material and the pressing force of the first sheaf-conveying rollers 114, 115 for conveying the sheaf awaiting a stapling makes it to convey the sheaf to the desired stapling position without incurring disruption of alignment. Further, the arrangement of the material and the pressing force of the-second sheet-conveying rollers 116, 117 for mainly conveying the stapled sheaf makes it possible to convey the sheaf without incurring such inconveniences as misalignment and wrinkles even when the sheaf thrust into the interface between the rollers 116 and 117 which are in a mutually pressed state. The construction of the drive mechanism for the second sheet-conveying rollers 116, 117 is identical to that of the drive mechanism for the first sheaf-conveying rollers 114, 115. Thus, there is no possibility of the sheaf being rotated about a staple as a center and no possibility of the sheets in the sheaf incurring such inconveniences as misalignment and wrinkles around the staple when the sheaf has been stapled only at one point.

A first sensor 137, which detects the edge of the sheaf being conveyed, is disposed near the downstream side of the first sheaf-conveying rollers 114, 115 as illustrated in FIG. 23. Likewise, the second sensor 118 is disposed near the downstream side of the second sheet-conveying rollers 116, 117. The sensors 118, 137 are each disposed at a position separated by a certain distance from the position for driving a staple needle.

At least the conveying path between the first sheaf-conveying rollers 114, 115 and the second sensor 118 is formed of a guide in a straight shape. The reason for the use of the straight guide is as follows.

The leading end of the sheaf is aligned, during the temporary stacking of sheets, by the leading end stopper 409. The pressure contact of the first sheaf-conveying rollers 114, 115 is initiated while the sheaf is in the state. Thus, the leading end of the sheaf is nipped as kept in the aligned state by the first sheaf-conveying rollers 114, 115. The conveying path from the first sheaf-conveying rollers 114, 115 to the stapling position has a straight shape without bending. The leading end of the sheaf, therefore, keeps the aligned state intact even when the sheaf is nipped and conveyed to the stapling position by the first sheaf-conveying rollers 114, 115. If the conveying path on the downstream side of the first sheaf-conveying rollers 114, 115 in the conveying direction is bent in the shape of an arc, the sheaf is elongated along the guide plate of a small radius and shortened along the guide plate of a large radius and the leading end of the sheaf is slanted relative to the guide plate. If the stapling perpendicular to the guide place is done, the sheaf is inevitably bound obliquely. Namely, the conveying path from the first sheaf-conveying rollers 114, 115 to the stapling position must be in a straight shape when the stapler 500 staples the sheaf which is nipped by the first sheaf-conveying rollers 114, 115.

The present embodiment, as described specifically herein below, is constructed such that a sheaf is nipped and conveyed by the first sheaf-conveying rollers 114, 115 and the sheaf is further nipped and conveyed by the second sheet-conveying rollers 116, 117 and the sheaf is separated from the first sheaf-conveying rollers 114, 115 and the sheaf is continuously conveyed by the second sheet-conveying rollers 116, 117 only and then the sheaf is stapled by the stapler 500. In other word, the leading end of the sheaf must remain in the aligned state until the sheaf being nipped and conveyed by the first sheaf-conveying rollers 114, 115 is newly nipped by the second sheet-conveying rollers 116, 117. It is, thus, required that the conveying path from the first sheaf-conveying rollers 114, 115 to the second sensor 118 at which the second sheet-conveying rollers 116, 117 starts nipping the sheaf is in a straight shape.

The second sheet-conveying rollers 116, 117 nip the sheaf in the downstream side from the stapling position. Thus, the conveying path in the downstream side from the second sensor 118 does not need to be in a straight shape but may be bent in the shape of an arc, for example. The finisher as a whole, therefore, can be prevented from adding to the size.

[Advantages of system for giving rotational driving force to both upper and lower rollers conveying the sheaf and hardness of rollers]

The advantages of transmitting the rotational driving force to both the upper and lower rollers engaging in the conveyance of the sheaf will be described below. In this specification, for the sake of convenience of description, the form of giving rotational driving force to both upper and lower rollers will be defined as "forced-parallel movement".

Figure 26:
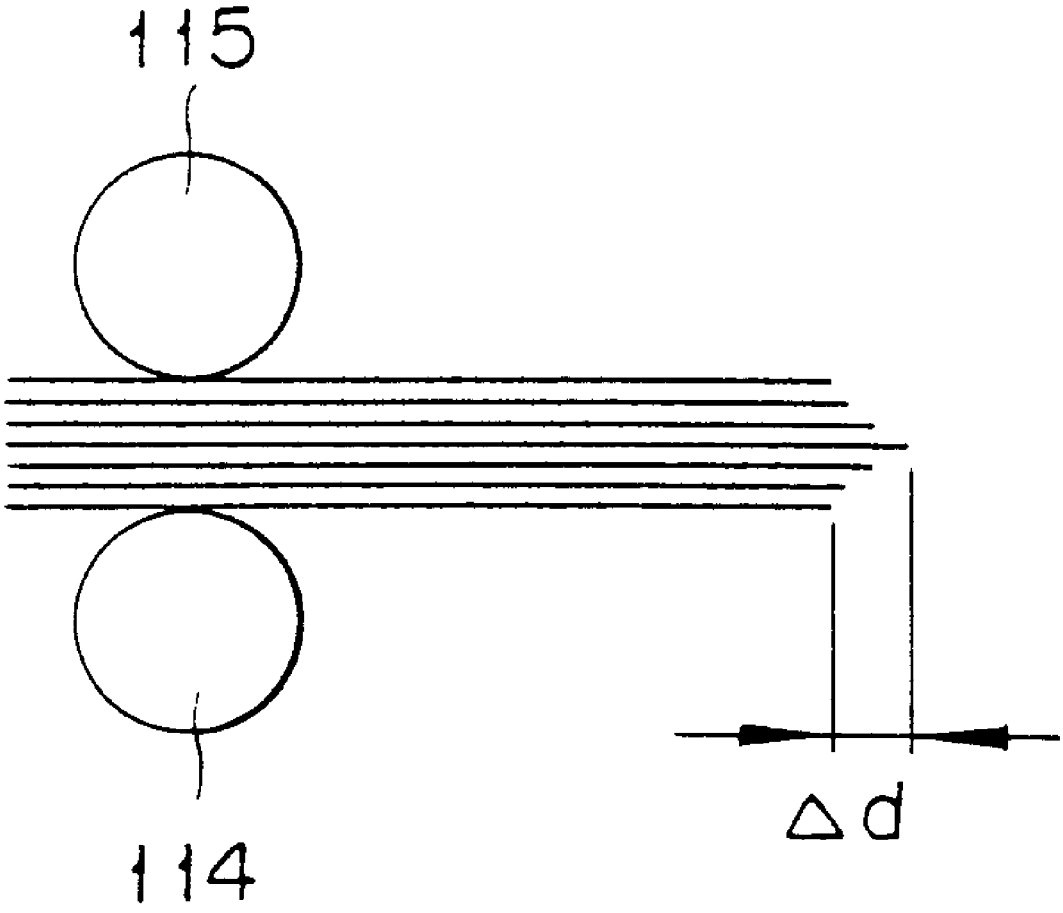
FIG. 26 is an explanatory diagram illustrating a portion defined as a sheet position deviation.

The sheet deviation was measured based on the presence or absence of the forced-parallel movement. The sheet deviation Δd represents the difference (mm) between the leading end of the foremost sheet and the leading end of the hindmost sheet being conveyed along the conveying direction as illustrated in FIG. 26. The measuring conditions were as follows.

1. Hardness of roller: 15 Hs (JIS A) as upper and lower rollers
2. Pressing force: 2 Kg
3. Method of conveyance: Manual feeding
4. Roller diameter: 30 mm
5. Conveying distance: 38 mm The hardness of the rubber used for the rollers was measured by the spring type hardness test (Type A) specified in JIS K 6301.

Figure 27A:
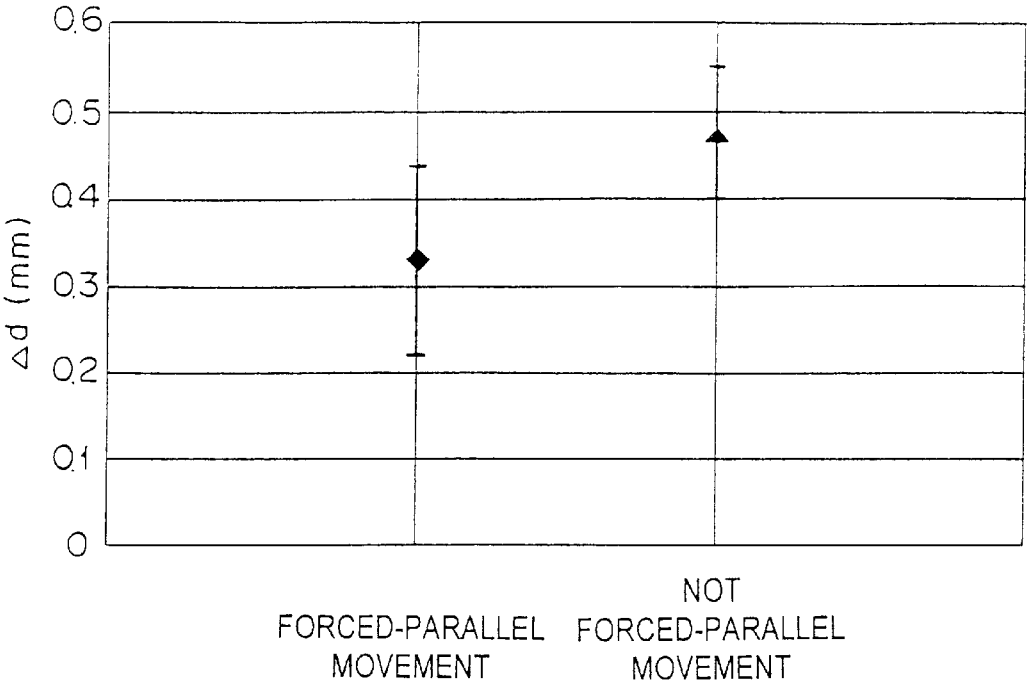
FIG. 27A is a graph showing the relation between the presence or absence of "forced-parallel movement" and the sheet position deviation.

The results of the test are shown in FIG. 27A. It is clearly noted from this graph that the sheet deviation Δd in the absence of a forced-parallel movement was about 1.4 times that in the presence of a forced-parallel movement. The data clearly show that the forced-parallel movement system of driving both the paired rollers allows more reduction in the sheet deviation than the system of driving one of the paired rollers and following the other roller.

Next, the hardness of the rollers for conveying the sheaf will be studied below.

The rollers with varying hardness were tested for sheet deviation Δd. The conditions of the test were as follows.

Figure 27B:
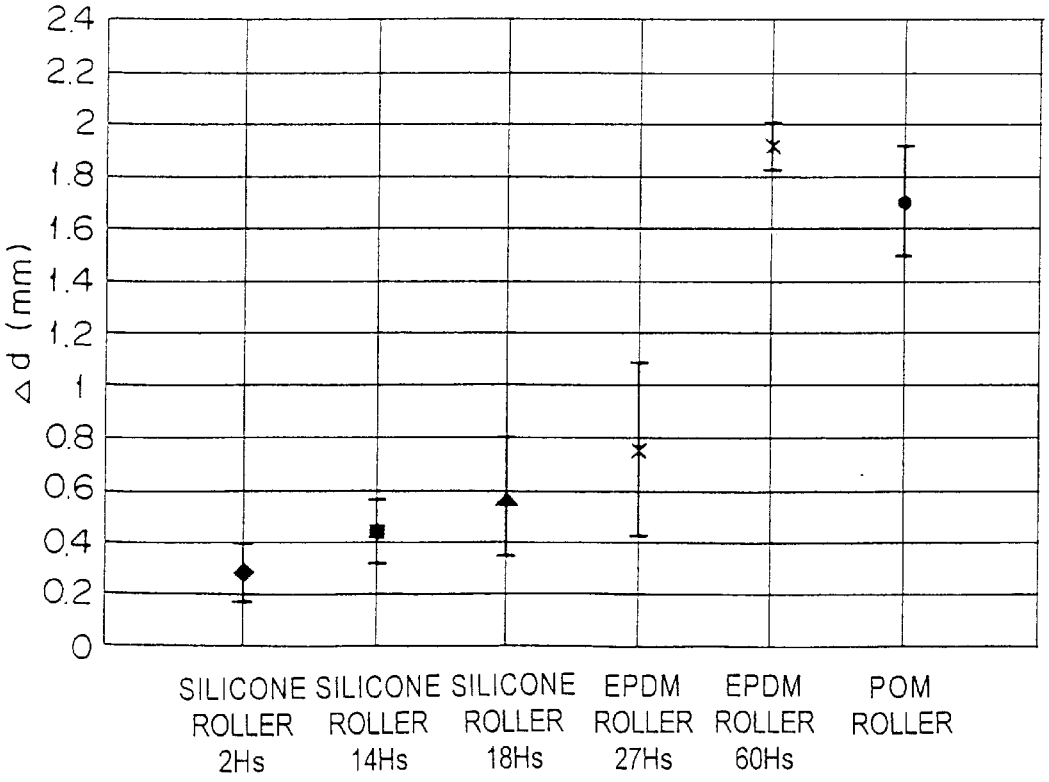
FIG. 27B is a graph showing the relation between hardness of the sheet-conveying rollers and the sheet position deviation.

1. Identical upper and lower rollers and forced-parallel movement
2. Pressing force: 2 Kg
3. Speed of conveyance: 320 mm/sec
4. Roller diameter: 24 mm
5. Conveying distance: 38 mm The sheet deviation Δd must be repressed to below 1 mm for obtaining a sheaf with a fine appearance after the stapling. Thus, the sheet deviation Δd within 1 mm were rated as acceptable. The results of the test are shown in FIG. 27B.

It is clear from this graph that, in case of the silicone rubber rollers having 2 Hs (JIS A), 14 Hs (JIS A), and 18 Hs (JIS A) in hardness, the sheet deviation Δd was invariably less than 1 mm and were rated as acceptable. In case of the EPDM (ethylene propylene rubber) roller and the POM (polyacetal) rollers having both 60 Hs (JIS A) in hardness, the sheet deviation Δd were both more than 1.4 mm and were rated as not acceptable. In case of the silicone rubber roller having 27 Hs (JIS A) in hardness, the sheet deviation Δd at times exceeded 1 mm. The data clearly show that it suffices to use a roller, not more than 18 Hs (JIS A) in hardness, for the purpose of repressing the sheet deviation Δd to below 1 mm, with due allowance for more or less dispersion of test results.

[Control of stapling position]

When the staple mode is selected, sheets are stacked on the additional-work tray 401. At this time, the first sheaf-conveying rollers 114, 115 are separated from each other. After the temporary stacking or storing of the sheets is completed, the first sheaf-conveying rollers 114, 115 are shifted to a mutually pressed state to nip a sheaf of the sheets and the leading end stopper 409 retracts outside the conveying path. Then, the sheaf is conveyed by rotating the first sheaf-conveying rollers 114, 115 and the stapling position is located along the conveying direction. The present embodiment contemplates three staple modes. The first mode is "leading end bind" which binds the leading end of the sheaf along the conveying direction. The second mode is "center bind" which binds the central section of the sheaf along the conveying direction. The third mode is "trailing end bind" which binds the trailing end of the sheaf along the conveying direction. The operation of the positioning depends on these modes. The each operation of the location for modes will be described below.

(1) Leading End Bind

FIG. 28A–FIG. 28F are explanatory diagrams illustrating the operation of leading end bind.

Figure 28A:
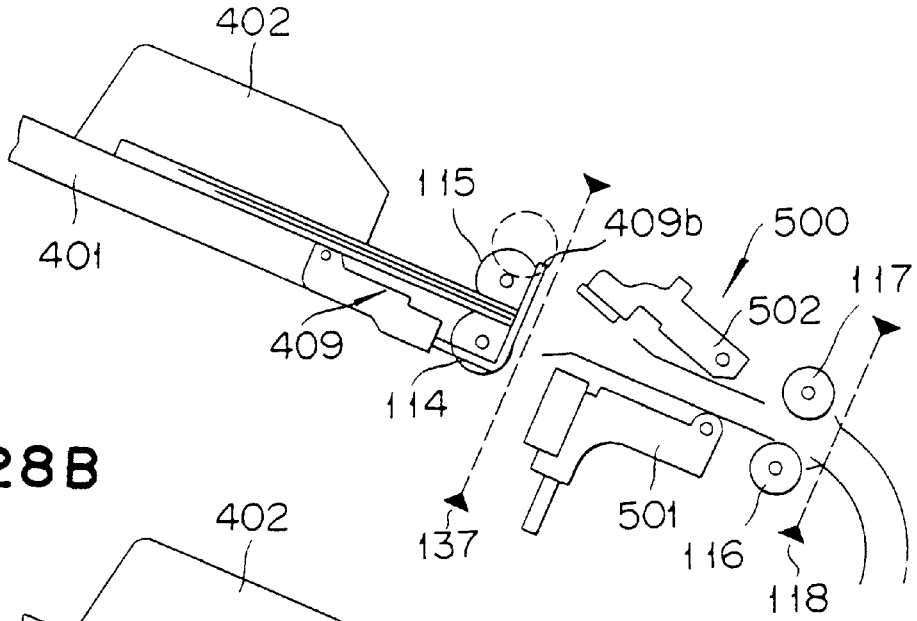
FIG. 28A–FIG. 28F are explanatory diagrams illustrating the operation of leading end binding.
Figure 28B:
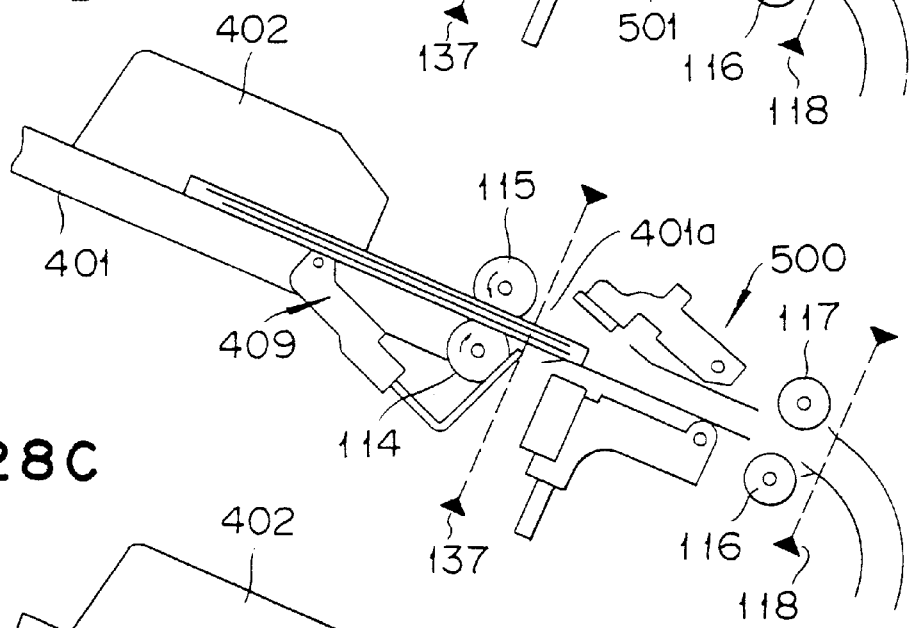
Figure 28C:
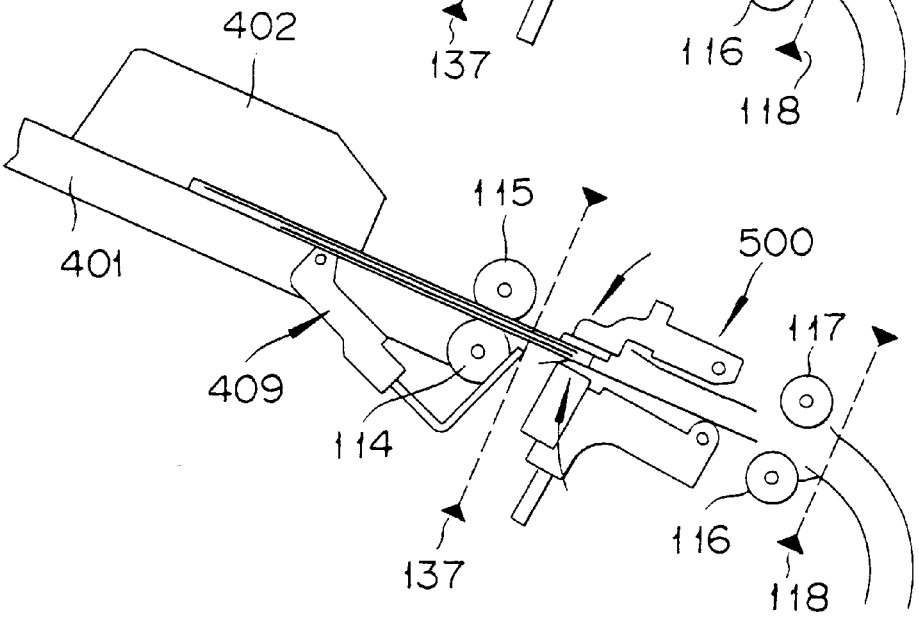

The leading end of the sheaf has already undergone the FD-alignment during the temporary stacking of sheets with the blocking plate 409*b* of the leading end stopper 409 used as a regulating face (FIG. 28A). In the mode of leading end bind, it suffices for the location of the stapling position to convey the sheaf in a certain distance without reference to the size of sheet. To be specific, it is only required that the first sheaf-conveying rollers 114, 115 convey the sheaf in the distance resulting from adding the length from the leading end of the sheaf to the desired stapling position (normally about 10 mm) to the length from the blocking plate 409*b* of the leading end stopper 409 to the stapler 500 (FIG. 28B). After the sheaf has been conveyed in the prescribed distance, the rollers 114, 115 are stopped and the stapler 500 is actuated to staple the sheaf (FIG. 28C).

Figure 28D:
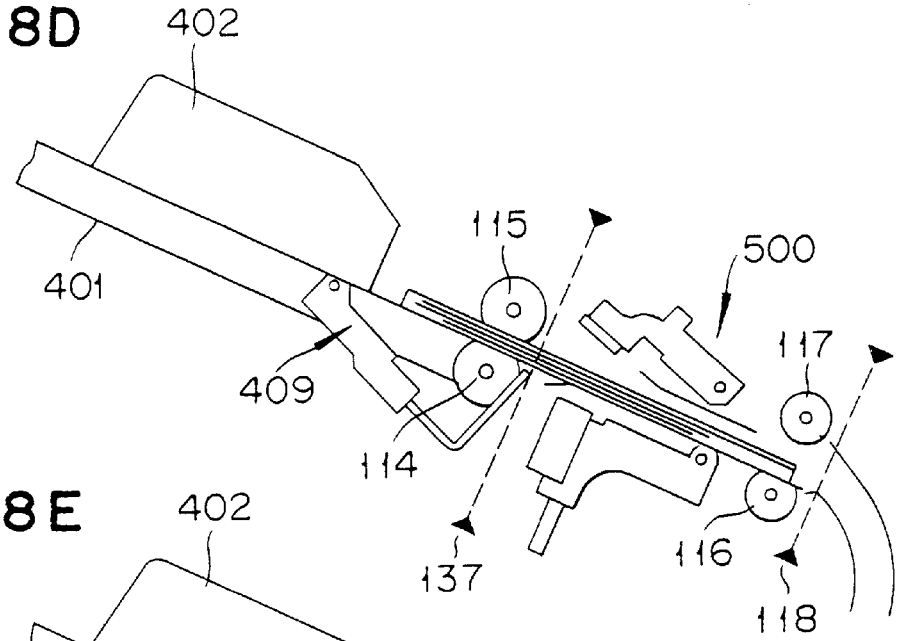
Figure 28E:
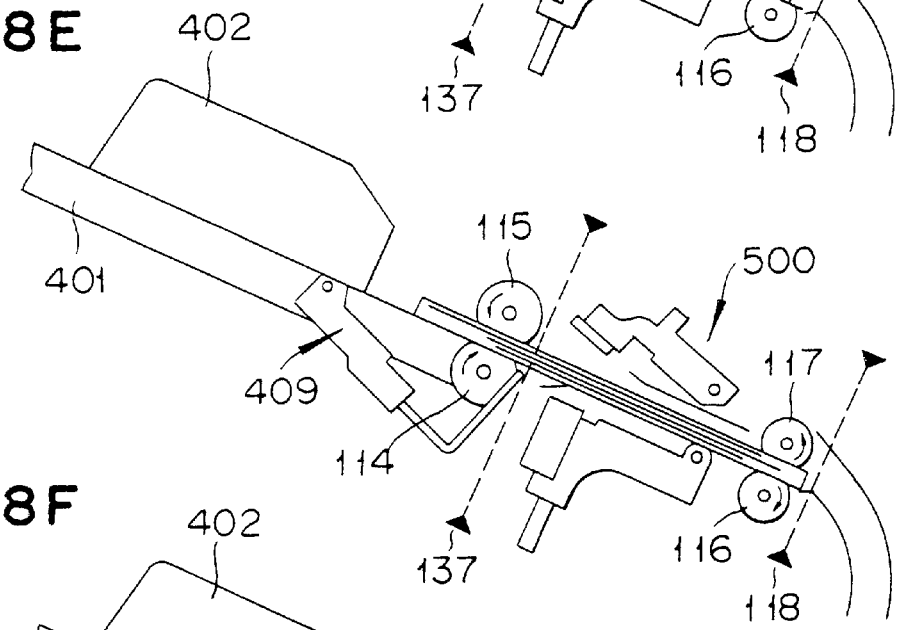
Figure 28F:
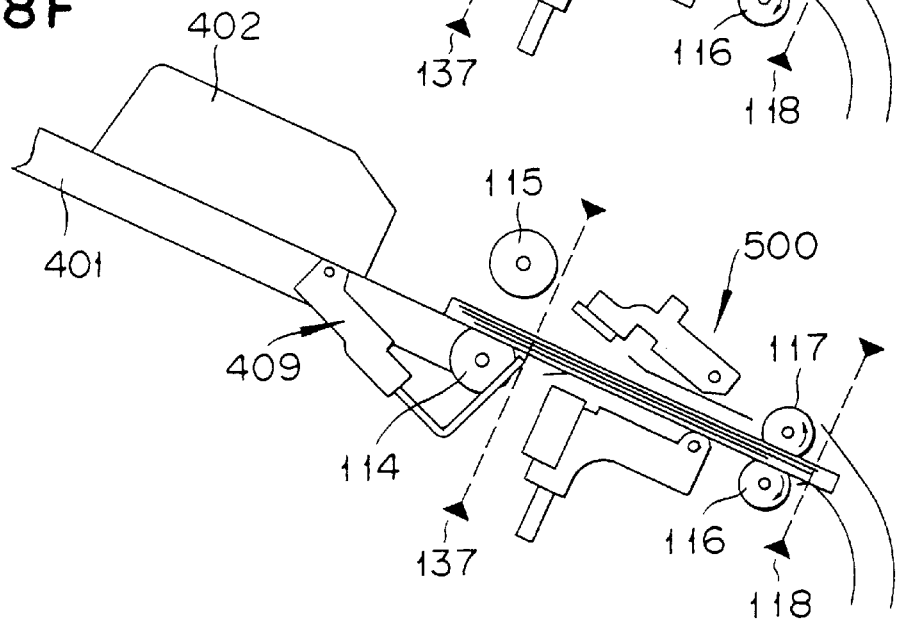

The conveyance of the sheaf is resumed after the completion of the stapling. The conveyance of the sheets is stopped when the leading end completely reaches the second sheet-conveying rollers 116, 117. At this time, the second sheet-conveying rollers 116, 117 are still in a mutually separated state (FIG. 28D). After the conveyance of the sheaf has ceased, the second sheet-conveying rollers 116, 117 are shifted to a mutually pressed state to nip the leading end of the sheaf. Then, the second sheet-conveying rollers 116, 117 are rotated to start the conveyance of the sheaf again (FIG. 28E). The first DC motor is actuated with continuing the conveyance of the sheaf and exclusively shifts the first sheaf-conveying rollers 114, 115 to a mutually separated state (FIG. 28F). The sheaf is subsequently conveyed and nipped by the second sheet-conveying rollers 116, 117 toward the accumulating tray unit 600.

The stepping motor rotates the first and second sheaf-conveying rollers 114–117. The conveying distance of the sheaf is controlled by regulating the pulses of the stepping motor.

(2) Center Bind

FIG. 29A–FIG. 29D are explanatory diagrams illustrating the operation of the center bind.

In the mode of center bind, the stapling is done in the central section of the sheaf along the conveying direction. Naturally, the conveying distance of the sheaf for the stapling varies with the size of sheet. The conveying distance is long as compared with that involved in the mode of leading end bind.

The stepping motor conveys the sheaf. It is theoretically possible to control, by simply changing pulses, the conveying distance even when the conveying distance is long. However, the diameters of the sheaf-conveying rollers 114–117 and the widths of the nips cannot be thoroughly freed from dimensional dispersions. Namely, the inaccuracy in the actual conveying distance enlarges in proportion as the conveying distance lengthens. To reduce the inaccuracy, the conveyance of the sheaf in the mode of center bind is effected as follows.

Figure 29A:
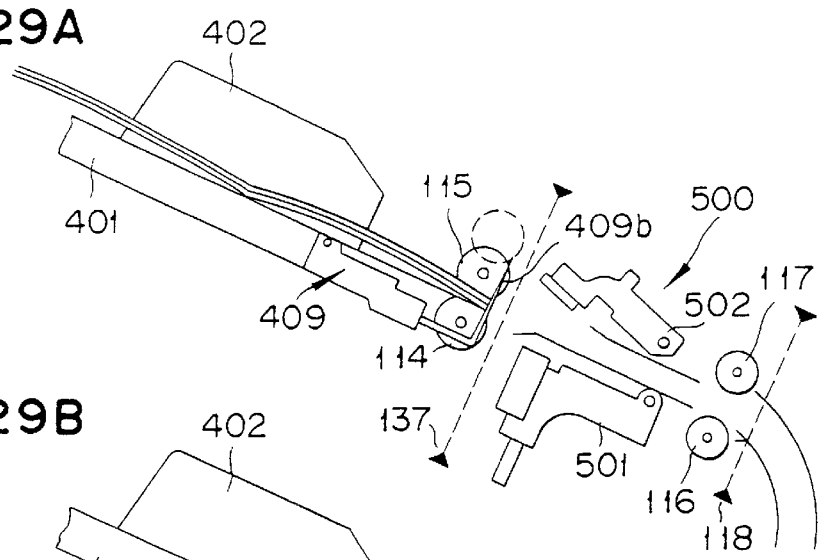
FIG. 29A–FIG. 29D are explanatory diagrams illustrating the operation of intermediate binding.
Figure 29B:
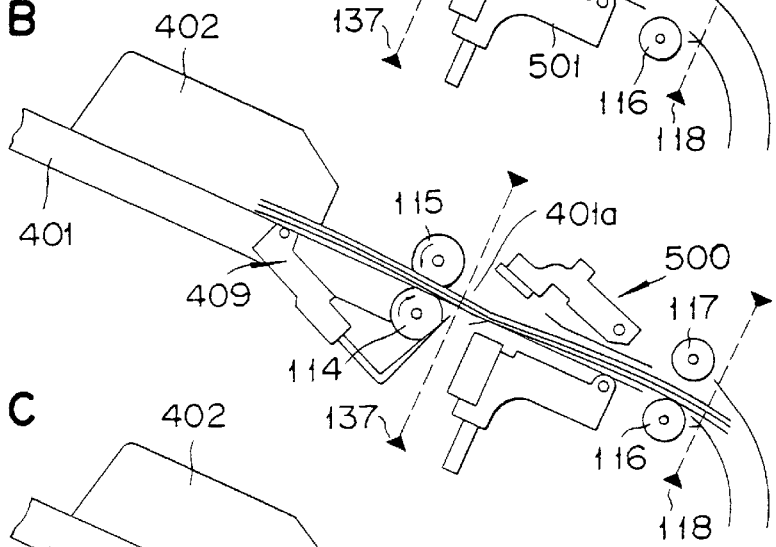
Figure 29C:
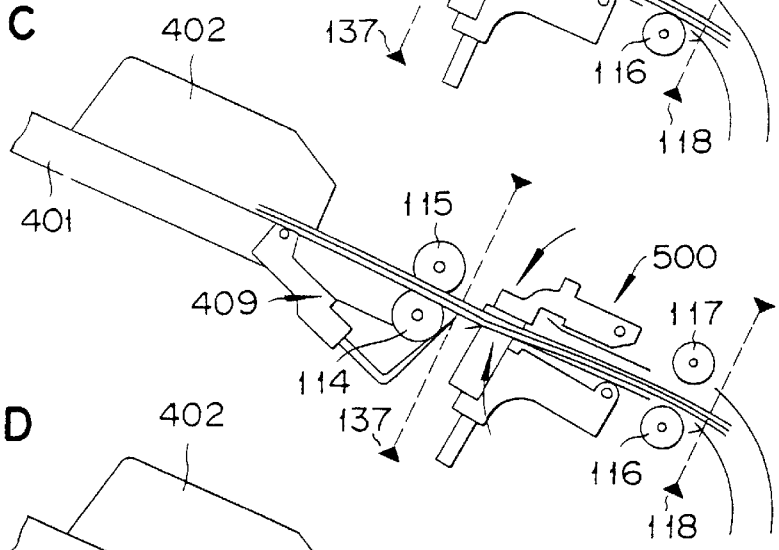

First, a sheaf is nipped and conveyed by the first sheaf-conveying rollers 114, 115. After the second sensor 118 disposed in the downstream side of the second sheet-conveying roller 116, 117 has detected the leading end of the sheaf, the sheaf is further conveyed in a distance proper for the sheet size and is stopped (FIG. 29A and FIG. 29B). Then, the sheaf is stapled (FIG. 29C).

Figure 29D:
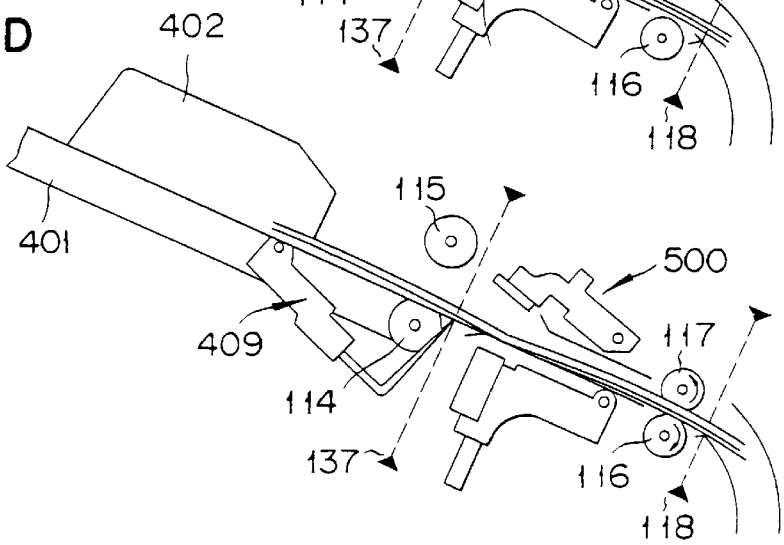

At this time, the leading end of the sheaf has completely reached the second sheet-conveying rollers 116, 117. The second sheet-conveying rollers 116, 117 nips the sheaf. Then, the second sheet-conveying rollers 116, 117 are rotated to resume the conveyance of the sheaf. Meanwhile the first DC motor is actuated to shift the first sheaf-conveying rollers 114, 115 alone to a mutually separated state, continuing the conveyance of the sheaf (FIG. 29D). Thereafter, the sheaf is conveyed and nipped by the second sheet-conveying rollers 116, 117 toward the accumulating tray unit 600.

The center bind does not need to be limited to the above manner but may be carried out as follows instead. First, the sheaf is nipped and conveyed by the first sheaf-conveying rollers 114, 115. The conveyance is stopped when the leading end of the sheaf completely reaches the second sheet-conveying rollers 116, 117. And the second sheet-conveying rollers 116, 117 nips the sheaf. After the completion of the nipping by the second sheet-conveying rollers 116, 117, the first DC motor is actuated to shift the first sheaf-conveying rollers 114, 115 to a mutually separated state.

After the completion of the operation of mutually separating the first sheaf-conveying rollers 114, 115, the second sheet-conveying rollers 116, 117 is rotated to resume the conveyance of the sheaf. When the second sensor 118 detects the leading end of the sheaf, the sheaf is stopped after conveyed in a proper distance in response to the sheet size. Then, the sheaf is stapled. The stapled sheaf resumes being conveyed and nipped by the second sheet-conveying rollers 116, 117 toward the accumulating tray unit 600. In short, the sheaf for the binding work can be conveyed as pulled by the second sheet-conveying rollers 116, 117 and, thus, the leading end of the sheaf does not form resistance and the irregularity of the leading end of the sheaf is reduced.

The mode of center bind is applied solely to creased sheets. And sheets having a length not less than twice the length of a sheet of the smallest size to be conveyed are only applicable.

(3) Trailing End Bind

FIG. 30A–FIG. 30D are explanatory diagrams illustrating the operation of trailing end bind.

Figure 30A:
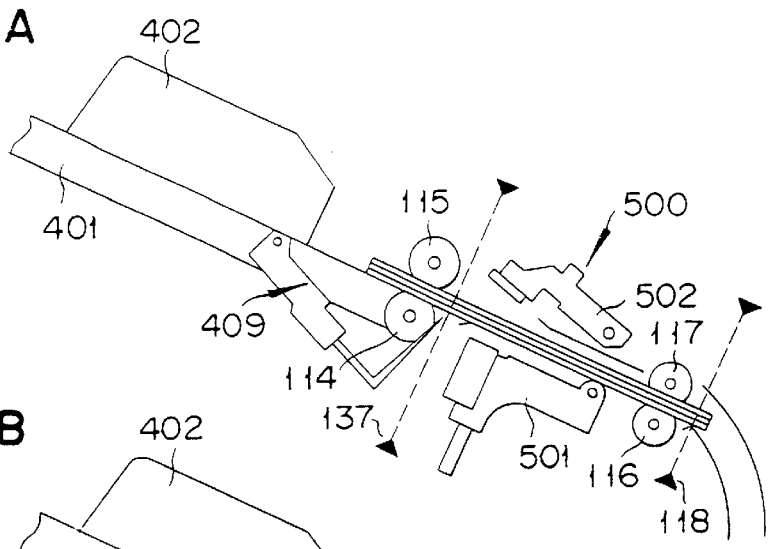
FIG. 30A–FIG. 30D are explanatory diagrams illustrating the operation of trailing end binding.
Figure 30B:
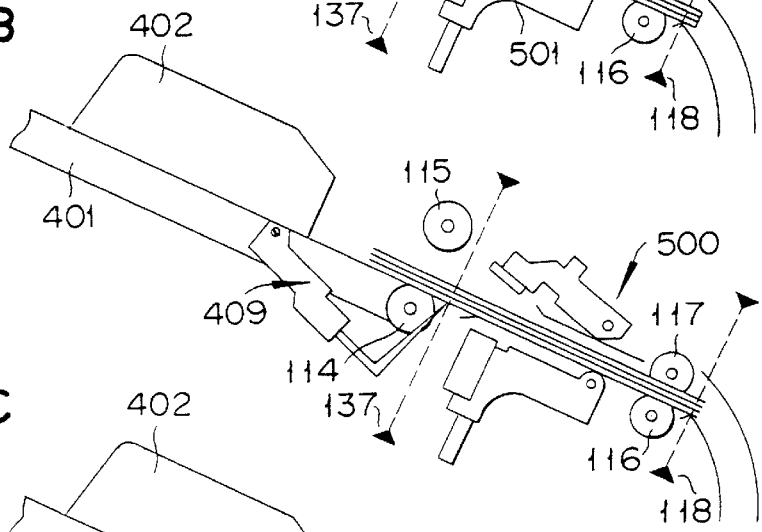
Figure 30C:
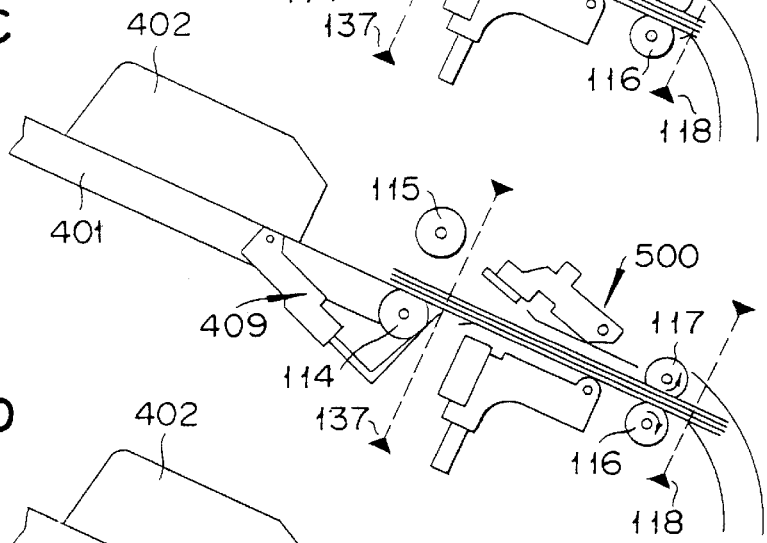
Figure 30D:
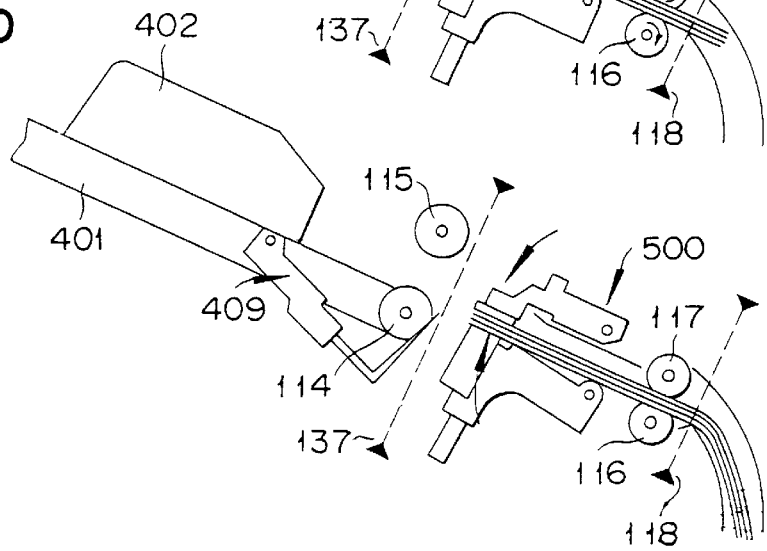

In the mode of trailing end bind, first the sheaf is nipped and conveyed by the first sheaf-conveying rollers 114, 115. When the leading end of the sheaf completely reaches the second sheet-conveying rollers 116, 117, the conveyance is stopped and the sheaf is nipped by the second sheet-conveying rollers 116, 117 (FIG. 30A). After the completion of the nipping by the second sheet-conveying rollers 116, 117, the first DC motor is actuated to shift the first sheaf-conveying rollers 114, 115 to a mutually separated state (FIG. 30B). After the completion of the operation for mutually separating the first sheaf-conveying rollers 114, 115, the second sheet-conveying rollers 116, 117 is rotated to resume the conveyance of the sheaf (FIG. 30C). When the second sensor 118 detects the leading end of the sheaf, the sheaf is stopped after conveyed in a certain distance proper for the sheet size. Then the sheaf is stapled (FIG. 30D).

The stapled sheaf resumes being conveyed and nipped by the second sheet-conveying rollers 116, 117 toward the accumulating tray unit 600.

In the above mode of conveyance, the conveying distance is set based on the position of the second sensor 118. Optionally, the conveying distance in the mode of trailing end bind may be set based on the position of the first sensor 137 which is disposed in the downstream side of the first sheaf-conveying rollers 114, 115. In the present mode, the sheaf is conveyed in a certain distance after the first sensor 137 has detected the trailing end of the sheaf. Namely, the sheaf has only to be conveyed in a prescribed distance without reference to the size of sheet. The first sensor 137 approximates closely to the stapling position. Advantageously, it results in shortening the conveying distance and improving the positioning accuracy.

Incidentally, the following operational flow is conceivable for the purpose of shortening the total time to be spent in conveying the sheaf and improving the productivity. The operational flow specifically comprises a step of causing the first sheaf-conveying rollers 114, 115 located in the upstream side and the second sheet-conveying rollers 116, 117 located in the downstream side of the stapler 500 severally to nip and convey the sheaf again, and a step of mutually separating the first sheaf-conveying rollers 114, 115 during the resumed conveyance.

When a sheaf has already stapled as in the mode of leading end bind or the mode of center bind, it incurs no particularly serious problem that the sheaf resumes being conveyed and nipped by both of the sheaf-conveying rollers 114, 115 and 116, 117 and then the first sheaf-conveying rollers 114, 115 is mutually separated. However, it possibly incur such inconveniences as disruption of sheet alignment owing to the difference in the conveying speed of the sheaf in the upstream zone and the downstream zone that the sheaf which has not been stapled is nipped and conveyed by both the sheaf-conveying rollers 114, 115 and 116, 117 as in the mode of trailing end bind.

Accordingly, in the present embodiment the first DC motor is actuated after the completion of nipping the sheaf by the second sheet-conveying rollers 116, 117 and the sheaf resumes being conveyed by the second sheet-conveying rollers 116, 117 alone after the completion of the mutual separation of the first sheaf-conveying rollers 114, 115 when the sheaf will be stapled later.

[Retracting of stapler 500 during restoring from jam]

The head unit 501 and the anvil unit 502 of the stapler 500 are so constructed as to be moved in the orthogonal direction by the drive motor 512 as a DC motor. The drive motor 512 is provided with the pulse disc sensor 513 as a pulse generating device and controls the positions of the units 501, 502 based on the pulses outputted from the pulse disc sensor 513 and the signal outputted from the sensor 516 which detects the units 501, 502 at the home positions. The home positions of the units 501, 502 are the positions approximated most closely to the front face of the finisher 100 inside the frame 510, i.e. the positions at which the units 501, 502 are kept waiting outside the conveying path.

When a jam of sheet occurs in the stapler 500 while the stapling is being performed on the sheaf which have been stacked in the additional-work tray 401 and conveyed to the stapler 500, the units 501, 502 respectively are returned to the home positions and then the fact that the jam of sheet has occurred in the stapler is outputted on the control panel of the copying machine 10.

When the completion of restoration from the jam is detected, the units 501, 502, which have retracted to the home positions, are moved to the positions which they assumed when the jam of sheet occurred.

<<Sheet discharge unit 550>>

Figure 31:
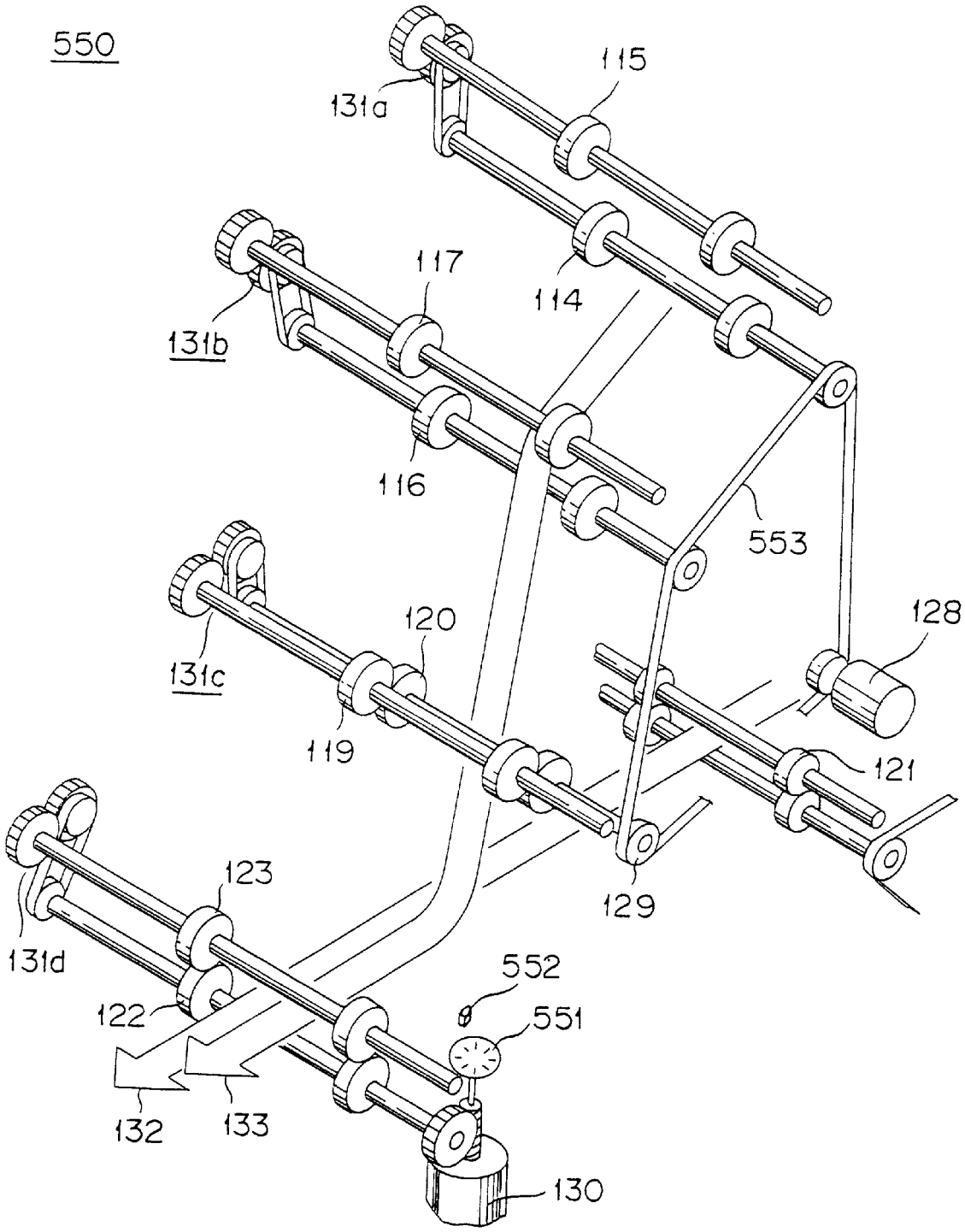
FIG. 31 is a perspective view illustrating an artist concept of a sheet discharge unit for conveying a stapled sheaf and one unstapled sheet in the direction of an accumulating tray unit.

FIG. 31 is a perspective view illustrating an artist concept of a sheet discharge unit 550 which conveys a stapled sheaf of sheets and an unstapled single sheet toward the accumulating tray unit 600. In the diagram, the reference numeral "132" de notes a conveying path for conveying the single sheet and the reference numeral "133" denotes a conveying path for the sheaf. In this diagram, the positional relation of the rollers is deliberately differentiated from that illustrated in FIG. 2 to facilitate comprehension of the conveying paths.

The accumulating tray 601 of the accumulating tray unit 600 receives a sheaf of sheets, which is discharged from the additional-work tray 401 and stapled by the stapler 500, and an unstapled single sheet, which is conveyed through the other conveying path. The sheet discharge unit 550 is provided for the purpose of conveying the sheaf and the single sheet.

The sheet discharge unit 550, as illustrated in the diagram, comprises the third sheet-conveying rollers 119, 120 which conveys the sheaf, the conveying roller 121 disposed in the downstream side of the switch claw 103 and conveys a lone sheet, and discharging rollers 122, 123 which outputs the sheaf or the single sheet into the accumulating tray 601 in addition to the first and second sheaf-conveying rollers 114, 115 and 116, 117.

A DC motor 130 independently of the other rollers actuates the discharging rollers 122, 123. The DC motor 130 includes a disc 551. The rotational speeds of the discharging rollers 122, 123 are controlled in accordance with pulses outputted from the disc 551 detected by a pulse disc sensor 552.

The first and second and third sheaf-conveying rollers 114, 115 and 116, 117 and 119, 120 are driven by one stepping motor 128 through a belt 553. The third sheet-conveying rollers 119, 120 are connected to the stepping motor 128 through a one-way clutch 129 provided on the shaft of the roller 120. The one-way clutch 129 rotates freely in the direction of permitting the sheaf to move along the conveying direction even when the stepping motor 128 is in a stopped state. The other rollers disposed in the sheet-conveying path such as the conveying roller 121 are altogether driven by another DC motor (not shown).

The discharging rollers 122, 123 are required to steadily convey a lone unstapled sheet or a stapled sheaf, which are different in thickness. Accordingly, the discharging rollers 122, 123 comprise rollers made of a material of low hardness, and a clearance of the upper rollers 123 is large enough for accepting a thick sheaf, and pressing force to the lower roller 122 is relatively weak. The sheet discharge unit 550 is provided with drive transmission mechanisms 131*a*–131*d* including at least one idle device capable of transmitting the driving motions of the lower rollers 114, 116, 120 and 122 to the upper rollers 115, 117, 119 and 123 respectively in order to convey both the upper and lower sections of the sheaf steadily.

[Discharge of sheaf or single sheet onto accumulating tray 601]

The sheaf stored on the additional-work tray 401 is nipped and conveyed to the stapling position by the first sheaf-conveying rollers 114, 115 or the second sheet-conveying rollers 116, 117, depending on the selected mode of staple. After the stapling, the conveyance is started again by the second sheet-conveying rollers 116, 117. One stepping motor 128 rotates the first and second sheaf-conveying rollers 114, 115 and 116, 117. This stepping motor 128 also rotates the third sheet-conveying rollers 119, 120. The sheaf-conveying path 133 joins the sheet-conveying path 132 in the downstream side of the third sheet-conveying rollers 119, 120. Accordingly, the sheaf passes through the discharging rollers 122, 123 and reaches the accumulating tray 601. The discharging rollers 122, 123 are rotated independently by the DC motor 130. The rotational speeds of the discharging rollers 122, 123 are controlled, depending on the pulses outputted from the disc 551.

The stapled sheaf is conveyed through the conveying path 133. After the leading end of the sheaf has been completely nipped by the third sheet-conveying rollers 119, 120 with the one-way clutch 129, the second sheet-conveying rollers 116, 117 are mutually separated. The first sheaf-conveying rollers 114, 115 have been already separated mutually by the time that the leading end of the sheaf has been completely nipped in the third sheet-conveying rollers 119, 120.

When the first sensor 137 detects the fact that the trailing end of the sheaf has passed the leading end stopper 409, the leading end stopper 409 is reset to close the sheet discharging outlet 401*a* of the additional-work tray 401. Then, the temporary accumulation of sheets for the next stapling, or the next job is started.

The stepping motor 128 is stopped after the sheaf has been further conveyed and the leading end of the sheaf has been completely nipped in the discharging rollers 122, 123. At this time, the rotation of the discharging rollers 122, 123 has been already started and the first and second sheaf-conveying rollers 114–117 are in a mutually separated state while the third sheet-conveying rollers 119, 120 are provided with the one-way clutch 129. Thus, the sheaf is continuously conveyed and stored in the accumulating tray 601.

The distances between the leading end stopper 409 and the discharging rollers 122, 123 are set such that the leading end of the sheaf in the preceding job can completely reach the discharging rollers 122, 123 before the completion of the temporary accumulation of the sheets of the next job, without reference to the size of sheet and the number of sheets. Therefore, the stepping motor 128 is standing at rest at the time that the temporary accumulation of the sheets for the next job is completed. In brief, the first sheaf-conveying rollers 114, 115 can be pressed against the sheaf at the time that the accumulation of the sheets for the next job is completed and the start of stapling the next sheaf does not need to be retarded.

<<Accumulating tray unit 600>>

[Whole construction of accumulating tray unit 600]

Figure 32:
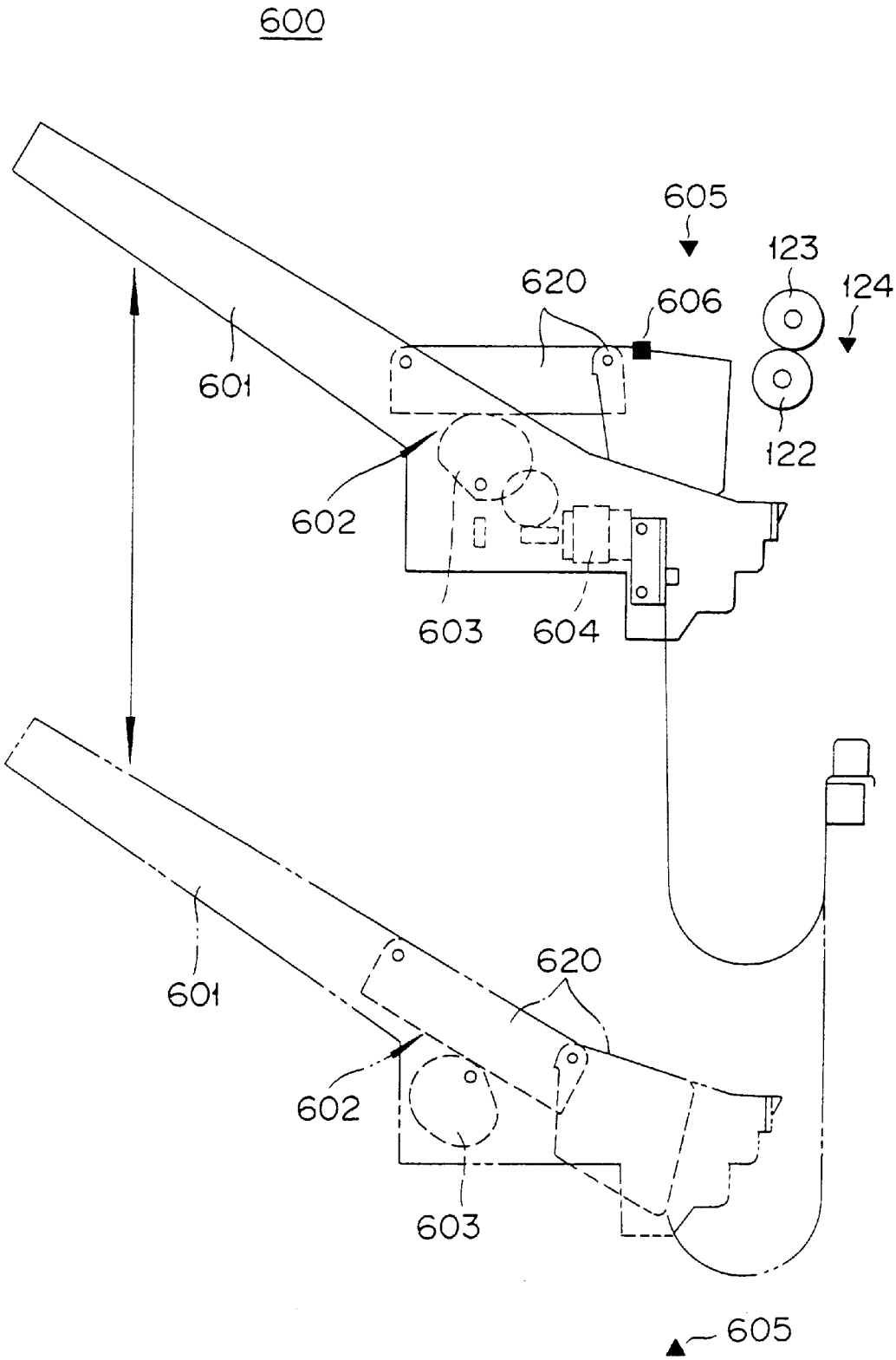
FIG. 32 is a structural diagram illustrating the accumulating tray unit.
Figure 33:
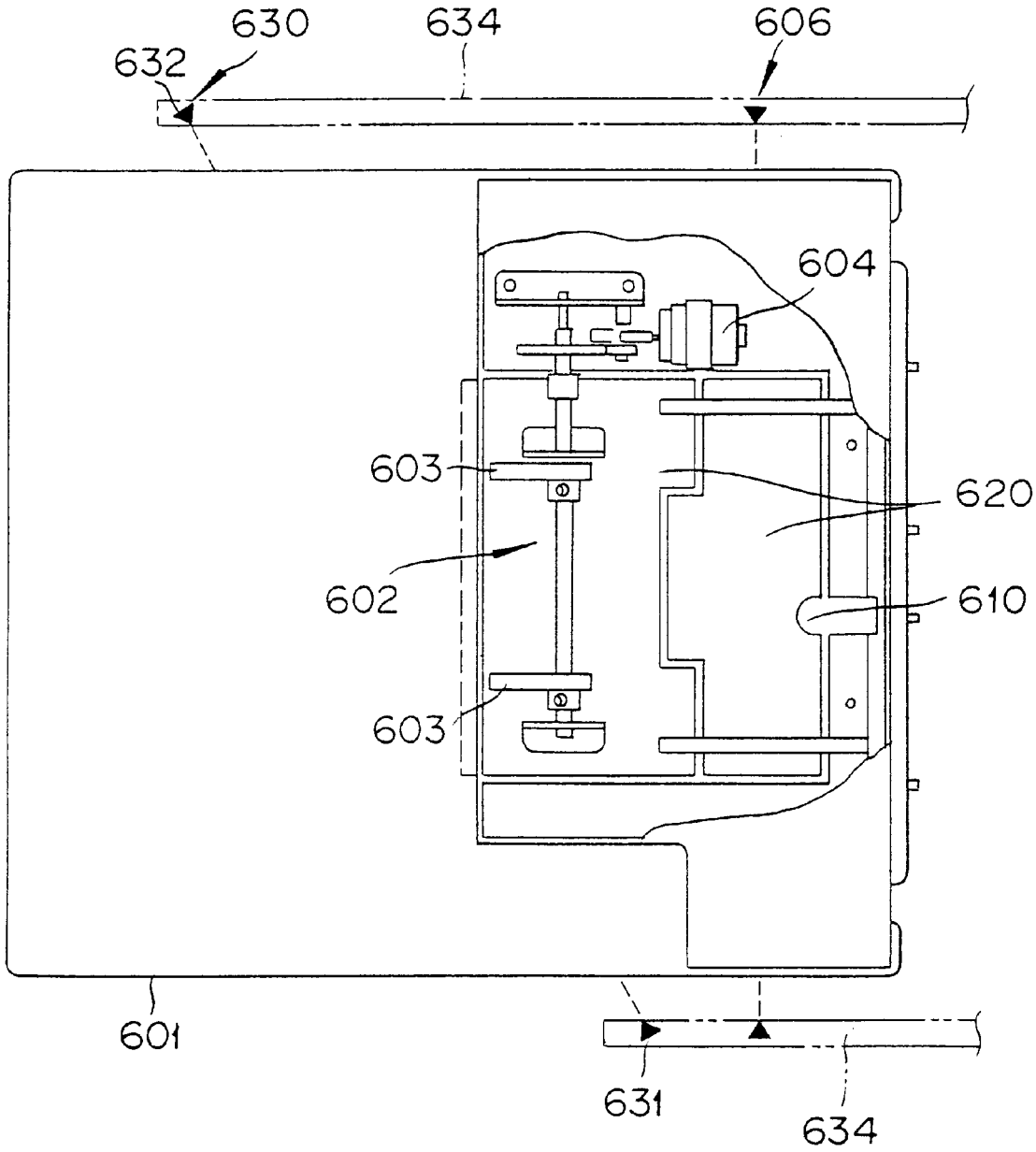
FIG. 33 is a partially cutaway bottom view illustrating an accumulating tray of the accumulating tray unit.

FIG. 32 is a structural diagram illustrating the accumulating tray unit 600 and FIG. 33 is a partially cutaway bottom view illustrating the accumulating tray 601 of the accumulating tray unit 600. A sheaf of sheets or lone sheet is successively outputted into the accumulating tray unit 600. The sheaf or the lone sheet will be expressed hereinafter as "sheet/sheaf" for the sake of the convenience of description.

The accumulating tray unit 600, as illustrated in FIG. 32, comprises the accumulating tray 601 which stores the sheet/sheaf and moves up and down proportionate to the amount of accumulation, an elevating mechanism which raises and lowers the accumulating tray 601, an angle adjusting device 602 which adjusts the angle of the tray (the angle of inclination of the accumulating base relative to the horizontal position), depending on the condition of the additional-working performed on the discharged sheet, an empty sensor 605 which detects the presence or absence of the sheet/sheaf on the accumulating tray 601, and an upper face sensor 606 which detects the upper face of the sheet/sheaf stacked on the tray 601. The discharged sheet sensor 124 is disposed on the upstream side of the discharging rollers 122, 123.

The sheet/sheaf given various additional-workings (folding, punching and stapling) and the sheet/sheaf without no additional-workings after outputted from the copying machine 10 are discharged onto the accumulating tray 601. The accumulating tray 601 is movable up and down and can store a large number of sheet/sheaf. The accumulating tray 601 is formed in a shape such that the leading end (the left end in FIG. 32) is raised, and can secure a perfect property of either discharging or stacking such sheets with no fold. The accumulating tray 601, as illustrated in FIG. 33, has a larger width than the acceptable largest width of sheet and has the opposite ends, in the width direction of the basal section, retained with a retainer (not shown).

The elevating mechanism includes a reversible motor (not shown) which raises and lowers the accumulating tray 601, a guide rail, etc. This construction is well known in the art, it will be omitted from the description here.

The empty sensor 605 and the upper face sensor 606 are each formed of a transmission type photosensor provided with a light-emitting device and a light-sensitive device. The light-emitting device and the light-sensitive device of the empty sensor 605, as illustrated in FIG. 32, are vertically disposed as opposed to each other across the accumulating tray 601, and possessed of optical axes which intersect the stacking base via a through hole 610 (FIG. 33) formed in the accumulating tray 601.

The light-emitting device and the light-sensitive device of the upper face sensor 606, as illustrated likewise in FIG. 33, are disposed on the base of the accumulating tray 601 so as to intersect the upper section of the accumulating tray 601 in the width direction, and are possessed of optical axes extending along the width direction or CD-direction. The upper face sensor 606 is mounted on a supporting plate 634, which is raised from the casing of the finisher 100. The upper face sensor 606 is not vertically movable. The accumulating tray 601 is moved up and down by the elevating mechanism while the upper face sensor 606 detects the upper face of the sheet on the accumulating tray 601. Namely, the drop distance of the sheet/sheaf from the nip part of the discharging rollers 122, 123 is kept constant without reference to the amount of sheets stacked on the accumulating tray 601.

The angle adjusting device 602, as illustrated in FIG. 32, comprises a movable plate 620 which is mounted rotatably to the accumulating tray 601 and protrudes freely from the stacking base, a cam 603 which contacts to the lower face of the movable plate 620 and rotates in one direction, and a drive motor 604 which rotates the cam 603. The amount of the protrusion of the movable plate 620 varies in proportion to the amount of rotation of the cam 603. The inclination of the tray is adjusted to a desired angle based on the above mechanism. The upper face of the movable plate 620 and the direction in which the sheet is discharged by the discharging rollers 122, 123 are nearly parallel when the movable plate 620 is elevated to the upper limit. The elevation of the accumulating tray 601 is controlled by actuating the elevating mechanism based on the signals from the discharged sheet sensor 124, the upper face sensor 606, and the empty sensor 605.

[Operation of accumulating tray unit 600]

Figure 34A:
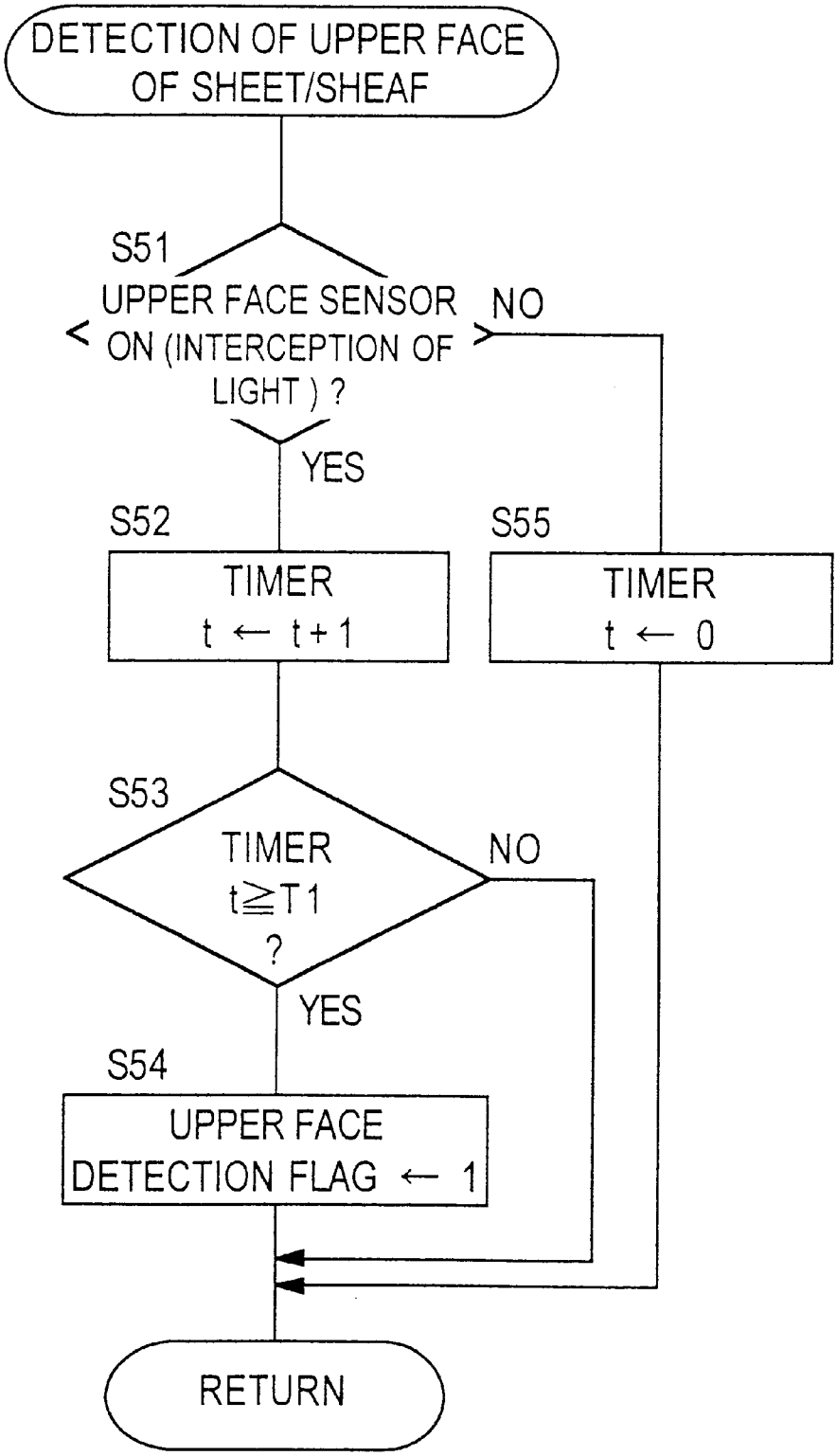
FIG. 34A is a flow chart illustrating a control routine for the detection of the upper face of sheets (sheaf) in a series of operations of the accumulating tray unit.
Figure 34B:
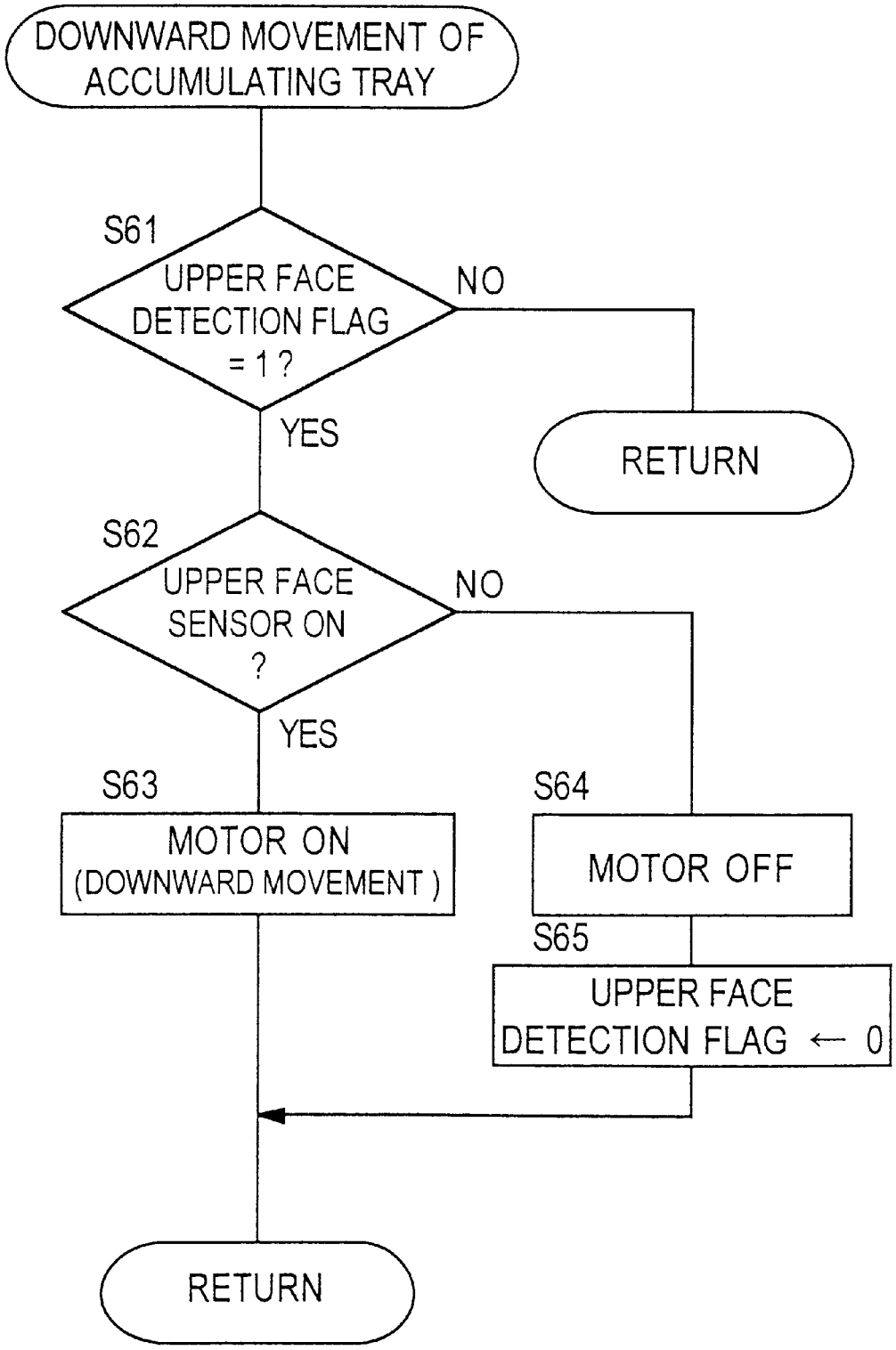
FIG. 34B is a flow chart illustrating the control routine for moving the accumulating tray downward with a drive motor in the series of operations of the accumulating tray unit.

FIG. 34A and FIG. 34B are respectively a flow chart illustrating a control routine for detecting the upper face of sheet/sheaf and a control routine for moving the accumulating tray 601 down with a drive motor in a series of operations of the accumulating tray unit 600.

The operation of the accumulating tray unit 600 will be described below with respect to the case (1) of discharging unfolded sheets one by one and the case (2) of discharging a sheaf obtained by subjecting sheets without a crease to either leading end fold or trailing end fold. The operation involved in the case of discharging a sheaf centrally creased and bounded like a weekly magazine will be described herein below.

(1) Case of Discharging Unfolded Sheets One by One

The accumulating tray 601 is elevated by the elevating mechanism when the empty sensor 605 detects the absence of a sheet on the accumulating tray 601. The elevating mechanism is stopped as soon as the upper face of the accumulating tray 601 intercepts the light incident on the upper face sensor 606. As a result, the accumulating tray 601 is kept at a lower position separated by a certain distance from the nip part of the discharging rollers 122, 123. And the accumulating tray 601 is kept waiting at the position, or the initial position until the sheet is discharged.

When the sheet is discharged onto the accumulating tray 601, the empty sensor 605 judges that the sheet exists. The accumulating tray 601 is gradually lowered by the elevating mechanism under the condition that the sheet exists on the accumulating tray 601. The elevating mechanism is stopped as soon as the interception of the light incident on the upper face sensor 606 is released.

To be more specific, the timer is started when the upper face sensor 606 detects the sheet as illustrated in FIG. 34A, namely when the stacked sheets intercept the light incident on the upper face sensor 606 and the sensor 606 becomes being in ON-state (S51 and S52). The upper face detection flag is set to be "1" when the upper face sensor 606 continuously detects the sheet for the duration of T1 [second] during a certain period following the detection of the trailing end of the sheet by the discharged sheet sensor 124, wherein T1 is shorter than the certain period ("Y" at S53, and S54). The timer is reset when the upper face sensor 606 does not continuously detect the sheet for the duration of T1 [second] (S55). When the upper face detection flag is "1" ("Y" at S61) as illustrated in FIG. 34B, it is judged whether or not the upper face sensor 606 has detected the sheet (S62). When the judgment is affirmative, the drive motor is actuated to lower the accumulating tray 601 ("Y" at S62, S63). When the interception of the light incident on the upper face sensor 606 is released and the upper face sensor 606 becomes being in OFF-state in consequence of the downward movement of the accumulating tray 601, the drive motor is stopped and the upper face detection flag is reset ("N" at S62, S64, S65)

When the discharge of sheets onto the accumulating tray 601 continues, the upper face sensor 606 is again hidden from the incident light by the stacked sheets. Then, the accumulating tray 601 is again lowered until the interception of the light incident on the upper face sensor 606 is released.

By repeating the steps, the distance between the nip part of the discharging rollers 122, 123 which have fixed positions and the uppermost face of the stacked sheets is kept to equal the distance at the initial position even when the number of stacked sheets happens to be large. Thus, the sheets can be always stacked steadily on the accumulating tray 602 without impairing the property of discharging sheets even when the number of sheets stacked on the accumulating tray 601 is large.

When the sheets on the accumulating tray 601 are removed, the empty sensor 605 detects the absence of a sheet and the accumulating tray 601 is elevated by reversing the rotation of the drive motor. The elevation of the accumulating tray 601 is stopped by halting the rotation of the drive motor when the upper face sensor 606 detects the upper face of the accumulating tray 601. Namely, the accumulating tray 601 is returned to be at the initial position for retaining desired distances between the tray 601 and the discharging rollers 122, 123.

(2) Case of Discharging Sheaf Obtained by Subjecting Sheets Without a Crease to Leading End Bind or Trailing End Bind In this case, the movable plate 620 of the angle adjusting device 602 is moved by the driving motor 604 until the face for receiving sheets is nearly leveled as illustrated in FIG. 32. After the movable plate 620 has been moved, the accumulating tray 601 is vertically moved until the upper face of the movable plate 620 reaches the position of the upper face sensor 606. As a result, the movable plate 620 assumes a position such that the sheet receiving face nearly parallel aligns with the direction of sheets discharged by the discharging rollers 122, 123. The operation of moving the movable plate 620 and the accumulating tray 601 is completed at least before the leading end of the first stapled sheaf reaches the discharging rollers 122, 123.

Thereafter, the sheaf is discharged onto the sheet receiving face of the movable plate 620 as kept nearly parallel to the discharging direction by the discharging rollers 122, 123. When the discharged sheaf intercepts the light incident on the upper face sensor 606, the accumulating tray 601 is lowered to a position such that the intersection of light incident on the upper face sensor 606 is released. It results in making it possible to discharge the stapled sheaf for the next jog under substantially the same condition as used for the sheaf for the previous job.

The sheaf is discharged, substantially parallel to the sheaf which has been already stacked on the accumulating tray 601. It results in preventing the leading end and the corners of the sheaf being discharged from contacting to a staple of the sheaf or reducing a shock in contacting to the staple. For that reason, such inconveniences as discharge failure of a sheaf of sheets, damage of the sheet as folds in corners, or misalignment of the sheet or the sheaf are no longer occurred.

Further, the discharge of unfolded sheets is attained without moving the movable plate 620 upward. Accordingly, both the discharge of unstapled sheets and the discharge of a stapled sheaf can be carried out satisfactorily on the single accumulating tray 601.

The accumulating tray 601 is moved upward and returned to the home position when the sheaf on the accumulating tray 601 is removed.

<<Guiding unit 160>>

[Construction of guide unit 160]

Figure 35A:
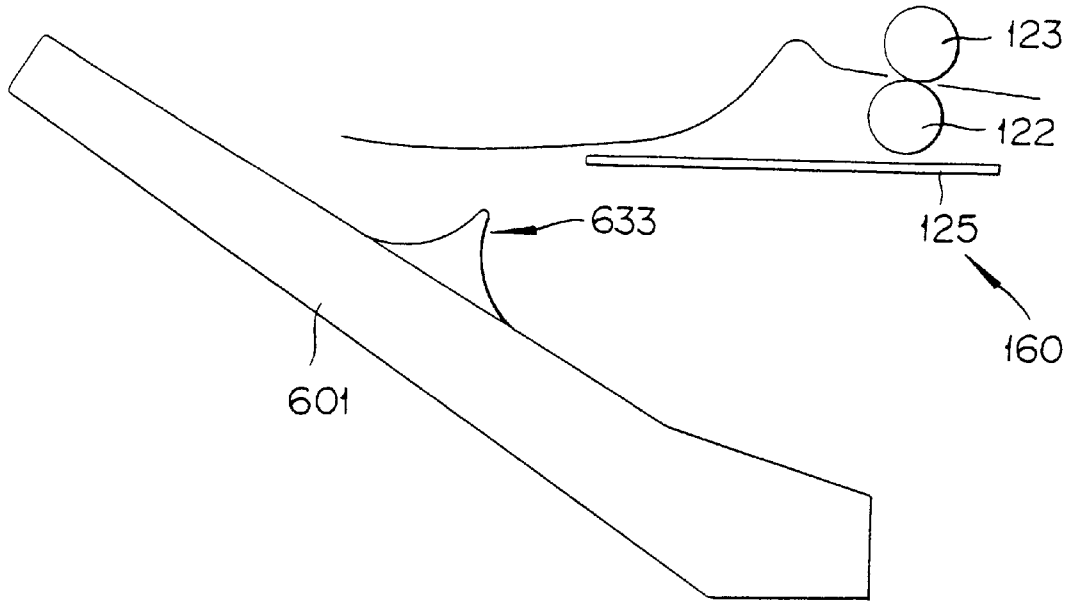
FIG. 35A is a schematic structural diagram illustrating an auxiliary guide of a guide unit.
Figure 35B:
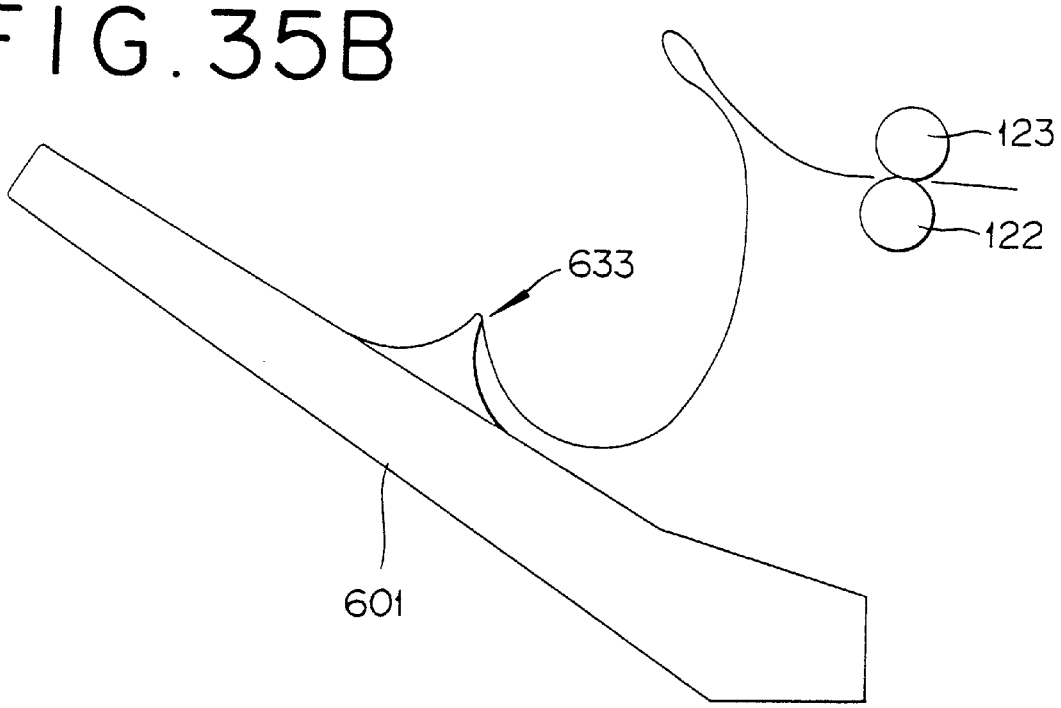
FIG. 35B is an explanatory diagram illustrating failed discharge of a sheaf like a weekly magazine in which the sheets are folded in two and the creases are bound.
Figure 36:
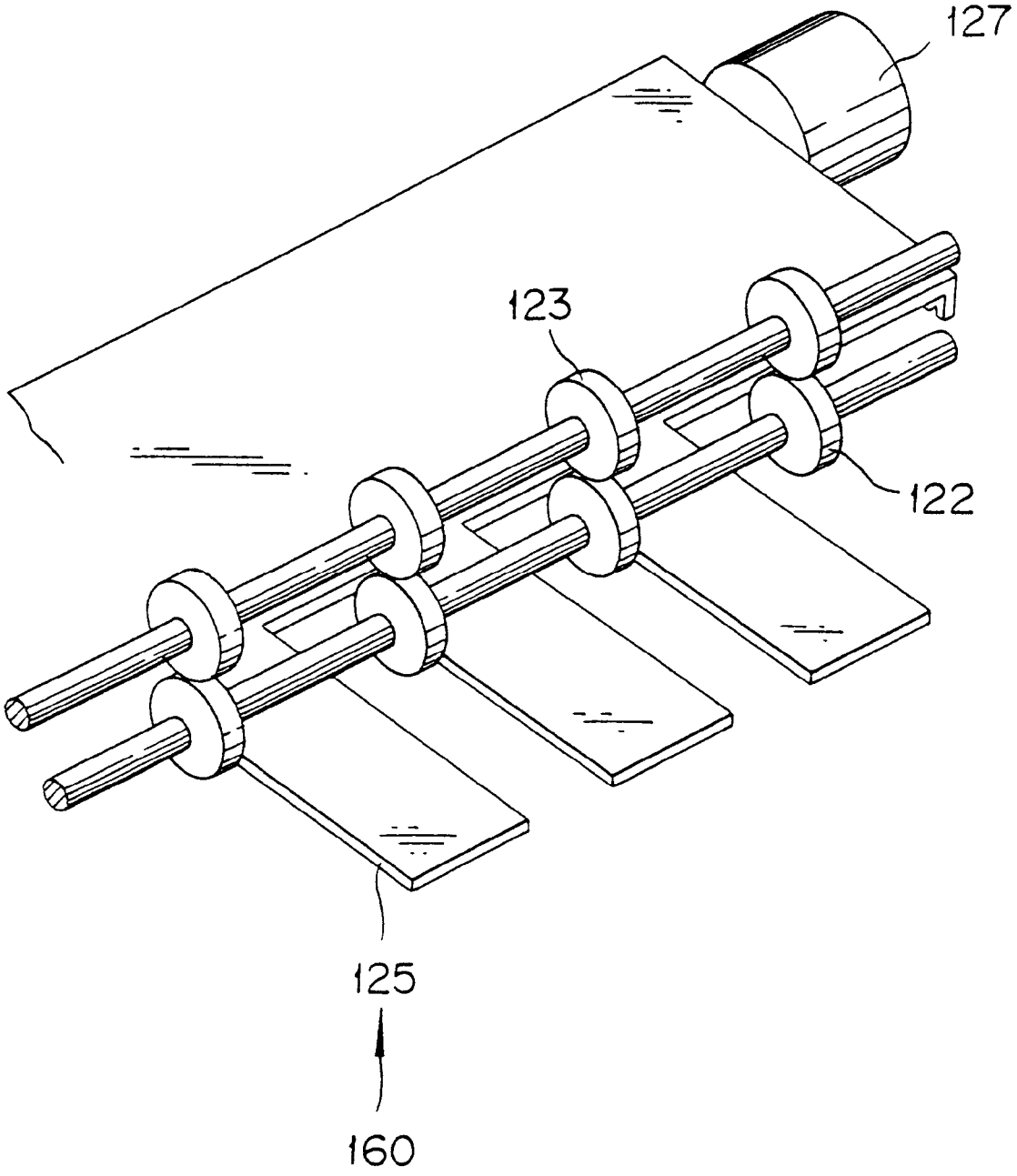
FIG. 36 is a perspective view illustrating the auxiliary guide.

FIG. 35A is a schematic structural diagram illustrating an auxiliary guide of the guide unit, FIG. 35B is an explanatory diagram illustrating discharge failure of a sheaf centrally creased and bound like a weekly magazine, and FIG. 36 is a perspective view illustrating the auxiliary guide.

The additional-worked sheaves include a so-called "weekly-magazine-like sheaf" which results from centrally creasing a sheet, stacking the sheet and centrally stapling the resultant sheaf. The weekly-magazine-like sheaf is stored on the accumulating tray 601 in an opened state that the stapled creases form a ridge 633, as illustrated in FIG. 35B. The discharging rollers 122, 123 discharge the weekly-magazine-like sheaf onto the accumulating tray 601 while the creases of the weekly-magazine-like sheaf rise. As soon as the creased central section of this sheaf passes through the nip part of the discharging rollers 122, 123, the leading end of the sheaf hangs down. A weekly magazine-like sheaf as have been stacked on the accumulating tray 601 has the possibility that the suspended leading end of the subsequently discharged weekly-magazine-like sheaf contacts and engages with the vicinities of the ridge 633 or the central raised section of the stacked weekly-magazine-like sheaf and thereby discharge failure of the subsequent sheaf is caused. To preclude the occurrence of such inconveniences, it is necessary that the leading end of the weekly-magazine-like sheaf being discharged should fall on the further downstream side of the ridge 633 of the weekly-magazine-like sheaf stacked on the accumulating tray 601 along the discharging direction.

From this point of view, the finisher 100 of the present embodiment is provided with the guide unit 160 which supports the lower face of the weekly-magazine-like sheaf freshly discharged from the discharging rollers 122, 123 as illustrated in FIG. 35A and FIG. 36. This guide unit 160 comprises an auxiliary guide 125 which is movable in a horizontal direction toward or away from the downstream side of the discharging rollers 122, 123 and a driving mechanism which moves the auxiliary guide 125 forward or backward.

The auxiliary guide 125 is constructed of a plate shaped nearly like a comb so as to avoid interfering with the lower discharging roller 122. The auxiliary guide 125 is disposed beneath the discharging rollers 122, 123. The auxiliary guide 125 moves forward or backward in a horizontal direction between the hindmost position at which the leading end is located on the upstream side from the nip position of the discharging rollers 122, 123 and the foremost position at which the leading end is located on the downstream side from the nip position. The foremost position of the auxiliary guide 125 is set such that the leading end of the weekly-magazine-like sheaf is discharged to pass over the ridge 633 of the weekly-magazine-like sheaf on the accumulating tray 601.

A rack (not shown) is integrally mounted to the auxiliary guide 125. The auxiliary guide 125 is moved forward or backward by transmitting the rotation of a motor 127 to the auxiliary guide 125 through the rack. The drive mechanism is composed of the rack, the motor 127, etc.

The auxiliary guide 125 is driven by the motor 127 to move the foremost position when the weekly-magazine-like sheaf is discharged. The weekly-magazine-like sheaf is discharged from the discharging rollers 122, 123, with the lower face supported by the auxiliary guide 125. The leading end of the sheaf falls on the further downstream side along the discharging direction from the ridge 633 of the sheaf on the accumulating tray 601.

[Operation of auxiliary guide 125]

Figure 37:
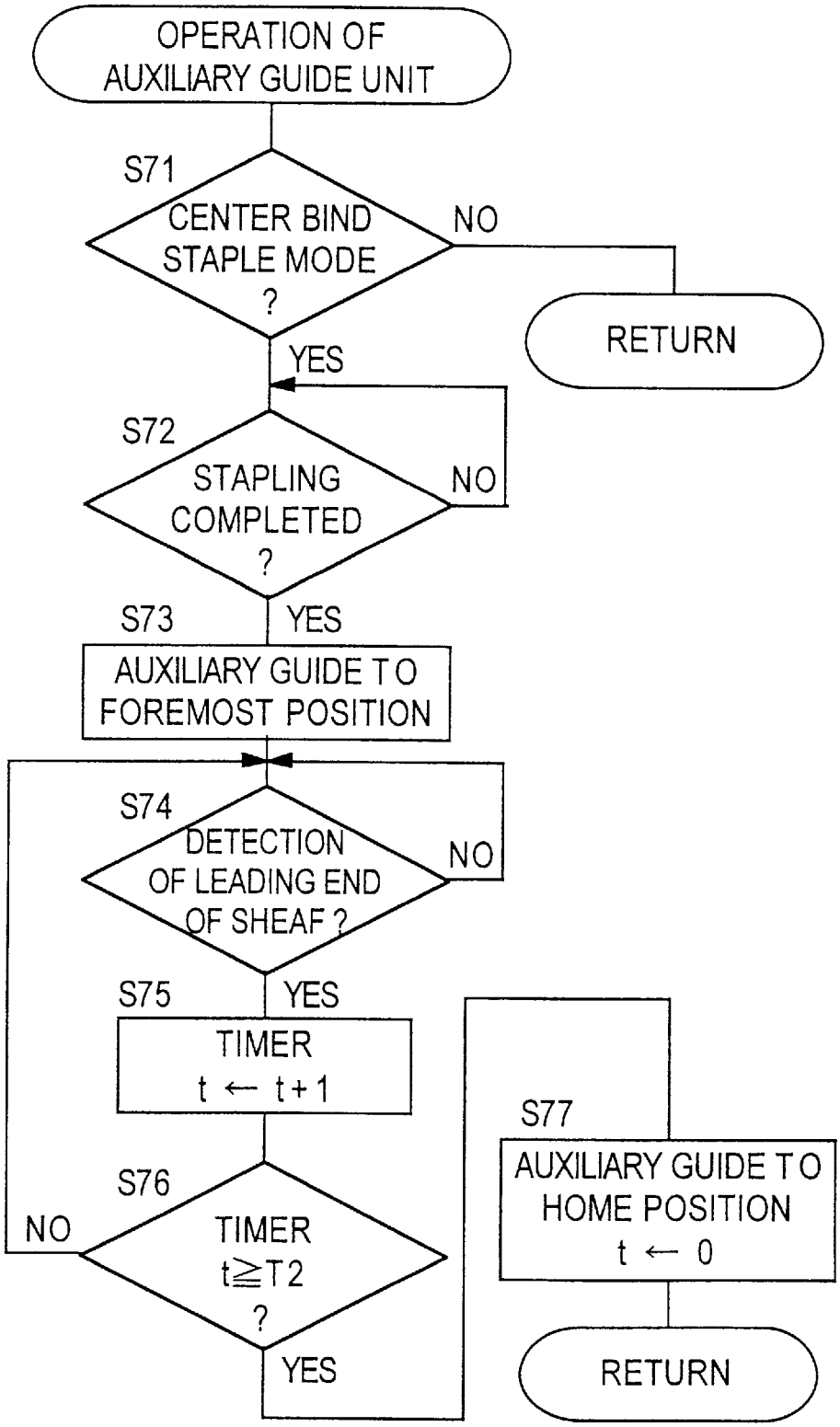
FIG. 37 is a flow chart illustrating steps for the operation of the guide unit.

FIG. 37 is a flowchart showing the steps of the operation of the guide unit 160.

The guide unit 160 is used exclusively when the mode of center bind staple or weekly-magazine-like sheaf is selected. When it is detected that the mode of center bind staple has been selected ("Y" at S71), the sheaf is aligned on the additional-work tray 401 and it is judged whether or not the stapler 500 has completed the stapling (S72). At the time that the stapling is completed ("Y" at S72), the motor 127 is actuated to move the auxiliary guide 125 to the foremost position so as to partly cover the upper face of the accumulating tray 601 (S73), as illustrated in FIG. 35A and FIG. 36. Besides, the sheaf has already been conveyed by the third sheet-conveying rollers 119, 120 after the completion of stapling.

The timer is started when the discharged sheet sensor 124 detects the leading end of the sheaf ("Y" at S74, S75). The protrusion of the auxiliary guide 125 is retained until the timer counts up a certain time T2 (S75, "N" at S76). The time T2 is sufficient for the leading end of the sheaf being discharged to pass over the ridge 633 of the sheaf already stored in the accumulating tray 601.

The weekly-magazine-like sheaf is discharged as nipped by the discharging rollers 122, 123. The auxiliary guide 125 supports the lower face of the weekly-magazine-like sheaf being discharged. There is no possibility of the leading end hanging down. As a result, the weekly-magazine-like sheaf being discharged advances on the auxiliary guide 125 and cannot contact to the sheaf already stacked on the accumulating tray 601. The leading end of the sheaf being discharged infallibly falls on the further downstream side along the discharging direction from the ridge 633 of the sheaf on the accumulating tray 601. Namely, the leading end of the sheaf being discharged avoids contacting to the ridge 633 of the stacked sheaf and the defective discharge of the sheaf is precluded.

When the timer counts up the time T2 ("Y" at S76), the auxiliary guide 125 retracts to the home position (S77) and the sheaf being discharged falls in an unconstrained state onto the accumulating tray 601. The weekly-magazine-like sheaf for the next job is received and stored by the same steps.

In the above manner, the finisher 100 can secure perfectly the property of smoothly discharging a weekly-magazine-like sheaf. The auxiliary guide 125 can retract to the home position incapable of interfering with the discharged sheets. The accumulating tray 601 is allowed to keep the shape intact and to secure perfectly the property of smoothly discharging unfolded sheet/sheaf.

<<Ridge sensor 630>>

Figure 38:
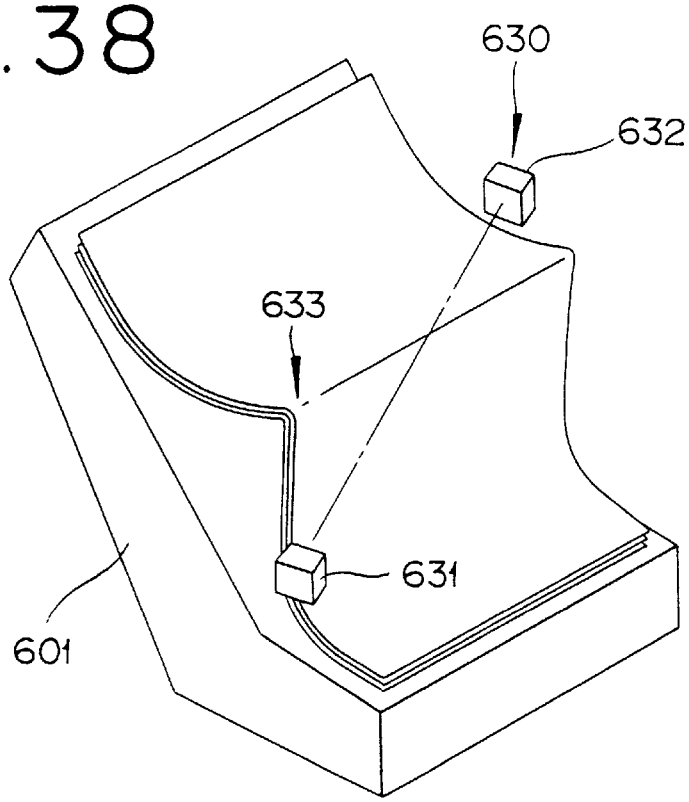
FIG. 38 is a schematic perspective view illustrating a ridge sensor provided in the accumulating tray unit.
Figure 39:
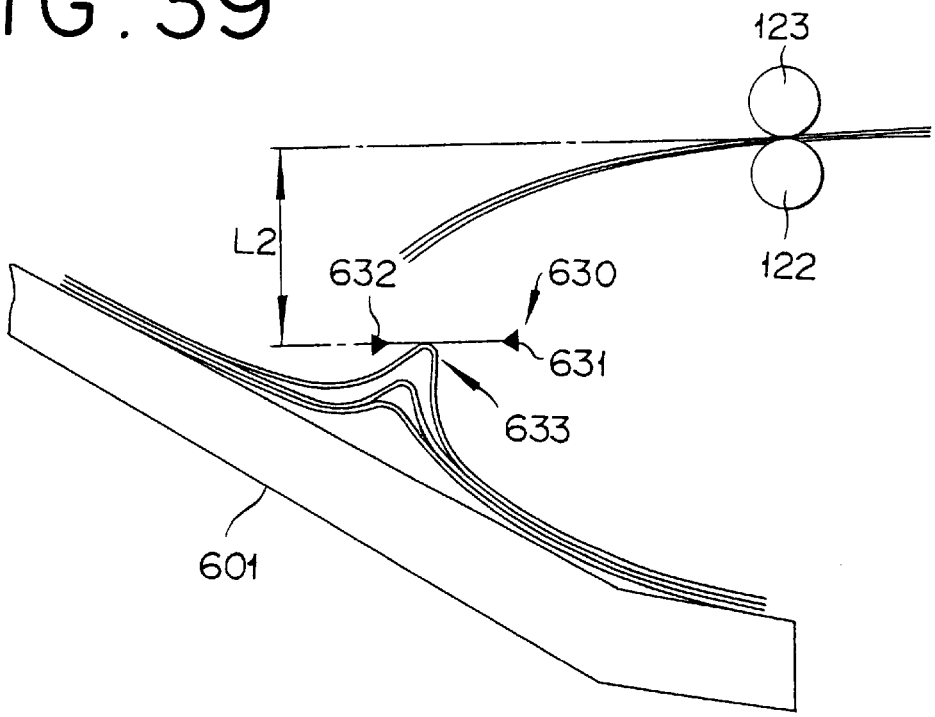
FIG. 39 is a diagram illustrating the state on which a weekly-magazine-like sheaf is stored.

FIG. 38 is a schematic perspective view illustrating a ridge sensor 630 which is provided for the accumulating tray unit 600 and FIG. 39 is a diagram illustrating the state in whish a weekly-magazine-like sheaf is stacked or stored.

The weekly-magazine-like sheaf is stacked on the accumulating tray 601 such that the bound section rises and is in the shape of a mountain. The accumulating tray unit 600 of the present embodiment particularly comprises a ridge sensor 630 which detects the ridge 633 of a weekly-magazine-like sheaf. The control of the elevation of the accumulating tray 601 is additionally attained based on the detection of the ridge 633 by the ridge sensor 630.

The ridge sensor 630 is constructed of a transmission type photosensor provided with a light-emitting device 631 and a light-sensitive device 632. The light-emitting device 631 and the light-sensitive device 632 are disposed so as to transverse obliquely the upper section of the accumulating tray 601 in the width direction and keep a certain distance ("L2" in FIG. 39) downward from the nip part of the discharging rollers 122, 123. The ridge sensor 630, therefore, is possessed of an optical axis which intersects the edge line of the ridge 633. The ridge sensor 630 is also mounted on the supporting plate 634 (FIG. 33). The distance L2 is such that the leading end of the weekly-magazine-like sheaf discharged by the discharging rollers 122, 123 is enabled to pass over the ridge 633 of the weekly-magazine-like sheaf stored on the accumulating tray 601. Specifically, the distance L2 is a size larger than the length of the leading end of the weekly-magazine-like sheaf which hangs down while being discharged.

The control of the elevation of the accumulating tray 601 based on the detection attained by the ridge sensor 630 is carried out as follows, in concert with the control of the forward and backward motion of the auxiliary guide 125.

The accumulating tray 601 is lowered by actuating the drive motor even when the upper face sensor 606 has not detect the sheaf when the ridge sensor 630 continuously detects the ridge 633 of the sheaf for the duration of the time t [second] during a certain period following the detection of the trailing end of the sheaf by the discharged sheet sensor 124, provided that the time t is shorter than the period. The downward movement of the accumulating tray 601 is stopped by halting the rotation of the drive motor when the detection of the ridge 633 by the ridge sensor 630 is interrupted (in case of a transmission state). The timer is reset, however, when the ridge sensor 630 fails to detect the ridge 633 continuously for the duration of the time t [second].

By forcibly lowering the accumulating tray 601 with respect to the presence of the ridge 633, the upper most section (ridge 633) of the weekly-magazine-like sheaf stacked on the accumulating tray 601 is always kept at a lower position separated by the distance L2 from the nip part of the discharging rollers 122, 123, irrespectively of the number of sheets stacked on the tray 601. The weekly-magazine-like sheaf being discharged cannot contact to the weekly-magazine-like sheaf already stored on the accumulating tray 601. The leading end of the sheaf being discharged infallibly falls on the further downstream side along the discharging direction from the ridge 633 of the sheaf on the accumulating tray 601. In brief, the leading end of the sheaf avoids coming in the contact with the ridge 633 of the stored sheaf and does not cause the discharge failure of the sheaf.

The control of the elevation of the accumulating tray 601 based on the detection attained by the ridge sensor 630 is executed exclusively during the discharge of a weekly-magazine-like sheaf. The control of the elevation based on the detection attained by the upper face sensor 606 is executed during the discharge of other forms of sheet/sheaf. Therefore, the property of discharging such other forms of sheet/sheaf is retained perfectly.

<<Construction of control system>>

Figure 40:
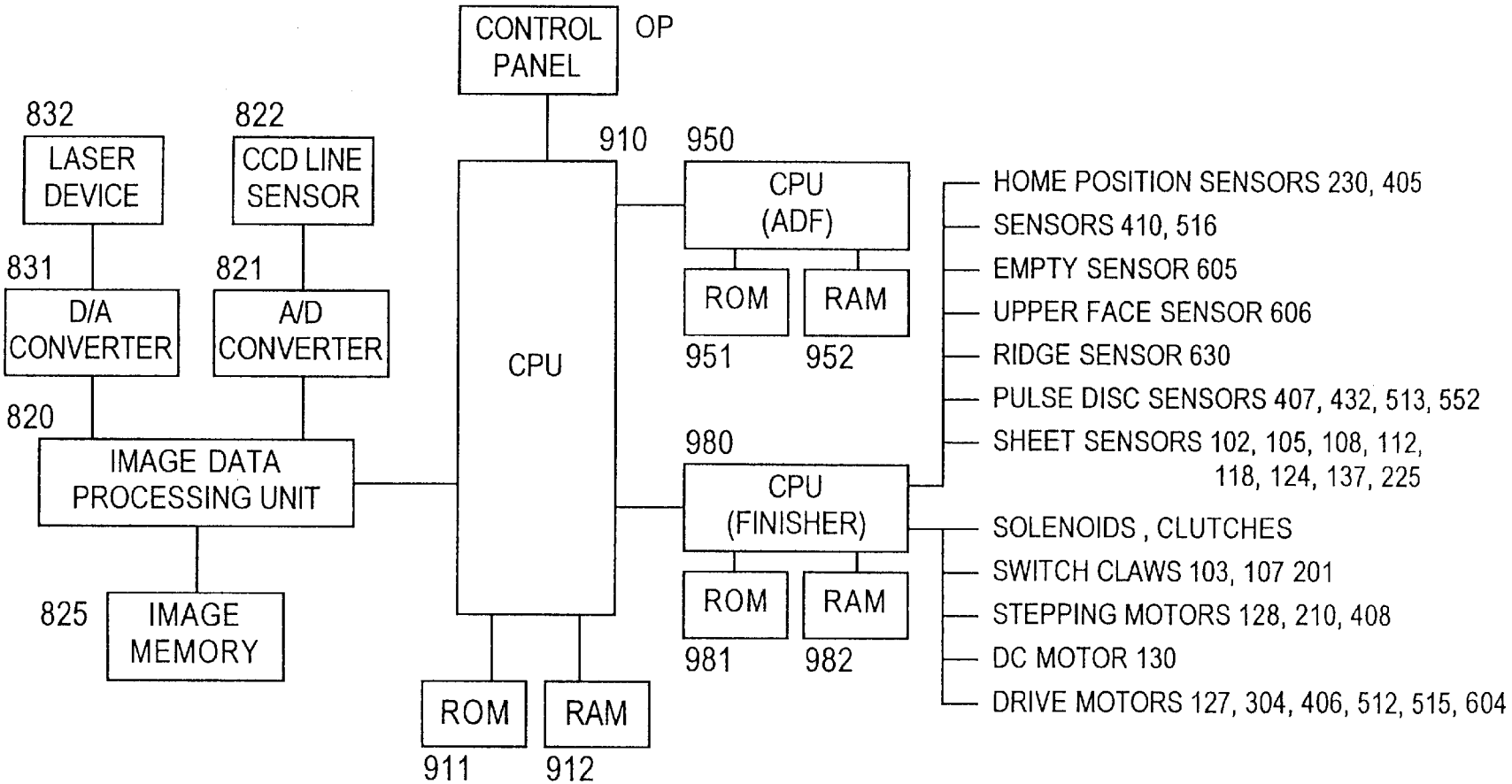
FIG. 40 is a block diagram illustrating a control system for controlling the various works or operation.

The system for controlling the various processing will be explained below. FIG. 40 is a block diagram of the control system for executing the various processing.

The control system is composed of a CPU 910 which controlling the copying machine, a CPU 950 which controls the ADF 12, and a CPU 980 which controls the finisher 100. These CPUs are provided respectively with ROM 911, 951 and 981 which store the control programs and RAM 912, 952 and 982 which function as relevant working areas.

The CPU 910 for the copying machine is provided with an image memory 825 which stores a scanned image data and an image data processing unit 820 which executes such image processing as rotation, enlargement, and reduction of the image based on the image data stored in the image memory 825. A CCD line sensor 822 of the image reader is connected to the image data processing unit 820 through an A/D converter 821 which converts the scanned analog signal into a digital signal. Further, the image data processing unit 820 controls a laser device 832 of an image forming device (not shown) through a D/A converter 831 which converts a digital signal as a digital image data to an analog signal as an analog image data for outputting.

Various driven units and sensors are connected to the CPU 980 for the finisher for controlling and actuating the various units or devices of the finisher. The driven units include the stepping motors 128, 210 and 408, the DC motor 130, the drive motors 127, 304, 406, 512, 515 and 604, many solenoids and clutches, the switch claws 103, 107 and 201, etc. The sensors include the home position sensors 230, 405 provided in the folding device 200 and the additional-work tray unit 400 respectively, the empty sensor 605, the upper face sensor 606 and the ridge sensor 630 provided in the accumulating tray unit 600, the sheet sensors 102, 105, 108, 112, 118, 124, 137 and 225 provided in the conveying paths for sheet/sheaf, the pulse disc sensors 407, 432, 513 and 552 for controlling the rotation of motors, and other sensors 410 and 516. The ROM 981 connected to the CPU 980 for the finisher stores the certain distance "$\alpha$" for calculating the moving length of the trailing end stopper 403 and the number of sheets as thresholds for determining leading end bind and training end bind.

The CPU 910 for the copying machine calculates the number of output sheets besides the basic operations proper for a copying machine (such as reading an image data on a document, storing the image data in memory, editing or processing the image data, forming an edited image on a paper, and outputting the paper). Specifically, the CPU 910 controls the document feeding of the ADF 12, obtains the number of documents from the ADF 12, and calculates the number of output sheets based on the number of documents and the copy mode inputted through the control panel. The result of the calculation is inputted to the CPU 980 for the finisher. The CPU 980 effects the choice between the leading end bind and the trailing end bind based on the threshold value, a level of priority concerning the productivity, etc. In case of the trailing end bind, the CPU 980 inputs an instruction for rotating an image to the CPU 910 for the copying machine. In the above manner, the leading end bind or the trailing end bind is automatically selected. The user optionally makes the selection through the control panel besides the automatic selection of the leading end bind and the trailing end bind. In the case, it is automatically judged whether or not the output image is rotated, based on the binding position for a specified image and the instructed stapling position (leading end bind or trailing end bind). A command for rotating the output image and effecting right bind even in the case of trailing end bind is generated when the user instructs the right bind and the trailing end bind.

The entire disclosure of Japanese Patent Application No. 09-058120 filed on Mar. 12, 1997, including the specification, claims, drawings and summary are incorporated herein by reference in its entirety.

What is claimed is:

1. A finisher for stacking sheets comprising:

a receiving tray unit to receive a plurality of sheets;

a first regulating device to contact leading edges of a plurality of sheets received within the receiving tray unit;

a second regulating device, movable in a direction parallel to a direction of discharge of a sheet received in the receiving tray unit, to contact trailing edges of a plurality of sheets received within the receiving tray unit; and a controller to control a movement of the second regulating device to push at least one sheet received within the receiving tray unit against the first regulating device to align a plurality of sheets received in the receiving tray unit in the direction of discharge.

2. A finisher according to claim 1, wherein the plurality of sheets can include a folded sheet.

3. A finisher according to claim 2, wherein the folded sheet is double-folded.

4. A finisher according to claim 2, wherein the folded sheet has a z-folding.

5. A finisher according to claim 1, wherein the finisher is adapted to receive a sheet from a connected device.

6. A finisher according to claim 5, further comprising:

a folding apparatus for folding a sheet received from the device.

7. A finisher according to claim 5, further comprising:

a stapling apparatus for stapling a plurality of sheets.

8. A finisher according to claim 5, further comprising:

a binding apparatus for binding a plurality of sheets.

9. A finisher according to claim 1, wherein, said second regulating device has a curved shape.

10. A finisher for stacking sheets comprising:

a receiving tray unit to receive a plurality of sheets;

a first regulating device to contact leading edges of a plurality of sheets received within the receiving tray unit;

a second regulating device, movable in a direction parallel to a direction of discharge of a sheet received in the receiving tray unit, to contact trailing edges of a plurality of sheets received within the receiving tray unit; and a controller (i) to control a movement of the second regulating device to move the second regulating device to, and wait at, a position separated by a prescribed distance from at least one sheet received in the receiving tray unit and (ii) to move the second regulating device from the position to push at least one sheet received within the receiving tray unit to align a plurality of sheets received in the receiving tray unit in the direction of discharge.

11. A finisher according to claim 10, wherein the plurality of sheets can include a folded sheet.

12. A finisher according to claim 11, wherein the folded sheet is double-folded.

13. A finisher according to claim 11, wherein the folded sheet has a z-folding.

14. A finisher according to claim 10, wherein the finisher is adapted to receive a sheet from a connected device.

15. A finisher according to claim 14, further comprising:

a folding apparatus for folding a plurality of sheets.

16. A finisher according to claim 14, further comprising:

a stapling apparatus for stapling a plurality of sheets.

17. A finisher according to claim 14, further comprising:

a binding apparatus for binding a plurality of sheets.

18. A finisher according to claim 10, wherein, said second regulating device has a curved shape.

19. A method of alignment for a plurality of sheets stacked in a receiving tray unit of a finisher, the finisher having a first regulating device to contact leading edges of a plurality of sheets received within the receiving tray unit and a second regulating device, which is movable in a direction parallel to a direction of discharge of a sheet received in the receiving tray unit, to contact trailing edges of a plurality of sheets received within the receiving tray unit, the method comprising the steps of:

determining a length of a sheet to be received in the receiving tray unit during a finishing operation;

moving the second regulating device from a home position to a first position, wherein said first position is based on a determined length of a sheet to be received in the receiving tray; and receiving a plurality of sheets into the receiving tray unit, wherein a trailing edge of each received sheet contacts the second regulating device as each sheet is received into the receiving tray unit.

20. A method according to claim 19, further comprising the step of:

aligning a plurality of sheets received in the receiving tray unit in the direction of discharge, wherein for the step of aligning, the second regulating device is moved in a reciprocating motion between the first position and a second position so as to push the plurality of sheets into the first regulating device.

21. A method according to claim 20, wherein the aligning step is performed after all sheets in the plurality of sheets to be stacked have been received by the receiving tray unit.

22. A method according to claim 20, wherein the aligning step is performed after each sheet in the plurality of sheets to be stacked has been received by the receiving tray unit.

23. A method according to claim 20, wherein the aligning step is performed after a prescribed number of sheets in the plurality of sheets to be stacked has been received by the receiving tray unit.

* * * * *